US009659573B2

(12) United States Patent
Yamamoto et al.

(10) Patent No.: US 9,659,573 B2
(45) **Date of Patent: *May 23, 2017**

(54) SIGNAL PROCESSING APPARATUS AND SIGNAL PROCESSING METHOD, ENCODER AND ENCODING METHOD, DECODER AND DECODING METHOD, AND PROGRAM

(71) Applicant: SONY CORPORATION, Tokyo (JP)

(72) Inventors: Yuki Yamamoto, Tokyo (JP); Toru Chinen, Kanagawa (JP); Hiroyuki Honma, Chiba (JP); Yuhki Mitsufuji, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/585,974

(22) Filed: Dec. 30, 2014

(65) Prior Publication Data

US 2015/0120307 A1 Apr. 30, 2015

Related U.S. Application Data

(63) Continuation of application No. 13/639,338, filed as application No. PCT/JP2011/059030 on Apr. 11, 2011, now Pat. No. 8,949,119.

(30) Foreign Application Priority Data

| | | |
|---|---|---|
| Apr. 13, 2010 | (JP) | 2010-092689 |
| Jan. 28, 2011 | (JP) | 2011-017230 |
| Mar. 29, 2011 | (JP) | 2011-072381 |

(51) Int. Cl.
*G10L 19/00* (2013.01)
*G10L 21/02* (2013.01)
(Continued)

(52) U.S. Cl.
CPC ..... *G10L 21/0205* (2013.01); *G10L 19/0204* (2013.01); *G10L 21/0388* (2013.01); *G10L 25/18* (2013.01); *G10L 19/167* (2013.01)

(58) Field of Classification Search
CPC ..... G10L 19/008; G10L 19/032; G10L 21/02; H04S 3/008
(Continued)

(56) References Cited

U.S. PATENT DOCUMENTS

| | | | |
|---|---|---|---|
| 4,628,529 | A | 12/1986 | Borth et al. |
| 6,073,100 | A | 6/2000 | Goodridge, Jr. |

(Continued)

FOREIGN PATENT DOCUMENTS

| | | | |
|---|---|---|---|
| CN | 1992533 | A | 7/2007 |
| CN | 101178898 | A | 5/2008 |

(Continued)

OTHER PUBLICATIONS

Japanese Office Action dated Oct. 15, 2014, issued in Japanese Application No. JP-2010-162259 (2 pgs.).

(Continued)

*Primary Examiner* — Daniel Abebe
(74) *Attorney, Agent, or Firm* — Wolf, Greenfield & Sacks, P.C.

(57) ABSTRACT

The present invention relates to a signal processing apparatus and a signal processing method, an encoder and an encoding method, a decoder and a decoding method, and a program capable of reproducing music signal having a better sound quality by expansion of frequency band.
A high band decoding circuit decodes high band encoded data outputs a coefficient table having coefficients for the respective high band sub-bands, which are specified by a coefficient index obtained as a result of decoding. A decoding high band sub-band power calculation circuit calculates
(Continued)

decoded high band sub-band powers for the respective high band sub-bands based on low band signals and the coefficient table, and a decoded high band signal production unit produces decoded high band signals from these decoded high band sub-band powers. At this time, an extension and reduction unit newly produces or deletes coefficients of the coefficient table for the respective sub-bands to correspond to the number of sub-bands of the calculated decoded high band sub-band powers, thereby to extend or reduce the coefficient table. The present invention can be applied to a decoder.

15 Claims, 40 Drawing Sheets

(51) Int. Cl.

| | |
|---|---|
| ***G10L 19/02*** | (2013.01) |
| ***G10L 21/0388*** | (2013.01) |
| ***G10L 25/18*** | (2013.01) |
| *G10L 19/16* | (2013.01) |

(58) Field of Classification Search
USPC ..... 704/500
See application file for complete search history.

(56) References Cited

U.S. PATENT DOCUMENTS 6,415,251 B1 7/2002 Oikawa et al.
6,708,145 B1 3/2004 Liljeryd et al.
6,829,360 B1 12/2004 Iwata et al.
6,895,375 B2 5/2005 Malah et al.
7,003,451 B2 2/2006 Kjorling et al.
7,069,212 B2 6/2006 Tanaka et al.
7,139,702 B2 11/2006 Tsushima et al.
7,242,710 B2 7/2007 Ekstrand
7,246,065 B2 7/2007 Tanaka et al.
7,283,955 B2 10/2007 Liljeryd et al.
7,318,035 B2 1/2008 Andersen et al.
7,330,812 B2 2/2008 Ding
7,337,118 B2 2/2008 Davidson et al.
7,447,631 B2 11/2008 Truman et al.
7,899,676 B2 3/2011 Honma et al.
7,941,315 B2 5/2011 Matsuo
7,974,847 B2 7/2011 Kjoerling et al.
7,983,424 B2 7/2011 Kjorling et al.
7,991,621 B2 8/2011 Oh et al.
8,019,614 B2 9/2011 Takagi et al.
8,032,387 B2 10/2011 Davidson et al.
8,050,933 B2 11/2011 Davidson et al.
8,063,809 B2 11/2011 Liu et al.
8,078,474 B2 12/2011 Vos et al.
8,144,804 B2 3/2012 Chinen et al.
8,145,475 B2 3/2012 Kjoerling et al.
8,244,524 B2 8/2012 Shirakawa et al.
8,260,609 B2 9/2012 Rajendran et al.
8,321,229 B2 11/2012 Choo et al.
8,332,210 B2 12/2012 Nilsson et al.
8,340,213 B2 12/2012 Chinen et al.
8,346,566 B2 1/2013 Kjoerling et al.
8,352,249 B2 1/2013 Chong et al.
8,364,474 B2 1/2013 Honma et al.
8,370,133 B2 2/2013 Taleb et al.
8,386,243 B2 2/2013 Nilsson et al.
8,407,046 B2 3/2013 Gao
8,423,371 B2 4/2013 Yamanashi et al.
8,433,582 B2 4/2013 Ramabadran et al.
8,463,599 B2 6/2013 Ramabadran et al.
8,463,602 B2 6/2013 Oshikiri
8,484,036 B2 7/2013 Vos
8,498,344 B2 7/2013 Wilson et al.
8,527,283 B2 9/2013 Jasiuk et al.
8,560,330 B2 10/2013 Gao
8,688,441 B2 4/2014 Ramabadran et al.
8,793,126 B2 7/2014 Gao
8,818,541 B2 8/2014 Villemoes et al.
8,949,119 B2 2/2015 Yamamoto et al.
8,972,248 B2 3/2015 Otani et al.
9,047,875 B2 6/2015 Gao
9,177,563 B2 11/2015 Yamamoto et al.
9,208,795 B2 12/2015 Yamamoto et al.
9,294,062 B2 3/2016 Hatanaka et al.
9,361,900 B2 6/2016 Yamamoto et al.
9,390,717 B2 7/2016 Yamamoto et al.
9,406,306 B2 8/2016 Yamamoto et al.
9,406,312 B2 8/2016 Yamamoto et al.
9,437,197 B2 9/2016 Honma et al.
9,437,198 B2 9/2016 Hatanaka et al.
9,536,542 B2 1/2017 Yamamoto et al.
9,542,952 B2 1/2017 Hatanaka et al.
2002/0128835 A1 9/2002 Iso
2003/0033142 A1 2/2003 Murashima
2003/0093271 A1 5/2003 Tsushima et al.
2003/0093278 A1 5/2003 Malah
2003/0187663 A1 10/2003 Truman et al.
2003/0233234 A1 12/2003 Truman et al.
2004/0028244 A1 2/2004 Tsushima et al.
2005/0004793 A1* 1/2005 Ojala ..... G10L 21/038 704/219
2005/0060146 A1 3/2005 Oh
2005/0096917 A1 5/2005 Kjorling et al.
2005/0143985 A1 6/2005 Sung et al.
2005/0267763 A1 12/2005 Ojanpera
2006/0031075 A1 2/2006 Oh et al.
2006/0106620 A1 5/2006 Thompson et al.
2006/0136199 A1 6/2006 Nongpiur et al.
2006/0251178 A1 11/2006 Oshikiri
2006/0271356 A1 11/2006 Vos
2007/0040709 A1 2/2007 Sung et al.
2007/0071116 A1 3/2007 Oshikiri
2007/0088541 A1 4/2007 Vos et al.
2007/0150267 A1 6/2007 Honma et al.
2007/0165869 A1 7/2007 Ojanpera
2007/0219785 A1 9/2007 Gao
2007/0282599 A1 12/2007 Choo et al.
2007/0299656 A1 12/2007 Son et al.
2008/0027733 A1 1/2008 Oshikiri et al.
2008/0056511 A1 3/2008 Zhang et al.
2008/0097751 A1 4/2008 Tsuchinaga et al.
2008/0120118 A1 5/2008 Choo et al.
2008/0129350 A1 6/2008 Mitsufuji et al.
2008/0140425 A1 6/2008 Shimada
2008/0253587 A1 10/2008 Une
2008/0262835 A1 10/2008 Oshikiri
2008/0263285 A1 10/2008 Sharma et al.
2008/0270125 A1 10/2008 Choo et al.
2009/0048846 A1 2/2009 Smaragdis et al.
2009/0132238 A1 5/2009 Sudhakar
2009/0157413 A1 6/2009 Oshikiri
2009/0192792 A1 7/2009 Lee et al.
2009/0228284 A1 9/2009 Moon et al.
2009/0234657 A1 9/2009 Takagi et al.
2009/0248407 A1 10/2009 Oshikiri
2009/0265167 A1 10/2009 Ehara et al.
2009/0271204 A1 10/2009 Tammi
2009/0281811 A1 11/2009 Oshikiri et al.
2010/0017198 A1 1/2010 Yamanashi et al.
2010/0063802 A1 3/2010 Gao
2010/0063812 A1 3/2010 Gao
2010/0083344 A1 4/2010 Schildbach et al.
2010/0106494 A1 4/2010 Honma et al.
2010/0106509 A1 4/2010 Shimada
2010/0161323 A1 6/2010 Oshikiri
2010/0198587 A1 8/2010 Ramabadran et al.
2010/0198588 A1 8/2010 Sudo et al.
2010/0217607 A1 8/2010 Neuendorf et al.
2010/0222907 A1 9/2010 Hashimoto
2010/0226498 A1 9/2010 Kino et al.
2010/0228557 A1 9/2010 Chen et al.
2010/0241437 A1 9/2010 Taleb et al.
2010/0280833 A1 11/2010 Yamanashi et al.
2010/0286990 A1 11/2010 Biswas et al.

(56) References Cited

U.S. PATENT DOCUMENTS

| | | | | |
|---|---|---|---|---|
| 2010/0305956 | A1* | 12/2010 | Oh | G10L 19/008 704/500 |
| 2010/0318350 | A1 | 12/2010 | Endo et al. | |
| 2011/0046965 | A1 | 2/2011 | Taleb et al. | |
| 2011/0054911 | A1 | 3/2011 | Baumgarte et al. | |
| 2011/0075855 | A1 | 3/2011 | Oh et al. | |
| 2011/0106529 | A1 | 5/2011 | Disch | |
| 2011/0112845 | A1 | 5/2011 | Jasiuk et al. | |
| 2011/0137643 | A1 | 6/2011 | Yamanashi et al. | |
| 2011/0137659 | A1 | 6/2011 | Honma et al. | |
| 2011/0153318 | A1 | 6/2011 | Rossello et al. | |
| 2011/0170711 | A1 | 7/2011 | Rettelbach et al. | |
| 2011/0173006 | A1 | 7/2011 | Nagel et al. | |
| 2011/0178807 | A1 | 7/2011 | Yang et al. | |
| 2011/0222630 | A1 | 9/2011 | Suzuki et al. | |
| 2011/0264454 | A1 | 10/2011 | Ullberg et al. | |
| 2011/0282675 | A1 | 11/2011 | Nagel et al. | |
| 2011/0305352 | A1* | 12/2011 | Villemoes | G10L 21/0388 381/98 |
| 2012/0010880 | A1 | 1/2012 | Nagel et al. | |
| 2012/0016667 | A1 | 1/2012 | Gao | |
| 2012/0057711 | A1 | 3/2012 | Makino et al. | |
| 2012/0243526 | A1 | 9/2012 | Yamamoto et al. | |
| 2012/0328124 | A1 | 12/2012 | Kjoerling | |
| 2013/0028427 | A1 | 1/2013 | Yamamoto et al. | |
| 2013/0124214 | A1 | 5/2013 | Yamamoto et al. | |
| 2013/0202118 | A1 | 8/2013 | Yamamoto et al. | |
| 2013/0208902 | A1 | 8/2013 | Yamamoto et al. | |
| 2013/0218577 | A1 | 8/2013 | Taleb et al. | |
| 2013/0226598 | A1 | 8/2013 | Laaksonen et al. | |
| 2013/0275142 | A1 | 10/2013 | Hatanaka et al. | |
| 2014/0006037 | A1 | 1/2014 | Honma et al. | |
| 2014/0156289 | A1 | 6/2014 | Hatanaka et al. | |
| 2014/0172433 | A2 | 6/2014 | Honma et al. | |
| 2014/0180682 | A1 | 6/2014 | Shi et al. | |
| 2014/0200899 | A1 | 7/2014 | Yamamoto et al. | |
| 2014/0200900 | A1 | 7/2014 | Yamamoto et al. | |
| 2014/0205101 | A1 | 7/2014 | Yamamoto et al. | |
| 2014/0205111 | A1 | 7/2014 | Hatanaka et al. | |
| 2014/0211948 | A1 | 7/2014 | Hatanaka et al. | |
| 2014/0214432 | A1 | 7/2014 | Hatanaka et al. | |
| 2014/0214433 | A1 | 7/2014 | Hatanaka et al. | |
| 2014/0226822 | A1 | 8/2014 | Engdegard et al. | |
| 2015/0051904 | A1 | 2/2015 | Kikuiri et al. | |
| 2015/0088528 | A1 | 3/2015 | Toguri et al. | |
| 2015/0243295 | A1 | 8/2015 | Truman et al. | |
| 2016/0012829 | A1 | 1/2016 | Yamamoto et al. | |
| 2016/0019911 | A1 | 1/2016 | Yamamoto et al. | |
| 2016/0140982 | A1 | 5/2016 | Yamamoto et al. | |
| 2016/0225376 | A1 | 8/2016 | Honma et al. | |
| 2016/0322057 | A1 | 11/2016 | Yamamoto et al. | |
| 2016/0343380 | A1 | 11/2016 | Hatanaka et al. | |

FOREIGN PATENT DOCUMENTS

| | | | |
|---|---|---|---|
| EP | 1921610 | | 5/2008 |
| EP | 2 019 391 | | 1/2009 |
| EP | 2317509 | | 5/2011 |
| EP | 2 472 512 | | 7/2012 |
| JP | 3-254223 | | 11/1991 |
| JP | 10-020888 | A | 1/1998 |
| JP | 2003-216190 | | 7/2003 |
| JP | 2003-255973 | A | 9/2003 |
| JP | 2004-101720 | | 4/2004 |
| JP | 2004-258603 | | 9/2004 |
| JP | 2005-521907 | | 7/2005 |
| JP | 2006-048043 | | 2/2006 |
| JP | 2006-048043 | A | 2/2006 |
| JP | 2007-171821 | | 7/2007 |
| JP | 2007-171821 | A | 7/2007 |
| JP | 2008-139844 | | 6/2008 |
| JP | 2008-139844 | A | 6/2008 |
| JP | 2009-116371 | | 5/2009 |
| JP | 2009-134260 | A | 6/2009 |
| JP | 2010-020251 | | 1/2010 |
| JP | 2010-079275 | | 4/2010 |
| KR | 10-2006-0060928 | | 6/2006 |
| KR | 10-2007-0083997 | A | 8/2007 |
| KR | 10-2007-0118174 | A | 12/2007 |
| WO | WO 2006/049205 | | 5/2006 |
| WO | WO 2007/052088 | A1 | 5/2007 |
| WO | WO 2007/126015 | A1 | 11/2007 |
| WO | WO 2009-054393 | | 4/2009 |
| WO | WO 2009/054393 | A | 4/2009 |
| WO | WO 2009-093466 | | 7/2009 |
| WO | WO 2010/024371 | | 8/2009 |
| WO | WO 2011/043227 | | 4/2011 |

OTHER PUBLICATIONS

Notification of the Second Office Action issued by People's Republic of China Patent Office on Mar. 26, 2014, in corresponding Japanese Application or Patent No, 2011-80018932.3.

English-Language People's Republic of China Patent Office Search Report in corresponding JP 2011-80018932.3, mailed Mar. 26, 2014.

Liu, C., "High Frequency Reconstruction for Band-Limited Audio Signals", *Proc. of the 5th Int Conference on Digital Audio Effects*, Sep. 8-11, 2003, 6 pages.

Supplementary International Search Report from the European Patent Office in Application No. 10821898.3, dated Jan. 18, 2013, 8 pages.

International Search Report from the Japanese Patent Office in Application No. PCT/JP2011/059030, mailed Jul. 12, 2011, 2 pages.

Chennoukh, S. et al., "Speech Enhancement via Frequency Bandwidth Extension Using Line Spectral Frequencies" *IEEE*, pp. 665-668.

Supplementary European Search Report from the European Patent Office in Application No. 11768824.2, dated Nov. 6, 2013, 7 pages.

Extended Supplementary European Search Report from the European Patent Office in Application No. 11768825.9, dated Nov. 12, 2013, 9 pages.

Extended Supplementary European search Report from the European Patent Office in Application No. 11768826.7 dated Nov. 14, 2013, 7 pages.

Japanese Office Action mailed Aug. 5, 2014 in connection with Japanese Application No. 2011-072382.

Japanese Office Action mailed Aug. 12, 2014 in connection with Japanese Application No. 2011-072380.

Japanese Office Action mailed Mar. 17, 2015 in connection with Japanese Application No. 2011-072380.

Chinen et al., Report on PVC CE for SBR in USAC, Motion Picture Expert Group Meeting, Oct. 28, 2010, ISO/IEC JTC1/SC29/WG11, No. M18399, 47 pages.

Krishnan et al., EVRC-Wideband: The New 3GPP2 Wideband Vocoder Standard, Qualcomm Inc., IEEE International Conference on Acoustics, Speech, and Signal Processing, Apr. 15, 2007, pp. II-333-336.

No Author Listed, Information technology—Coding of audio-visual objects—Part 3: Audio, International Standard, ISO/IEC 14496-3:/Amd.1:1999(E), ISO/IEC JTC I/SC 29/WG 11, 199 pages.

No Author Listed, Information technology Coding of audio-visual objects Part 3: Audio, International Standard, ISO/IEC 14496-3:2001(E), Second Edition, Dec. 15, 2001, 110 pages.

* cited by examiner

FIG. 30

$$\begin{pmatrix} A_{sb+1}(sb-3) & A_{sb+1}(sb-2) & A_{sb+1}(sb-1) & A_{sb+1}(sb) & B_{sb+1} \\ A_{sb+2}(sb-3) & A_{sb+2}(sb-2) & A_{sb+2}(sb-1) & A_{sb+2}(sb) & B_{sb+2} \\ & & \vdots & & \\ A_{eb}(sb-3) & A_{eb}(sb-2) & A_{eb}(sb-1) & A_{eb}(sb) & B_{eb} \end{pmatrix}$$

FIG. 37

| | BAND-LIMITED FREQUENCY | SAMPLING FREQUENCY | CODEC | ENCODING ALGORITHM |
|---|---|---|---|---|
| CONDITION A | 8kHz | 20kHz | AAC | ALGORITHM A |
| CONDITION B | 5kHz | 30kHz | AAC | ALGORITHM A |
| CONDITION C | 5kHz | 20kHz | AMR | ALGORITHM B |
| CONDITION D | 5kHz | 20kHz | AAC | ALGORITHM C |

SIGNAL PROCESSING APPARATUS AND SIGNAL PROCESSING METHOD, ENCODER AND ENCODING METHOD, DECODER AND DECODING METHOD, AND PROGRAM

This is a continuation of application Ser. No. 13/639,338, filed Oct. 4, 2012, which is national stage entry of International Application No. PCT/JP2011/059030, filed Apr. 11, 2011 which claims the benefit of priority from Japanese Patent Application No. 2011-072381, filed Mar. 29, 2011, Japanese Patent Application No. 2011-017230, filed Jan. 28, 2011, and Japanese Patent Application No. 2010-092689, filed Apr. 13, 2010, the entire contents of all of which are incorporated herein by reference.

TECHNICAL FIELD

The present invention relates to a signal processing apparatus and a signal processing method, an encoder and an encoding method, a decoder and a decoding method, and a program, and more particularly to a signal processing apparatus and a signal processing method, an encoder and an encoding method, a decoder and a decoding method, and a program for reproducing a music signal with improved sound quality by expansion of a frequency band.

BACKGROUND ART

Recently, music distribution services for distributing music data via the internet have been increased. The music distribution service distributes, as music data, encoded data obtained by encoding a music signal. As an encoding method of the music signal, an encoding method has been commonly used in which the encoded data file size is suppressed to decrease a bit rate so as to save time during download.

Such an encoding method of the music signal is broadly divided into an encoding method such as MP3 (MPEG (Moving Picture Experts Group) Audio Layers 3) (International Standard ISO/IEC 11172-3) and an encoding method such as HE-AAC (High Efficiency MPEG4 AAC) (International Standard ISO/IEC 14496-3).

The encoding method represented by MP3 cancels a signal component of a high frequency band (hereinafter, referred to as a high band) having about 15 kHz or more in music signal that is almost imperceptible to humans, and encodes the low frequency band (hereinafter, referred to as a low band) of the signal component of the remainder. Therefore, the encoding method is referred to as a high band cancellation encoding method. This kind of high band cancellation encoding method can suppress the file size of encoded data. However, since sound in a high band can be perceived slightly by human, if sound is produced and output from the decoded music signal obtained by decoding the encoded data, suffers a loss of sound quality whereby a sense of realism of an original sound is lost and a sound quality deterioration such a blur of sound occurs.

Unlike this, the encoding method represented by HE-AAC extracts specific information from a signal component of the high band and encodes the information in conjunction with a signal component of the low band. The encoding method is referred to below as a high band characteristic encoding method. Since the high band characteristic encoding method encodes only characteristic information of the signal component of the high band as information on the signal component of the high band, deterioration of sound quality is suppressed and encoding efficiency can be improved.

In decoding data encoded by the high band characteristic encoding method, the signal component of the low band and characteristic information are decoded and the signal component of the high band is produced from a signal component of the low band and characteristic information after being decoded. Accordingly, a technology that expands a frequency band of the signal component of the high band by producing a signal component of the high band from signal component of the low band is referred to as a band expansion technology.

As an application example of a band expansion method, after decoding of data encoded by a high band cancellation encoding method, a post process is performed. In the post process, the high band signal component lost in the encoding is generated from the decoded low band signal component, thereby expanding the frequency band of the signal component of the low band (see Patent Document 1). The method of frequency band expansion of the related art is referred below to as a band expansion method of Patent Document 1.

In a band expansion method of the Patent Document 1, the apparatus estimates a power spectrum (hereinafter, suitably referred to as a frequency envelope of the high band) of the high band from the power spectrum of an input signal by setting the signal component of the low band after decoding as the input signal and produces the signal component of the high band having the frequency envelope of the high band from the signal component of the low band.

FIG. 1 illustrates an example of a power spectrum of the low band after the decoding as an input signal and a frequency envelope of an estimated high band.

In FIG. 1, the vertical axis illustrates a power as a logarithm and a horizontal axis illustrates a frequency.

The apparatus determines the band in the low band of the signal component of the high band (hereinafter, referred to as an expansion start band) from a kind of an encoding system on the input signal and information such as a sampling rate, a bit rate and the like (hereinafter, referred to as side information). Next, the apparatus divides the input signal as signal component of the low band into a plurality of sub-band signals. The apparatus obtains a plurality of sub-band signals after division, that is, an average of respective groups (hereinafter, referred to as a group power) in a time direction of each power of a plurality of sub-band signals of a low band side lower than the expansion start band is obtained (hereinafter, simply referred to as a low band side). As illustrated in FIG. 1, according to the apparatus, it is assumed that the average of respective group powers of the signals of a plurality of sub-bands of the low band side is a power and a point making a frequency of a lower end of the expansion start band be a frequency is a starting point. The apparatus estimates a primary straight line of a predetermined slope passing through the starting point as the frequency envelope of the high band higher than the expansion start band (hereinafter, simply referred to as a high band side). In addition, a position in a power direction of the starting point may be adjusted by a user. The apparatus produces each of a plurality of signals of a sub-band of the high band side from a plurality of signals of a sub-band of the low band side to be an estimated frequency envelope of the high band side. The apparatus adds a plurality of the produced signals of the sub-band of the high band side to each other into the signal components of the high band and adds the signal components of the low band to each other to output the added signal components. Therefore, the music signal after expansion of the frequency band is close to the original music signal. However, it is possible to produce the music signal of a better quality.

The band expansion method disclosed in the Patent Document 1 has an advantage that the frequency band can be expanded for the music signal after decoding of the encoded data with respect to various high band cancellation encoding methods and encoded data of various bit rates.

CITATION LIST

Patent Document

Patent Document 1: Japanese Patent Application Laid-Open No. 2008-139844

SUMMARY OF THE INVENTION

Problems to be Solved by the Invention

Accordingly, the band expansion method disclosed in Patent Document 1 may be improved in that the estimated frequency envelope of a high band side is a primary straight line of a predetermined slope, that is, a shape of the frequency envelope is fixed.

In other words, the power spectrum of the music signal has various shapes and the music signal has a lot of cases where the frequency envelope of the high band side estimated by the band expansion method disclosed in Patent Document 1 deviates considerably.

FIG. 2 illustrates an example of an original power spectrum of an attack music signal (attack music signal) having a rapid change in time as a drum is strongly hit once.

In addition, FIG. 2 also illustrates the frequency envelope of the high band side estimated from the input signal by setting the signal component of the low band side of the attack relative music signal as an input signal by the band expansion method disclosed in the Patent Document 1.

As illustrated in FIG. 2, the power spectrum of the original high band side of the attack music signal has a substantially flat shape.

Unlike this, the estimated frequency envelope of the high band side has a predetermined negative slope and even if the frequency is adjusted to have the power close to the original power spectrum, difference between the power and the original power spectrum becomes large as the frequency becomes high.

Accordingly, in the band expansion method disclosed in Patent Document 1, the estimated frequency envelope of the high band side cannot reproduce the frequency envelope of the original high band side with high accuracy. Therefore, if sound from the music signal after the expansion of the frequency band is produced and output, clarity of the sound in auditory is lower than the original sound.

In addition, in the high band characteristic encoding method such as HE-AAC and the like described above, the frequency envelope of the high band side is used as characteristic information of the encoded high band signal components. However, it needs to reproduce the frequency envelope of the original high band side with high accuracy in a decoding side.

The present invention has been made in a consideration of such a circumstance and provides a music signal having a better sound quality by expanding a frequency band.

Solutions to Problems

A signal processing apparatus according to a first aspect of the present invention includes: a demultiplexing unit that demultiplexes input encoded data to at least low band encoded data and coefficient information; a low band decoding unit that decodes the low band encoded data to produce low band signals; a selection unit that selects a coefficient table which is obtained based on the coefficient information among a plurality of coefficient tables used for the production of high band signals and having coefficients for the respective sub-bands on a high band side; an extension and reduction unit that deletes the coefficients of some sub-bands to reduce the coefficient table or produces the coefficients of predetermined sub-bands based on the coefficients of some sub-bands to extend the coefficient table; a high band sub-band power calculation unit that calculates high band sub-band powers of high band sub-band signals of the respective sub-bands constituting the high band signals based on low band sub-band signals of the respective sub-bands constituting the low band signals and the extended or reduced coefficient table; and a high band signal production unit that produces the high band signals based on the high band sub-band powers and the low band sub-band signals.

The extension and reduction unit may duplicate the coefficients of a sub-band having a highest frequency which is included in the coefficient table and set the duplicated coefficients to coefficients of a sub-band having a higher frequency than the highest frequency to extend the coefficient table.

The extension and reduction unit may delete the coefficients of a sub-band, which has a higher frequency than that of a sub-band having a highest frequency among sub-bands of the high band sub-band signals, from the coefficient table to reduce the coefficient table.

A signal processing method or a program according to the first aspect of the invention includes the steps of demultiplexing input encoded data to at least low band encoded data and coefficient information; decoding the low band encoded data to produce low band signals; selecting a coefficient table which is obtained based on the coefficient information among a plurality of coefficient tables used for the production of high band signals and having coefficients for the respective sub-bands on a high band side; deleting the coefficients of some sub-bands to reduce the coefficient table or generating the coefficients of predetermined sub-bands based on the coefficients of some sub-bands to extend the coefficient table; calculating high band sub-band powers of high band sub-band signals of the respective sub-bands constituting the high band signals based on low band sub-band signals of the respective sub-bands constituting the low band signals and the extended or reduced coefficient table; and generating the high band signals based on the high band sub-band powers and the low band sub-band signals.

According to the first aspect of the invention, input encoded data is demultiplexed to at least low band encoded data and coefficient information; the low band encoded data is decoded to produce low band signals; a coefficient table which is obtained based on the coefficient information is selected among a plurality of coefficient tables used for the production of high band signals and having coefficients for the respective sub-bands on a high band side; the coefficients of some sub-bands are deleted to reduce the coefficient table or the coefficients of predetermined sub-bands are produced based on the coefficients of some sub-bands to extend the coefficient table; high band sub-band powers of high band sub-band signals of the respective sub-bands constituting the high band signals are calculated based on low band sub-band signals of the respective sub-bands constituting the low band signals and the extended or reduced coefficient table; and the high band signals are produced based on the high band sub-band powers and the low band sub-band signals.

A signal processing apparatus according to a second aspect of the present invention includes: a sub-band division unit that produces low band sub-band signals of a plurality of sub-bands on a low band side of an input signal and high band sub-band signals of a plurality of sub-bands on a high band side of the input signal; an extension and reduction unit that deletes the coefficients of some sub-bands to reduce a coefficient table or produces coefficients of predetermined sub-bands based on coefficients of some sub-bands to extend a coefficient table, the coefficient table having the coefficients for the respective sub-bands on the high band side; a pseudo high band sub-band power calculation unit that calculates pseudo high band sub-band powers, which are estimated values of powers of the high band sub-band signals, for the respective sub-bands on the high band side based on the extended or reduced coefficient table and the low band sub-band signals; a selection unit that compares high band sub-band powers of the high band sub-band signals and the pseudo high band sub-band powers to each other and selects one of a plurality of the coefficient tables; and a production unit that produces data containing coefficient information for obtaining the selected coefficient table.

The extension and reduction unit may duplicate the coefficients of a sub-band having a highest frequency which is included in the coefficient table and set the duplicated coefficients to coefficients of a sub-band having a higher frequency than the highest frequency to extend the coefficient table.

The extension and reduction unit may delete the coefficients of a sub-band, which has a higher frequency than that of a sub-band having a highest frequency among sub-bands of the high band sub-band signals, from the coefficient table to reduce the coefficient table.

A signal processing method or a program according to the second aspect of the invention includes the steps of generating low band sub-band signals of a plurality of sub-bands on a low band side of an input signal and high band sub-band signals of a plurality of sub-bands on a high band side of the input signal; deleting the coefficients of some sub-bands to reduce a coefficient table or generating coefficients of predetermined sub-bands based on coefficients of some sub-bands to extend a coefficient table, the coefficient table having the coefficients for the respective sub-bands on the high band side; calculating pseudo high band sub-band powers, which are estimated values of powers of the high band sub-band signals, for the respective sub-bands on the high band side based on the extended or reduced coefficient table and the low band sub-band signals; comparing high band sub-band powers of the high band sub-band signals and the pseudo high band sub-band powers to each other and selecting one of a plurality of the coefficient tables; and generating data containing coefficient information for obtaining the selected coefficient table.

According to the second aspect of the invention, low band sub-band signals of a plurality of sub-bands on a low band side of an input signal and high band sub-band signals of a plurality of sub-bands on a high band side of the input signal are produced; the coefficients of some sub-bands are deleted to reduce a coefficient table or coefficients of predetermined sub-bands are produced based on coefficients of some sub-bands to extend a coefficient table, the coefficient table having the coefficients for the respective sub-bands on the high band side; pseudo high band sub-band powers, which are estimated values of powers of the high band sub-band signals, are calculated for the respective sub-bands on the high band side based on the extended or reduced coefficient table and the low band sub-band signals; high band sub-band powers of the high band sub-band signals and the pseudo high band sub-band powers are compared to each other and one of a plurality of the coefficient tables is selected; and data containing coefficient information for obtaining the selected coefficient table is produced.

A decoder according to a third aspect of the present invention includes: a demultiplexing unit that demultiplexes input encoded data to at least low band encoded data and coefficient information; a low band decoding unit that decodes the low band encoded data to produce low band signals; a selection unit that selects a coefficient table which is obtained based on the coefficient information among a plurality of coefficient tables used for the production of high band signals and having coefficients for the respective sub-bands on a high band side; an ex tension and reduction unit that deletes the coefficients of some sub-bands to reduce the coefficient table or produces the coefficients of predetermined sub-bands based on the coefficients of some sub-bands to extend the coefficient table; a high band sub-band power calculation unit that calculates high band sub-band powers of high band sub-band signals of the respective sub-bands constituting the high band signals based on low band sub-band signals of the respective sub-bands constituting the low band signals and the extended or reduced coefficient table; a high band signal production unit that produces the high band signals based on the high band sub-band powers and the low band sub-band signals; and a synthesis unit that synthesizes the low band signal and the high band signal with each other to produce an output signal.

A decoding method according to the third aspect of the invention includes the steps of demultiplexing input encoded data to at least low band encoded data and coefficient information; decoding the low band encoded data to produce low band signals; selecting a coefficient table which is obtained based on the coefficient information among a plurality of coefficient tables used for the production of high band signals and having coefficients for the respective sub-bands on a high band side; deleting the coefficients of some sub-bands to reduce the coefficient table or generating the coefficients of predetermined sub-bands based on the coefficients of some sub-bands to extend the coefficient table; calculating high band sub-band powers of high band sub-band signals of the respective sub-bands constituting the high band signals based on low band sub-band signals of the respective sub-bands constituting the low band signals and the extended or reduced coefficient table; generating the high band signals based on the high band sub-band powers and the low band sub-band signals; and synthesizing the low band signal and the high band signal with each other to produce an output signal.

According to the third aspect of the invention, input encoded data is demultiplexed to at least low band encoded data and coefficient information; the low band encoded data is decoded to produce low band signals; a coefficient table which is obtained based on the coefficient information is selected among a plurality of coefficient tables used for the production of high band signals and having coefficients for the respective sub-bands on a high band side; the coefficients of some sub-bands are deleted to reduce the coefficient table or the coefficients of predetermined sub-bands are produced based on the coefficients of some sub-bands to extend the coefficient table; high band sub-band powers of high band sub-band signals of the respective sub-bands constituting the high band signals are calculated based on low band sub-band signals of the respective sub-bands constituting the low band signals and the extended or reduced coefficient table; the high band signals are produced based on the high band sub-band powers and the low band sub-band signals; and the low band signal and the high band signal are synthesized with each other to produce an output signal.

An encoder according to a fourth aspect of the present invention includes: a sub-band division unit that produces low band sub-band signals of a plurality of sub-bands on a low band side of an input signal and high band sub-band signals of a plurality of sub-bands on a high band side of the input signal; an extension and reduction unit that deletes the coefficients of some sub-bands to reduce a coefficient table or produces coefficients of predetermined sub-bands based on coefficients of some sub-bands to extend a coefficient table, the coefficient table having coefficients for the respective sub-bands on the high band side; a pseudo high band sub-band power calculation unit that calculates pseudo high band sub-band powers, which are estimated values of powers of the high band sub-band signals, for the respective sub-bands on the high band side based on the extended or reduced coefficient table and the low band sub-band signals; a selection unit that compares high band sub-band powers of the high band sub-band signals and the pseudo high band sub-band powers to each other and selects one of a plurality of the coefficient tables; a high band encoding unit that encodes coefficient information for obtaining the selected coefficient table to produce high band encoded data; a low band encoding unit that encodes low band signals of the input signal to produce low band encoded data and a multiplexing unit that multiplexes the low band encoded data and the high band encoded data to produce an output code string.

An encoding method according the fourth aspect of the invention includes the steps of generating low band sub-band signals of a plurality of sub-bands on a low band side of an input signal and high band sub-band signals of a plurality of sub-bands on a high band side of the input signal; deleting the coefficients of some sub-bands to reduce a coefficient table or generating coefficients of predetermined sub-bands based on coefficients of some sub-bands to extend a coefficient table, the coefficient table having coefficients for the respective sub-bands on the high band side; calculating pseudo high band sub-band powers, which are estimated values of powers of the high band sub-band signals, for the respective sub-bands on the high band side based on the extended or reduced coefficient table and the low band sub-band signals; comparing high band sub-band powers of the high band sub-band signals and the pseudo high band sub-band powers to each other and selecting one of a plurality of the coefficient tables; encoding coefficient information for obtaining the selected coefficient table to produce high band encoded data; encoding low band signals of the input signal to produce low band encoded data; and multiplexing the low band encoded data and the high band encoded data to produce an output code string.

According to the fourth aspect of the invention, low band sub-band signals of a plurality of sub-bands on a low band side of an input signal and high band sub-band signals of a plurality of sub-bands on a high band side of the input signal are produced; the coefficients of some sub-bands are deleted to reduce a coefficient table or coefficients of predetermined sub-bands are produced based on coefficients of some sub-bands to extend a coefficient table, the coefficient table having coefficients for the respective sub-bands on the high band side; pseudo high band sub-band powers, which are estimated values of powers of the high band sub-band signals, are calculated for the respective sub-bands on the high band side based on the extended or reduced coefficient table and the low band sub-band signals; high band sub-band powers of the high band sub-band signals and the pseudo high band sub-band powers are compared to each other and one of a plurality of the coefficient tables is selected; coefficient information for obtaining the selected coefficient table is encoded to produce high band encoded data; low band signals of the input signal are encoded to produce low band encoded data; and the low band encoded data and the high band encoded data are multiplexed to produce an output code string.

Effects of the Invention

According to the first embodiment to the fourth embodiment, it is possible to reproduce music signal with high sound quality by expansion of a frequency band.

BRIEF DESCRIPTION OF DRAWINGS

FIG. 30 is a diagram illustrating a coefficient table.

FIG. 37 is a diagram illustrating the sharing of a coefficient table using blended learning.

MODE FOR CARRYING OUT THE INVENTION

An embodiment of the present invention will be described with reference to the drawings. In addition, the description thereof is performed in the following sequence.

1. First embodiment (when the present invention is applied to a frequency band expansion apparatus)
2. Second embodiment (when the present invention is applied to an encoder and a decoder)
3. Third embodiment (when a coefficient index is included in high band encoded data)
4. Fourth embodiment (when a difference between coefficient index and a pseudo high band sub-band power is included in high band encoded data)
5. Fifth embodiment (when a coefficient index is selected using an estimation value).
6. Sixth embodiment (when a portion of a coefficient is commons)
7. Seventh Embodiment (In Case Where Coefficient Table is Extended or Reduced)
8. Eighth Embodiment (In Case Where Learning is Performed Using Broadband Instruction Signals Having Different Conditions)

1. First Embodiment

In a first embodiment, a process that expands a frequency band (hereinafter, referred to as a frequency band expansion process) is performed with respect to a signal component of a low band after decoding obtained by decoding encoded data using a high cancellation encoding method.

[Functional Configuration Example of Frequency Band Expansion Apparatus]

Figure 3:
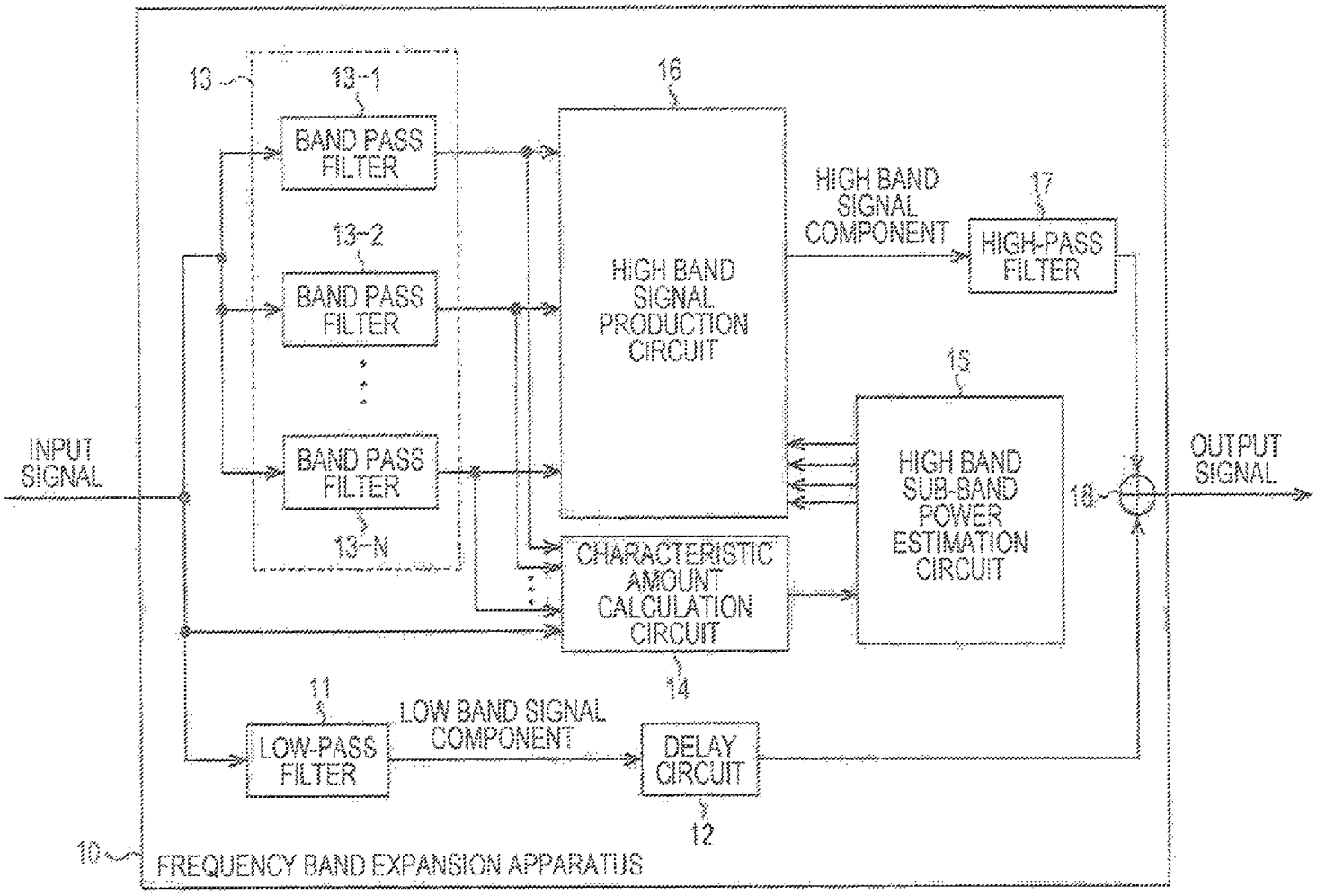
FIG. 3 is a block diagram illustrating a functional configuration example of a frequency band expansion apparatus in a first embodiment of the present invention.

FIG. 3 illustrates a functional configuration example of a frequency band expansion apparatus according to the present invention.

A frequency band expansion apparatus 10 performs a frequency band expansion process with respect to the input signal by setting a signal component of the low band after decoding as the input signal and outputs the signal after the frequency band expansion process obtained by the result as an output signal.

The frequency band expansion apparatus 10 includes a low-pass filter 11, a delay circuit 12, a band pass filter 13, a characteristic amount calculation circuit 14, a high band sub-band power estimation circuit 15, a high band signal production circuit 16, a high-pass filter 17 and a signal adder 18.

The low-pass filter 11 filters an input signal by a predetermined cut off frequency and supplies a low band signal component, which is a signal component of the low band as a signal after filtering to the delay circuit 12.

Since the delay circuit 12 is synchronized when adding the low band signal component from the low-pass filter 11 and a high band signal component which will be described later to each other, it delays the low signal component only a certain time and the low signal component is supplied to the signal adder 18.

The band pass filter 13 includes band pass filters 13-1 to 13-N having pass bands different from each other. The band pass filter 13-$i$ ($\leq i \leq N$)) passes a signal of a predetermined pass band of the input signal and supplies the passed signal as one of a plurality of sub-band signal to the characteristic amount calculation circuit 14 and the high band signal production circuit 16.

The characteristic amount calculation circuit 14 calculates one or more characteristic amounts by using at least any one of a plurality of sub-band signals and the input signal from the band pass filter 13 and supplies the calculated characteristic amounts to the high band sub-band power estimation circuit 15. Herein, the characteristic amounts are information showing a feature of the input signal as a signal.

The high band sub-band power estimation circuit 15 calculates an estimation value of a high band sub-band power which is a power of the high band sub-band signal for each high band sub-band based on one or more characteristic amounts from the characteristic amount calculation circuit 14 and supplies the calculated estimation value to the high band signal production circuit 16.

The high band signal production circuit 16 produces the high band signal component which is a signal component of the high band based on a plurality of sub-band signals from the band pass filter 13 and an estimation value of a plurality of high band sub-band powers from the high band sub-band power estimation circuit 15 and supplies the produced high signal component to the high-pass filter 17.

The high-pass filter 17 filters the high band signal component from the high band signal production circuit 16 using a cut off frequency corresponding to the cut off frequency in the low-pass filter 11 and supplies the filtered high band signal component to a signal adder 18.

The signal adder 18 adds the low band signal component from the delay circuit 12 and the high band signal component from the high-pass filter 17 and outputs the added components as an output signal.

In addition, in a configuration in FIG. 3, in order to obtain a sub-band signal, the band pass filter 13 is applied but is not limited thereto. For example, the band division filter disclosed in Patent Document 1 may be applied.

In addition, likewise, in a configuration in FIG. 3, the signal adder 18 is applied in order to synthesize a sub-band signal, but is not limited thereto. For example, a band synthetic filter disclosed in Patent Document 1 may be applied.

[Frequency Band Expansion Process of Frequency Band Expansion Apparatus]

Next, referring to a flowchart in FIG. 4, the frequency band expansion process by the frequency band expansion apparatus in FIG. 3 will be described.

In step S1, the low-pass filter 11 filters the input signal by a predetermined cutoff frequency and supplies the low band signal component as a signal after filtering to the delay circuit 12.

The low-pass filter 11 can set an optional frequency as the cutoff frequency. However, in an embodiment of the present invention, the low-pass filter can set to correspond a frequency of a low end of the expansion start band by setting a predetermined frequency as an expansion start band described blow. Therefore, the low-pass filter 11 supplies a low band signal component, which is a signal component of the lower band than the expansion start band to the delay circuit 12 as a signal after filtering.

In addition, the low-pass filter 11 can set the optimal frequency as the cutoff frequency in response to the encoding parameter such as the high band cancellation encoding method or a bit rate and the like of the input signal. As the encoding parameter, for example, side information employed in the band expansion method disclosed in Patent Document 1 can be used.

In step S2, the delay circuit 12 delays the low band signal component only a certain delay time from the low-pass filter 11 and supplies the delayed low band signal component to the signal adder 18.

In step S3, the band pass filter 13 (band pass filters 13-1 to 13-N) divides the input signal into a plurality of sub-band signals and supplies each of a plurality of sub-band signals after the division to the characteristic amount calculation circuit 14 and the high band signal production circuit 16. In addition, the process of division of the input signal by the band pass filter 13 will be described below.

In step S4, the characteristic amount calculation circuit 14 calculates one or more characteristic amounts by at least one of a plurality of sub-band signals from the band pass filter 13 and the input signal and supplies the calculated characteristic amounts to the high band sub-band power estimation circuit 15. In addition, a process of the calculation for the characteristic amount by the characteristic amount calculation circuit 14 will be described below in detail.

In step S5, the high band sub-band power estimation circuit 15 calculates an estimation value of a plurality of high band sub-band powers based on one or more characteristic amounts and supplies the calculated estimation value to the high band signal production circuit 16 from the characteristic amount calculation circuit 14. In addition, a process of a calculation of an estimation value of the high band sub-band power by the high band sub-band power estimation circuit 15 will be described below in detail.

In step S6, the high band signal production circuit 16 produces a high band signal component based on a plurality of sub-band signals from the band pass filter 13 and an estimation value of a plurality of high band sub-band powers from the high band sub-band power estimation circuit 15 and supplies the produced high band signal component to the high-pass filter 17. In this case, the high band signal component is the signal component of the higher band than the expansion start band. In addition, a process on the production of the high band signal component by the high band signal production circuit 16 will be described below in detail.

In step S7, the high-pass filter 17 removes the noise such as an alias component in the low band included in the high band signal component by filtering the high band signal component from the high band signal production circuit 16 and supplies the high band signal component to the signal adder 18.

In step S8, a signal adder 18 adds the low band signal component from the delay circuit 12 and the high band signal component from the high-pass filter 17 to each other and outputs the added components as an output signal.

According to the above-mentioned process, the frequency band can be expanded with respect to a signal component of the low band after decoding.

Next, a description for each process of step S3 to S6 of the flowchart in FIG. 4 will be described.

[Description of Process by Band Pass Filter]

First, a description of process by the band pass filter 13 in step S3 in a flowchart of FIG. 4 will be described.

In addition, for convenience of the explanation, as described below, it is assumed that the number N of the band pass filter 13 is N=4.

For example, it is assumed that one of 16 sub-bands obtained by dividing Nyquist frequency of the input signal into 16 parts is an expansion start band and each of 4 sub-bands of the lower band than the expansion start band of 16 sub-bands is each pass band of the band pass filters 13-1 to 13-4.

Figure 5:
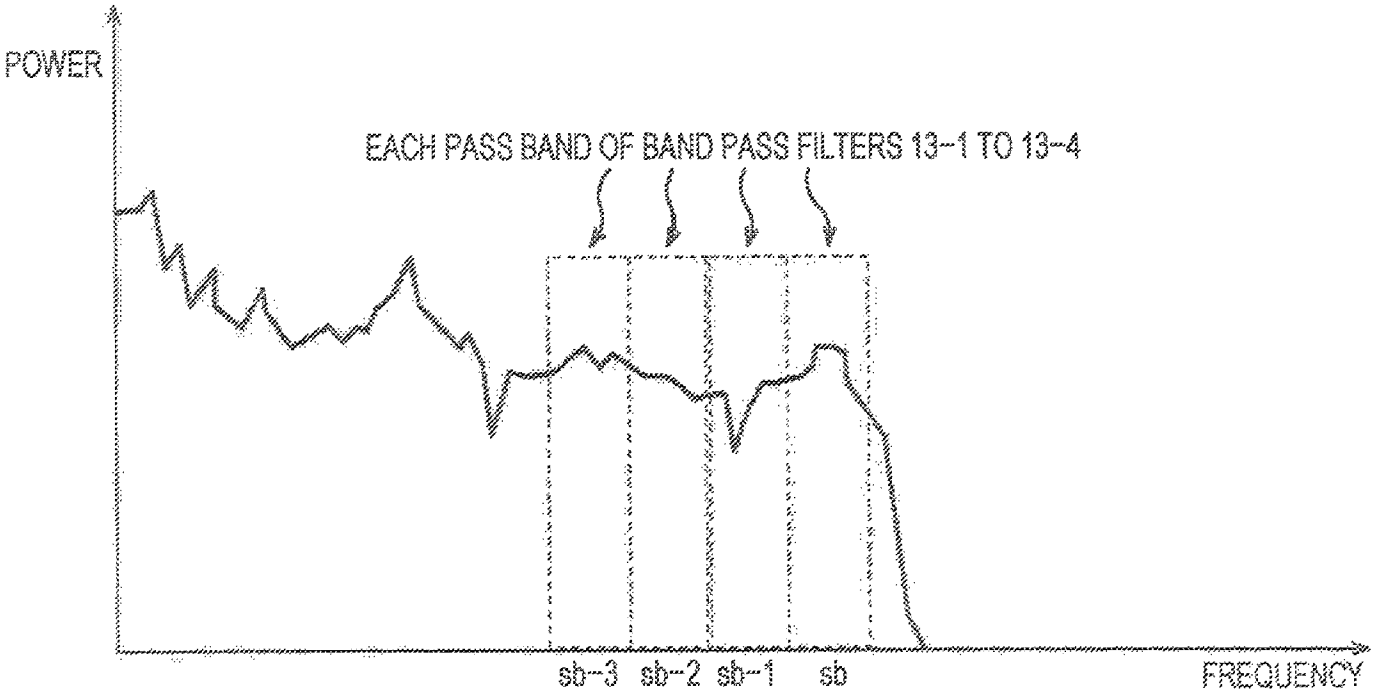
FIG. 5 is a view illustrating arrangement of a power spectrum of signal input to a frequency band expansion apparatus in FIG. 3 and arrangement on a frequency axis of a band pass filter.

FIG. 5 illustrates arrangements on each axis of a frequency for each pass band of the band pass filters 13-1 to 13-4.

As illustrated in FIG. 5, if it is assumed that an index of the first sub-band from the high band of the frequency band (sub-band) of the lower band than the expansion start band is sb, an index of second sub-band is sb−1, and an index of I-th sub-band is sb−(I−1), Each of band pass filters 13-1 to 13-4 assign each sub-band in which the index is sb to sb−3 among the sub-band of the low band lower than the expansion initial band as the pass band.

In the present embodiment, each pass band of the band pass filters 13-1 to 13-4 is 4 predetermined sub-bands of 16 sub-bands obtained by dividing the Nyquist frequency of the input signal into 16 parts but is not limited thereto and may be 4 predetermined sub-bands of 256 sub-band obtained by dividing the Nyquist frequency of the input signal into 256 parts. In addition, each bandwidth of the band pass filters 13-1 to 13-4 may be different from each other.

[Description of Process by Characteristic Amount Calculation Circuit]

Next, a description of a process by the characteristic amount calculation circuit 14 in step S4 of the flowchart in FIG. 4 will be described.

The characteristic amount calculation circuit 14 calculates one or more characteristic amounts used such that the high band sub-band power estimation circuit 15 calculates the estimation value of the high band sub-band power by using at least one of a plurality of sub-band signals from the band pass filter 13 and the input signal.

In more detail, the characteristic amount calculation circuit 14 calculates as the characteristic amount, the power of the sub-band signal (sub-band power (hereinafter, referred to as a low band sub-band power)) for each sub-band from 4 sub-band signals of the band pass filter 13 and supplies the calculated power of the sub-band signal to the high band sub-band power estimation circuit 15.

In other words, the characteristic amount calculation circuit 14 calculates the low band sub-band power power (ib, J) in a predetermined time frame J from 4 sub-band signals x(ib,n), which is supplied from the band pass filter 13 by using the following Equation (1). Herein, ib is an index of the sub-band, and n is expressed as index of discrete time. In addition, the number of a sample of one frame is expressed as FSIZE and power is expressed as decibel.

[Equation 1]

$$\text{power}(ib, J) = 10\log10\left\{\left(\sum_{n=J*FSIZE}^{(J+1)FSIZE-1} \times (ib, n)^2\right) \Big/ FSIZE\right\} \quad (1)$$

$$(sb-3 \le ib \le sb)$$

Accordingly, the low band sub-band power power(ib, J) obtained by the characteristic amount calculation circuit 14 is supplied to the high band sub-band power estimation circuit 15 as the characteristic amount.

[Description of Process by High Band Sub-Band Power Estimation Circuit]

Next, a description of a process by the high band sub-band power estimation circuit 15 of step S5 of a flowchart in FIG. 4 will be described.

The high band sub-band power estimation circuit 15 calculates an estimation value of the sub-band power (high band sub-band power) of the band (frequency expansion band) which is caused to be expanded following the sub-band (expansion start band) of which the index is sb+1, based on 4 sub-band powers supplied from the characteristic amount calculation circuit 14.

That is, if the high band sub-band power estimation circuit 15 considers the index of the sub-band of maximum band of the frequency expansion band to be eb, (eb−sb) sub-band power is estimated with respect to the sub-band in which the index is sb+1 to eb.

In the frequency expansion band, the estimation value $\text{power}_{est}$(ib,J) of sub-band power of which the index is ib is expressed by the following Equation (2) using 4 sub-band power power(ib,j) supplied from the characteristic amount calculation circuit 14.

[Equation 2]

$$\text{power}_{est}(ib, J) = \left(\sum_{kb=sb-3}^{sb} [A_{ib}(kb)\text{power}(kb, J)]\right) + B_{ib} \quad (2)$$

$$(J*FSIZE \le n \le (J+1)FSIZE-1,\ sb+1 \le ib \le eb)$$

Herein, in Equation (2), coefficients $A_{ib}$(kb), and $B_{ib}$ are coefficients having value different for respective sub-band ib. Coefficients $A_{ib}$(kb), $B_{ib}$ are coefficients set suitably to obtain a suitable value with respect to various input signals. In addition, Coefficients $A_{ib}$(kb) $B_{ib}$ are also charged to an optimal value by changing the sub-band sb. A deduction of $A_{ib}$(kb), $B_{ib}$ will be described below.

In Equation (2), the estimation value of the high band sub-band power is calculated by a primary linear combination using power of each of a plurality of sub-band signals from the band pass filter 13, but is not limited thereto, and for example, may be calculated using a linear combination of a plurality of the low band sub-band powers of frames before and after the time frame J, and may be calculated using a nonlinear function.

As described above, the estimation value of the high band sub-band power calculated by the high band sub-band power estimation circuit 15 is supplied to the high band signal production circuit 16 will be described.

[Description of Process by High Band Signal Production Circuit]

Next, a description will be made of process by the high band signal production circuit 16 in step S6 of a flowchart in FIG. 4.

The high band signal production circuit 16 calculates the low band sub-band power power(ib, J) of each sub-band based on Equation (1) described above, from a plurality of sub-band signals supplied from the band pass filter 13. The high band signal production circuit 16 obtains a gain amount G(ib,J) by Equation 3 described below, using a plurality of low band sub-band powers power(ib, J) calculated, and an estimation value $\text{power}_{est}$(ib,J) of the high band sub-band power calculated based on Equation (2) described above by the high band sub-band power estimation circuit 15.

[Equation 3]

$$G(ib,J)=10^{\{(power_{est}(ib,J)-power(sb_{map}(ib),J))/20\}}$$
$$(J*FSIZE \le n \le (J+1)FSIZE-1, sb+1 \le ib \le eb) \quad (3)$$

Herein, in Equation (3), $sb_{map}$(ib) shows the index of the sub-band of an original map of the case where the sub-band ib is considered as the sub-band of an original map and is expressed by the following Equation 4.

[Equation 4]

$$sb_{map}(ib) = ib - 4\text{INT}\left(\frac{ib-sb-1}{4}+1\right) \quad (4)$$

$$(sb+1 \le ib \le eb)$$

In addition, in Equation (4), INT (a) is a function which cut down a decimal point of value a.

Next, the high band signal production circuit 16 calculates the sub-band signal x2(ib,n) after gain control by multiplying the gain amount G(ib,J) obtained by Equation 3 by an output of the band pass filter 13 using the following Equation (5).

[Equation 5]

$$x2(ib,n)=G(ib,J)x(sb_{map}(ib),n)(J*FSIZE \le n \le (J+1)$$
$$FSIZE-1, sb+1 \le ib \le eb) \quad (5)$$

Further, the high band signal production circuit 16 calculates the sub-band signal x3(ib,n) after the gain control which is cosine-transferred from the sub-band signal x2(ib, n) after adjustment of gain by performing cosine transfer to)

a frequency corresponding a frequency of the upper end of the sub-band having index of sb from a frequency corresponding to a frequency of the lower end of the sub-band having the index of sb−3 by the following Equation (6).

[Equation 6]

$$x3(ib,n)=x2(ib,n)*2\cos(n)*\{4(ib+1)\pi/32\}(sb+1ib\ eb) \quad (6)$$

In addition, in Equation (6), π shows a circular constant. Equation (6) means that the sub-band signal x2(ib,n) after the gain control is shifted to the frequency of each of 4 band part high band sides.

Therefore, the high band signal production circuit 16 calculates the high band signal component $x_{high}(n)$ from the sub-band signal x3(ib,n) after the gain control shifted to the high band side according to the following Equation 7.

[Equation 7]

$$x_{high}(n) = \sum_{ib=sb+1}^{eb} x3(ib, n) \quad (7)$$

Accordingly, the high band signal component is produced by the high band signal production circuit 16 based on the 4 low band sub-band powers obtained based on the 4 sub-band signals from the band pass filter 13 and an estimation value of the high band sub-band power from the high band sub-band power estimation circuit 15, and the produced high band signal component is supplied to the high-pass filter 17.

According to process described above, since the low band sub-band power calculated from a plurality of sub-band signals is set as the characteristic amount with respect to the input signal obtained after decoding of the encoded data by the high band cancellation encoding method, the estimation value of the high band sub-band power is calculated based on a coefficient set suitably thereto, and the high band signal component is produced adaptively from the estimation value of the low band sub-band power and the high band sub-band power, whereby it is possible to estimate the sub-band power of the frequency expansion band with high accuracy and to reproduce a music signal with a better sound quality.

As described above, the characteristic amount calculation circuit 14 illustrates an example that calculates as the characteristic amount, only the low band sub-band power calculated from the plurality sub-band signal. However, in this case, the sub-band power of the frequency expansion band cannot be estimated with high accuracy by a kind of the input signal.

Herein, the estimate of the sub-band power of the frequency expansion band in the high band sub-band power estimation circuit 15 can be performed with high accuracy because the characteristic amount calculation circuit 14 calculates a characteristic amount having a strong correlation with an output system of sub-band power of the frequency expansion band (a power spectrum shape of the high band).

[Another Example of Characteristic Amount Calculated by Characteristic Amount Calculation Circuit]

Figure 6:
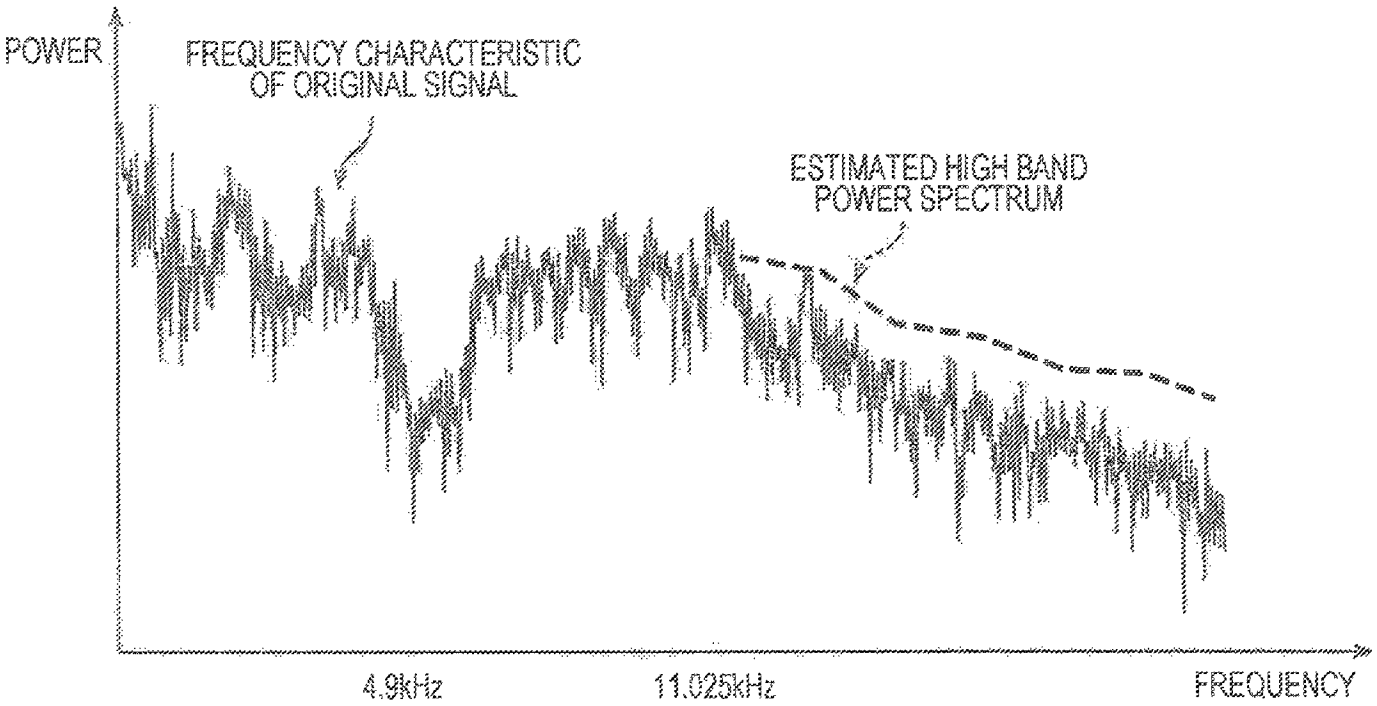
FIG. 6 is a view illustrating an example illustrating frequency characteristics of a vocal region and a power spectrum of a high band estimated.

FIG. 6 illustrates an example of the frequency characteristic of a vocal region where most of vocal is occupied and the power spectrum of the high band obtained by estimating the high band sub-band power by calculating only the low band sub-band power as the characteristic amount.

As illustrated in FIG. 6, in the frequency characteristic of the vocal region, there are many cases where the estimated power spectrum of the high band has a position higher than the power spectrum of the high band of an original signal. Since sense of incongruity of the singing voice of people is easily perceived by the people's ear, it is necessary to estimate the high band sub-band power with high accuracy in vocal region.

In addition, as illustrated in FIG. 6, in the frequency characteristic of the vocal region, there are many cases that a lager concave is disposed from 4.9 kHz to 11.025 kHz.

Herein, as described below, an example will be described which can apply a degree of the concave in 4.9 kHz to 11.025 kHz in the frequency area as a characteristic amount used in estimating the high band sub-band power of the vocal region. In addition, a characteristic amount showing a degree of the concave is referred to as a dip below.

A calculation example of a dip in time frames J dip(J) will be described below.

Fast Fourier Transform (FFT) of 2048 points is performed with respect to signals of 2048 sample sections included in a range of a few frames before and after a time frame J of the input signal, and coefficients on the frequency axis is calculated. The power spectrum is obtained by performing db conversion with respect to the absolute value of each of the calculated coefficients.

Figure 7:
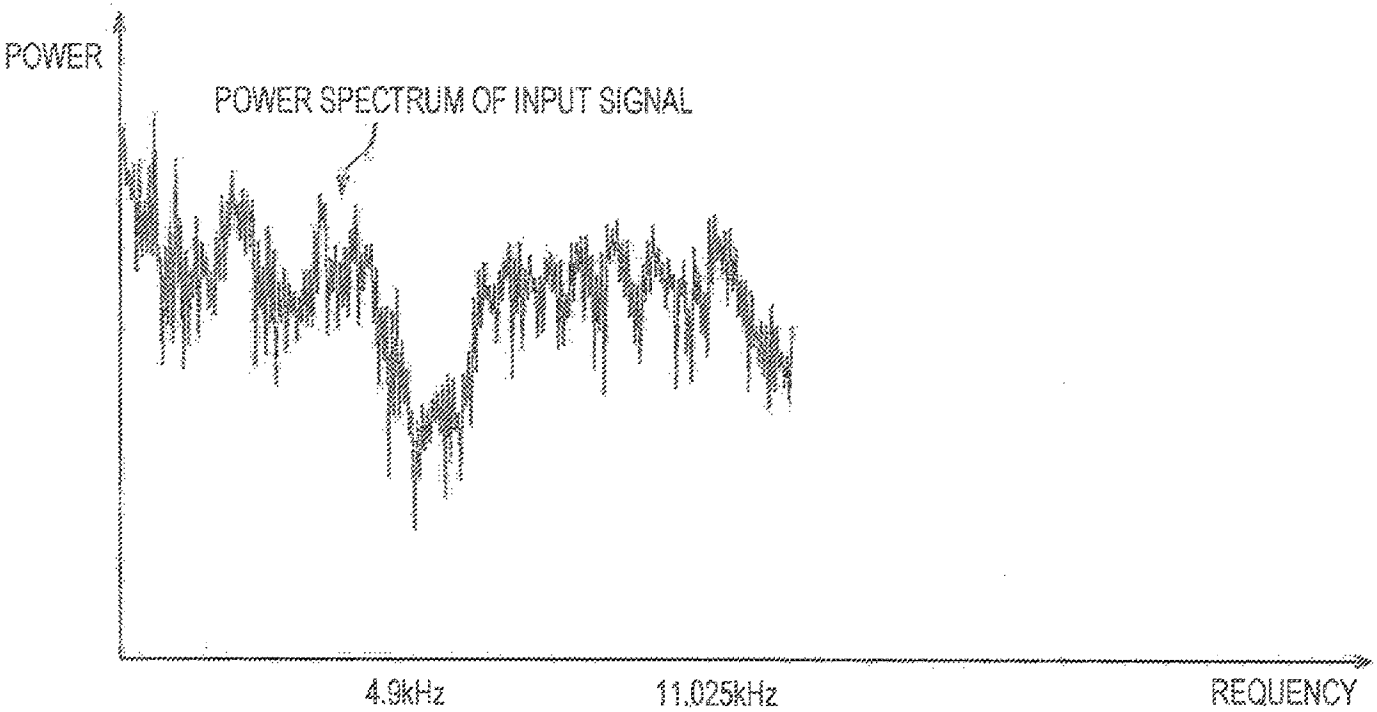
FIG. 7 is a view illustrating an example of a power spectrum of signal input to a frequency band expansion apparatus in FIG. 3.

FIG. 7 illustrates one example of the power spectrum obtained in above-mentioned method. Herein, in order to remove a fine component of the power spectrum, for example so as to remove component of 1.3 kHz or less, a liftering process is performed. If the liftering process is performed, it is possible to smooth the fine component of the spectrum peak by selecting each dimension of the power spectrum and performing a filtering process by applying the low-pass filter according to a time sequence.

Figure 8:
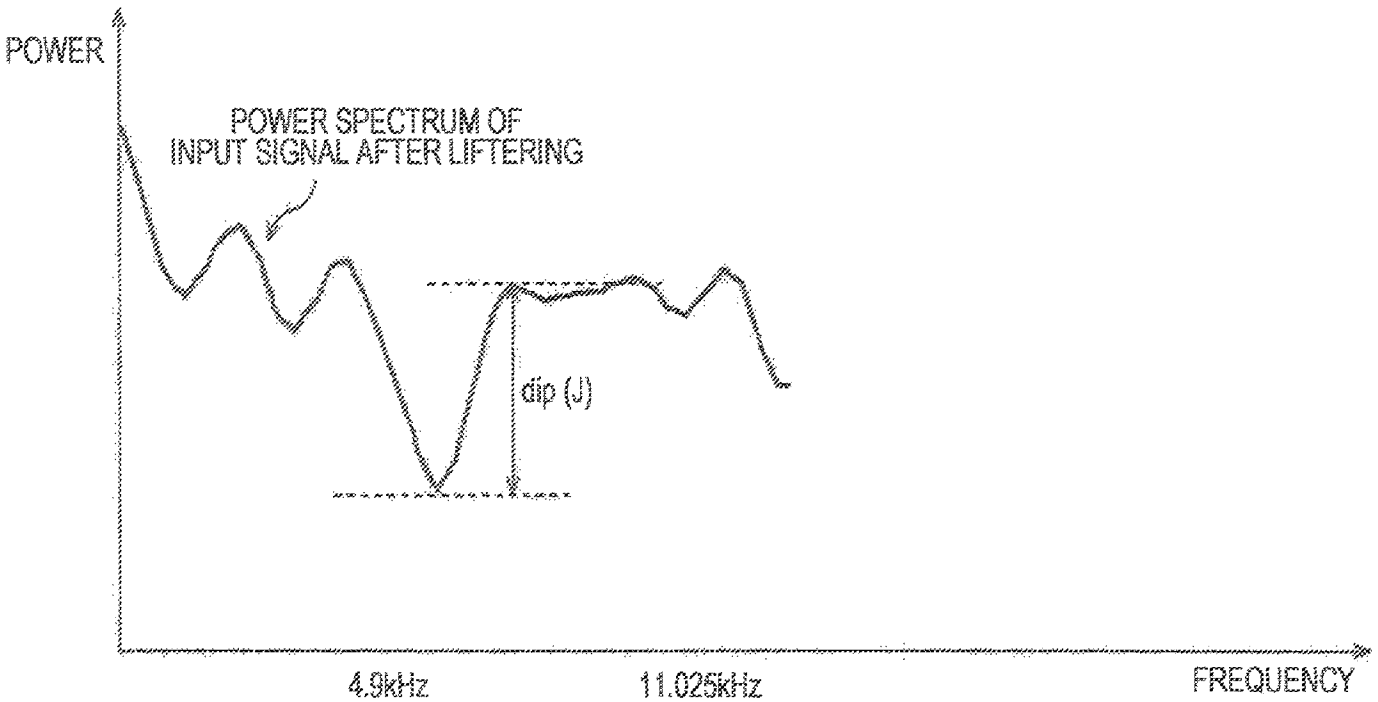
FIG. 8 is a view illustrating an example of a power vector after liftering of an input signal in FIG. 7.

FIG. 8 illustrates an example of the power spectrum of the input signal after liftering. In the power spectrum following recovering illustrated in FIG. 8, difference between minimum value and maximum value included in a range corresponding to 4.9 kHz to 11.025 kHz is set as a dip dip(J).

As described above, the characteristic amount having a strong correlation with the sub-band power of the frequency expansion band is calculated. In addition, a calculation example of a dip dip(J) is not limited to the above-mentioned method, and other method may be performed.

Next, other example of calculation of a characteristic amount having a strong correlation with the sub-band power of the frequency expansion band will be described.

[Still Another Example of Characteristic Amount Calculated by Characteristic Amount Calculation Circuit]

In a frequency characteristic of an attack region, which is, a region including an attack type music signal in any input signal, there are many cases that the power spectrum of the high band is substantially flat as described with reference to FIG. 2. It is difficult for a method calculating as the characteristic amount, only the low band sub-band power to estimate the sub-band power of the almost flat frequency expansion band seen from an attack region with high accuracy in order to estimate the sub-band power of a frequency expansion band without the characteristic amount indicating time variation having a specific input signal including an attack region.

Herein, an example applying time variation of the low band sub-band power will be described below as the characteristic amount used for estimating the high band sub-band power of the attack region.

Time vibration $power_d(J)$ of the low band sub-band power in some time frames J, for example, is obtained from the following Equation (8).

[Equation 8]

$$\text{power}_d(J) = \sum_{ib=sb-3}^{sb} \sum_{n=J*FSIZE}^{(J+1)FSIZE-1} (x(ib, n)^2) \Big/ \sum_{ib=sb-3}^{sb} \sum_{n=(J-1)FSIZE}^{J*FSIZE-1} (x(ib, n)^2) \quad (8)$$

According to Equation 8, time variation $\text{power}_d$ (J) of a low band sub-band power shows ratio between the sum of four low band sub-band powers in time frames J−1 and the sum of four low band sub-band powers in time frames (J−1) before one frame of the time frames J, and if this value become large, the time variation of power between frames is large, that is, a signal included in time frames J is regarded as having strong attack.

Figure 1:
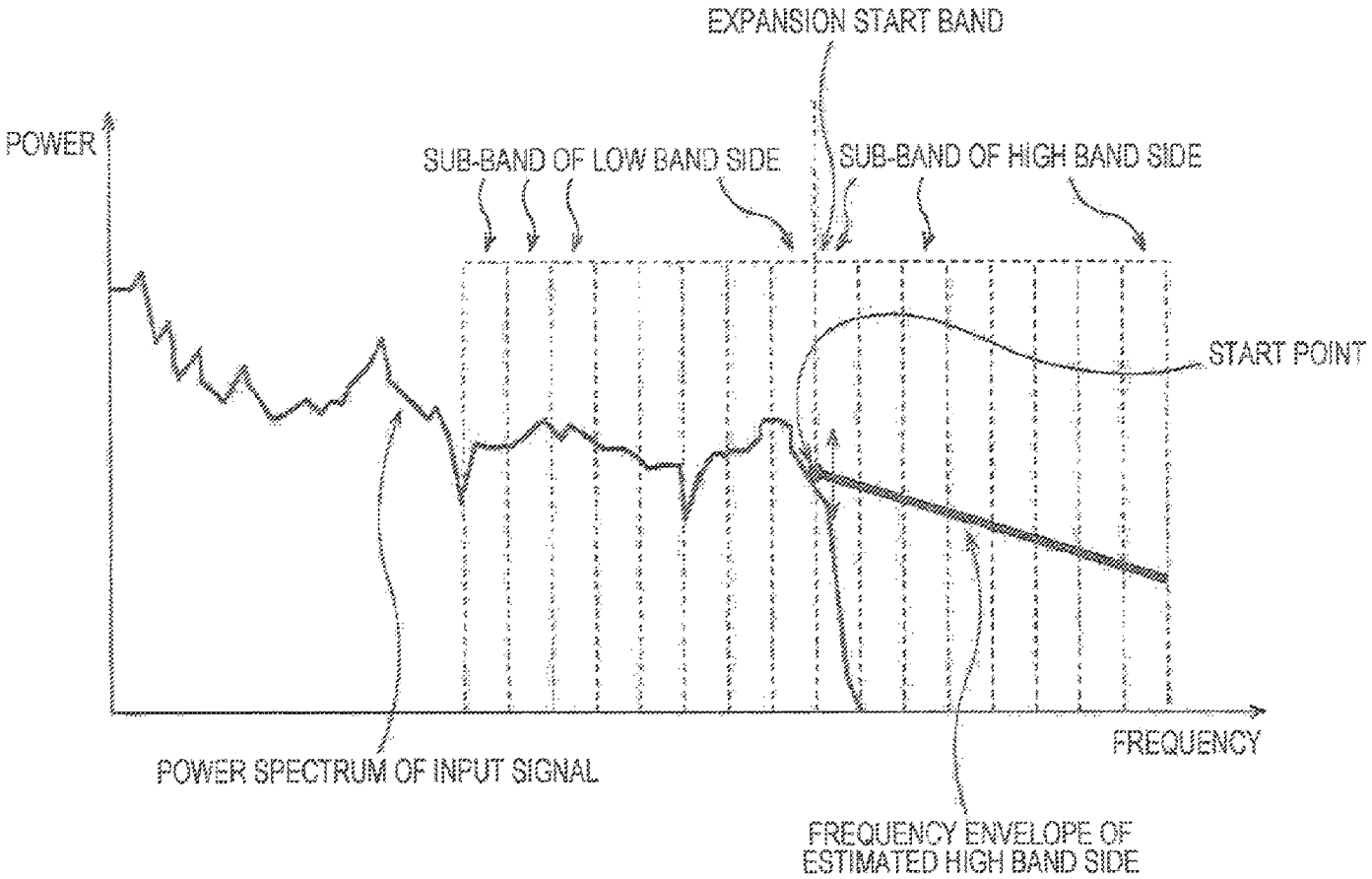
FIG. 1 is a view an example of illustrating in an example of a power spectrum of a low band after decoding an input signal and a frequency envelope of a high band estimated.
Figure 2:
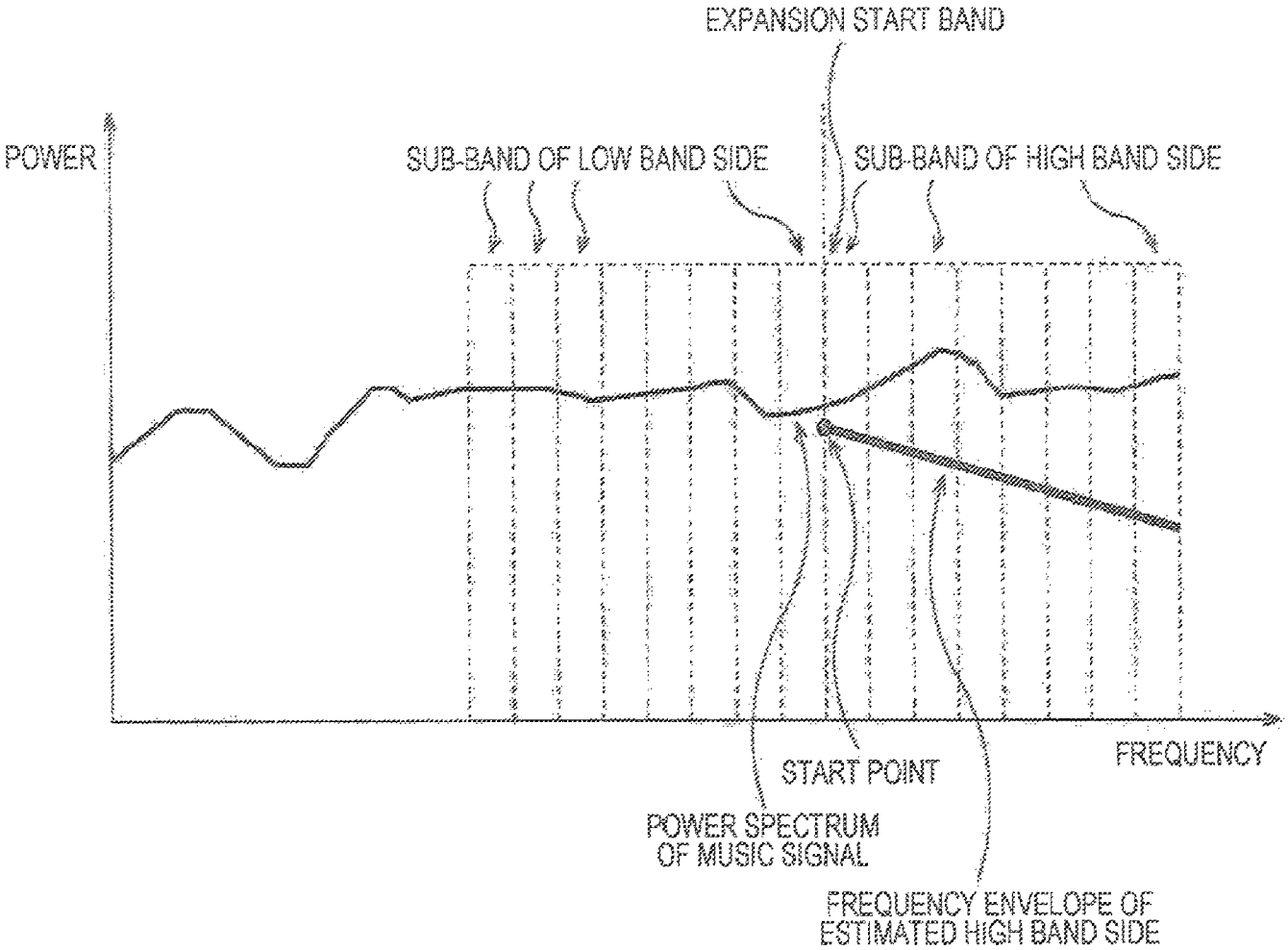
FIG. 2 is a view illustrating an example of an original power spectrum of music signal of an attack according to rapid change in time.

In addition, if the power spectrum illustrated in FIG. 1, which is average statistically is compared with the power spectrum of the attack region (attack type music signal) illustrated in FIG. 2, the power spectrum in the attack region ascends toward the right in a middle band. Between the attack regions, there are many cases which show the frequency characteristics.

Accordingly, an example which applies a slope in the middle band as the characteristic amount used for estimating the high band sub-band power between the attack regions will be described below.

A slope slope (J) of a middle band in some time frames J, for example, is obtained from the following Equation (9).

[Equation 9]

$$\text{slope}(J) = \sum_{ib=sb-3}^{sb} \sum_{n=J*FSIZE}^{(J+1)FSIZE-1} \{W(ib) * x(ib, n)^2)\} \Big/ \sum_{ib=sb-3}^{sb} \sum_{n=J*FSIZE}^{(J+1)FSIZE-1} (x(ib, n)^2) \quad (9)$$

In the Equation (9), a coefficient w (ib) is a weight factor adjusted to be weighted to the high band sub-band power. According to the Equation (9), the slope (J) shows a ratio of the sum of four low band sub-band powers weighted to the high band and the sum of four low band sub-band powers. For example, if four low band sub-band powers are set as a power with respect to the sub-band of the middle band, the slope (J) has a large value when the power spectrum in a middle band ascends to the right, and the power spectrum has small value when the power spectrum descends to the right.

Since there are many cases that the slope of the middle band considerably varies before and after the attack section, it may be assumed that the time variety $\text{slope}_d$ (J) of the slope expressed by the following Equation (10) is the characteristic amount used in estimating the high band sub-band power of the attack region.

[Equation 10]

$$\text{slope}_d(J) = \text{slope}(J)/\text{slope}(J-1)$$

$$(J*FSIZE \le n \le (J+1)FSIZE-1) \quad (10)$$

In addition, it may be assumed that time variety $\text{dip}_d$(J) of the dip dip(J) described above, which is expressed by the following Equation (11) is the characteristic amount used in estimating the high band sub-band power of the attack region.

[Equation 11]

$$\text{dip}_d(J) = \text{dip}(J) - \text{dip}(J-1)$$

$$(J*FSIZE \le n \le (J+1)FSIZE-1) \quad (11)$$

According to the above-mentioned method, since the characteristic amount having a strong correlation with the sub-band power of the frequency expansion band is calculated, if using this, the estimation for the sub-band power of the frequency expansion band in the high band sub-band power estimation circuit 15 can be performed with high accuracy.

As described above, an example for calculating the characteristic amount having a strong correlation with the sub-band power of the frequency expansion band was described. However, an example for estimating the high band sub-band power will be described below using the characteristic amount calculated by the method described above.

[Description of Process by High Band Sub-Band Power Estimation Circuit]

Herein, an example for estimating the high band sub-band power using the dip described with reference to FIG. 8 and the low band sub-band power as the characteristic amount will be described.

Figure 4:
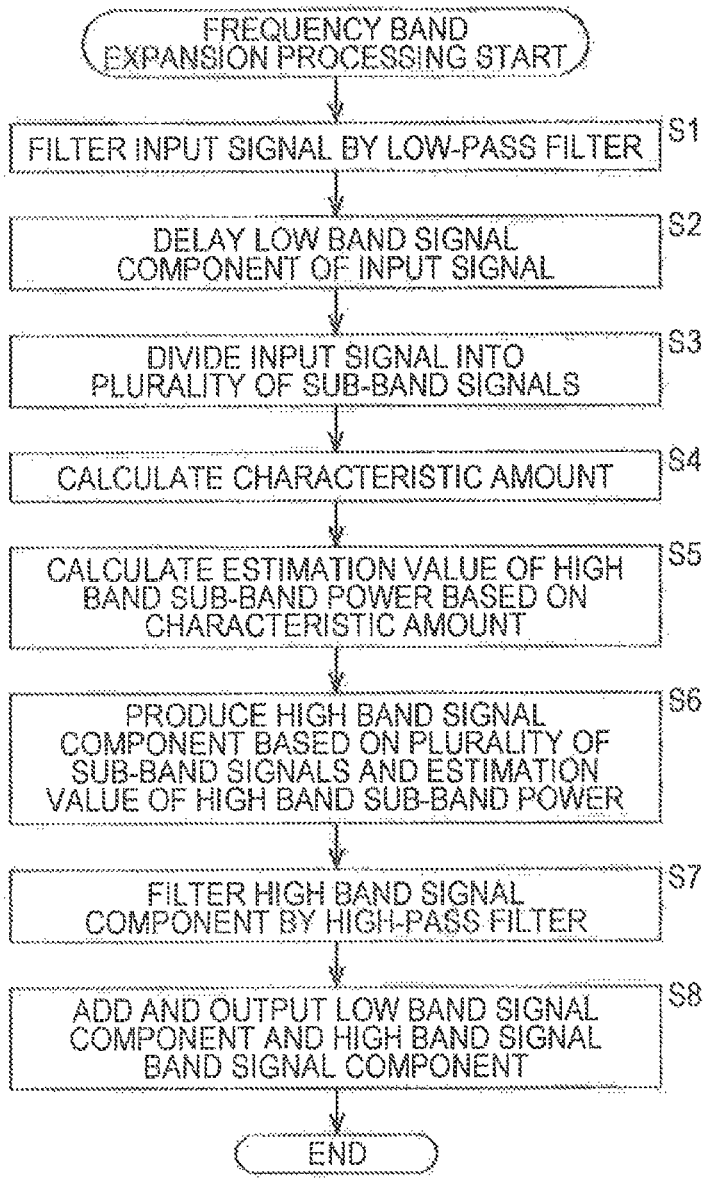
FIG. 4 is a flowchart illustrating an example of a frequency band expansion process by a frequency band expansion apparatus in FIG. 3.

That is, in step S4 of the flowchart in FIG. 4, the characteristic amount calculation circuit 14 calculates as the characteristic amount, the low band sub-band power and the dip and supplies the calculated low band sub-band power and dip to the high band sub-band power estimation circuit 15 for each sub-band from four sub-band signals from the band pass filter 13.

Therefore, in step S5, the high band sub-band power estimation circuit 15 calculates the estimation value of the high band sub-band power based on the four low band sub-band powers and the dip from the characteristic amount calculation circuit 14.

Herein, in the sub-band power and the dip, since ranges of the obtained values (scales) are different from each other, the high band sub-band power estimation circuit 15, for example, performs the following conversion with respect to the dip value.

The high band sub-band power estimation circuit 15 calculates the sub-band power of a maximum band of the four low band sub-band powers and a dip value with respect to a predetermined large amount of the input signal and obtains an average value and standard deviation respectively. Herein, it is assumed that the average value of sub-band power is $\text{power}_{ave}$, a standard deviation of the sub-band power is $\text{power}_{std}$, the average value of the dip is $\text{dip}_{ave}$, and the standard deviation of the dip is $\text{dip}_{std}$.

The high band sub-band power estimation circuit 15 converts the value of the dip dip(J) using the value as in the following Equation (12) and obtains the $\text{dip}_s$ dip(J) after conversion.

[Equation 12]

$$dip_s(J) = \frac{dip(J) - dip_{ave}}{dip_{std}} \text{power}_{std} + \text{power}_{ave} \quad (12)$$

By performing conversion described in Equation (12), the high band sub-band power estimation circuit 15 can statistically convert the value of dip dip(J) to an equal variable (dip) $dip_s$ (J) for the average and dispersion of the low band sub-band power and make a range of the value obtained from the dip approximately equal to a range of the value obtained from the sub-band power.

In the frequency expansion band, the estimation value $power_{est}(ib,J)$ of the sub-band power in which index is ib, is expressed, according to Equation 13, by a linear combination of the four low band sub-band powers power(ib,J) from the characteristic amount calculation circuit 14 and the dip $dip_s$ (J) shown in Equation (12).

[Equation 13]

$$power_{est}(ib, J) = \left( \sum_{kb=sb-3}^{sb} [C_{ib}(kb)power(kb, J)] \right) + D_{ib}dip_s(J) + E_{it} \quad (13)$$

$$(J * FSIZE \leq n \leq (J+1)FSIZE - 1, sb + 1 \leq ib \leq eb)$$

Herein, in Equation (13), coefficients $C_{ib}$(kb), $D_{ib}$, $E_{ib}$ are coefficients having value different for each sub-band ib. The coefficients $C_{ib}$(kb), $D_{ib}$, and $E_{ib}$ are coefficients set suitably in order to obtain a favorable value with respect to various input signals. In addition, the coefficient $C_{ib}$(kb), $D_{ib}$ and $E_{ib}$ are also changed to optimal values in order to change sub-band sb. Further, derivation of coefficient $C_{ib}$(kb), and $E_{ib}$ will be described below.

In Equation (13), the estimation value of the high band sub-band power is calculated by a linear combination, but is not limited thereto. For example, the estimation value may be calculated using a linear combination of a plurality characteristic amount of a few frames before and after the time frame J, and may be calculated using a non-linear function.

According to the process described above, it may be possible to reproduce music signal having a better quality in that estimation accuracy of the high band sub-band power at the vocal region is improved compared with a case that it is assumed that only the low band sub-band power is the characteristic amount in estimation of the high band sub-band power using a value of a specific dip of vocal region as a characteristic amount, the power spectrum of the high band is produced by being estimated to be larger than that of the high band power spectrum of the original signal and sense of incongruity can be easily perceived by the people's ear using a method setting only the low band sub-band as the characteristic amount.

Therefore, if the number of divisions of sub-bands is 16, since frequency resolution is low with respect to the dip calculated as the characteristic amount by the method described above (a degree of the concave in a frequency characteristic of the vocal region), a degree of the concave cannot be expressed by only the low band sub-band power.

Herein, the frequency resolution is improved and it may be possible to express the degree of the concave at only the low band sub-band power in that the number of the divisions of the sub-bands increases (for example, 256 divisions of 16 times), the number of the band divisions by the band pass filter 13 increases (for example, 64 of 16 times), and the number of the low band sub-band power calculated by the characteristic amount calculation circuit 14 increases (64 of 16 times).

By only a low band sub-band power, it is assumed that it is possible to estimate the high band sub-band power with accuracy substantially equal to the estimation of the high band sub-band power used as the characteristic amount and the dip described above.

However, a calculation amount increases by increasing the number of the divisions of the sub-bands, the number of the band divisions and the number of the low band sub-band powers. If it is assumed that the high band sub-band power can be estimated with accuracy equal to any method, the method that estimates the high band sub-band power using the dip as the characteristic amount without increasing the number of divisions of the sub-bands is considered to be efficient in terms of the calculation amount.

As described above, a method that estimates the high band sub-band power using the dip and the low band sub-band power was described, but as the characteristic amount used in estimating the high band sub-band power, one or more the characteristic amounts described above (a low band sub-band power, a dip, time variation of the low band sub-band power, slope, time variation of the slope, and time variation of the dip) without being limited to the combination. In this case, it is possible to improve accuracy in estimating the high band sub-band power.

In addition, as described above, in the input signal, it may be possible to improve estimation accuracy of the section by using a specific parameter in which estimation of the high band sub-band power is difficult as the characteristic amount used in estimating the high band sub-band power. For example, time variety of the low band sub-band power, slope, time variety of slope and time variety of the dip are a specific parameter in the attack region, and can improve estimation accuracy of the high band sub-band power in the attack region by using the parameter thereof as the characteristic amount.

In addition, even if estimation of the high band sub-band power is performed using the characteristic amount other than the low band sub-band power and the dip, that is, time variety of the low band sub-band power, slope, time variety of the slope and time variety of the dip, the high band sub-band power can be estimated in the same manner as the method described above.

In addition, each calculation method of the characteristic amount described in the specification is not limited to the method described above, and other method may be used.

[Method for Obtaining Coefficients $C_{ib}$ (kb), $D_{ib}$, $E_{ib}$]

Next, a method for obtaining the coefficients $C_{ib}$ (kb), $D_{ib}$ and $E_{ib}$ will be described in Equation (13) described above.

The method is applied in which coefficients is determined based on learning result, which performs learning using instruction signal having a predetermined broad band (hereinafter, referred to as a broadband instruction signal) such that as method for obtaining coefficients $C_{ib}$ (kb), $D_{ib}$ and $E_{ib}$, coefficients $C_{ib}$ (kb), $D_{ib}$ and $E_{ib}$ become suitable values with respect to various input signals in estimating the sub-band power of the frequency expansion band.

When learning of coefficient $C_{ib}$ (kb), $D_{ib}$ and $E_{ib}$ is performed, a coefficient learning apparatus including the band pass filter having the same pass band width as the band pass filters 13-1 to 13-4 described with reference to FIG. 5 is applied to the high band higher the expansion initial band. The coefficient learning apparatus performs learning when broadband instruction is input.

[Functional Configuration Example of Coefficient Learning Apparatus]

Figure 9:
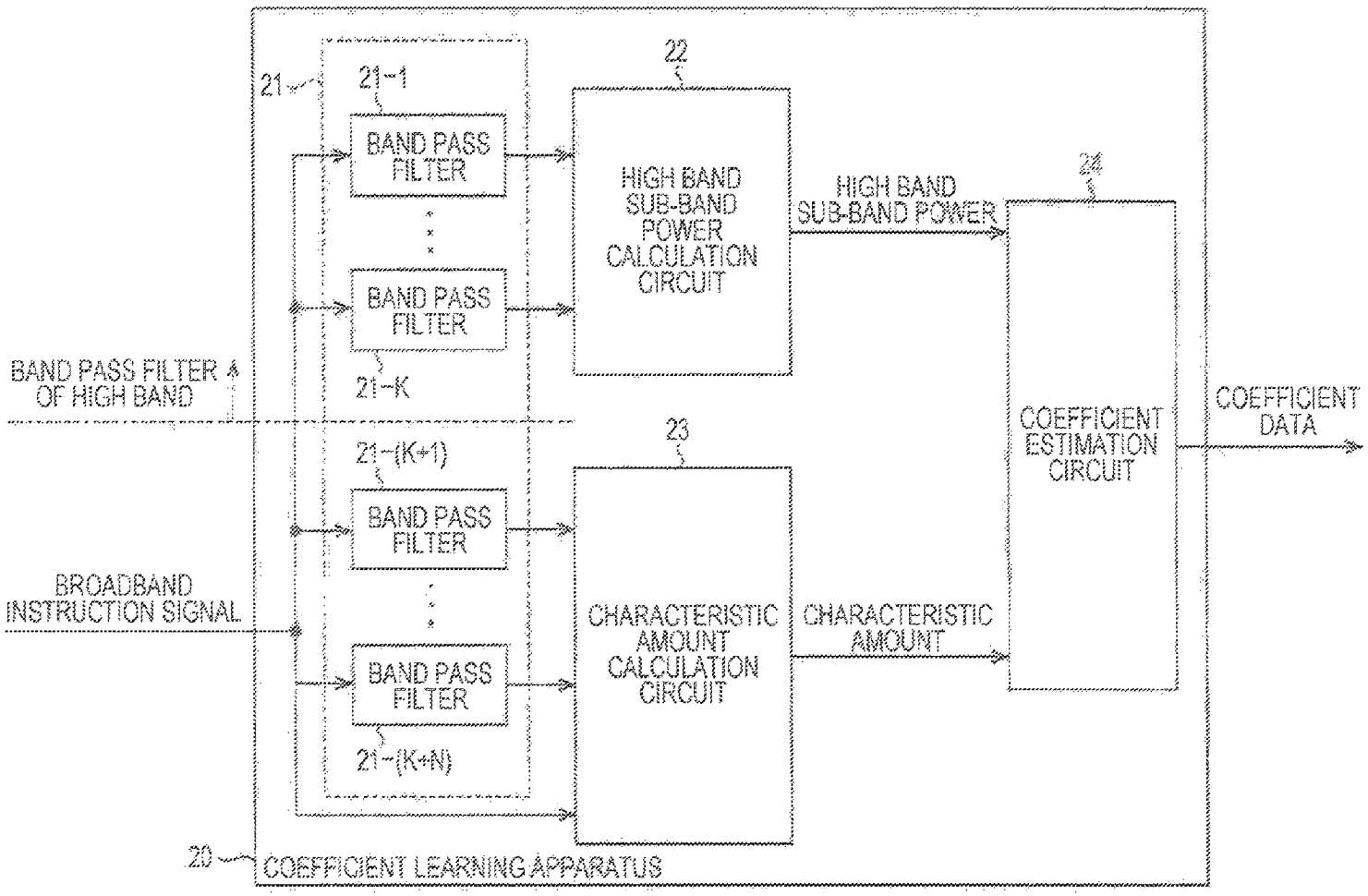
FIG. 9 is a block diagram illustrating a functional configuration example of a coefficient learning apparatus for performing learning of a coefficient used in a high band signal production circuit of a frequency band expansion apparatus in FIG. 3.

FIG. 9 illustrates a functional configuration example of a coefficient learning apparatus performing an instruction of coefficients $C_{ib}$ (kb), $D_{ib}$ and $E_{ib}$.

The signal component of the low band lower than the expansion initial band of a broadband instruction signal input to a coefficient learning apparatus 20 in FIG. 9 is a signal encoded in the same manner as an encoding method performed when the input signal having a limited band input to the frequency band expansion apparatus 10 in FIG. 3 is encoded.

A coefficient learning apparatus 20 includes a bandpass filter 21, a high band sub-band power calculation circuit 22, a characteristic amount calculation circuit 23, and a coefficient estimation circuit 24.

The band pass filter 21 includes band pass filters 21-1 to 21-(K+N) having the pass bands different from each other. The band pass filter 21-$i$($1 \leq i \leq K+N$) passes a signal of a predetermined pass band of the input signal and supplies the passed signal to the high band sub-band power calculation circuit 22 or the characteristic amount calculation circuit 23 as one of a plurality of sub-band signals. In addition, the band pass filters 21-1 to 21-K of the band pass filters 21-1 to 21-(K+N) pass a signal of the high band higher than the expansion start band.

The high band sub-band power calculation circuit 22 calculates a high band sub-band power of each sub-band for each constant time frame with respect to a plurality of sub-band signals of the high band, from the band pass filter 21 and supplies the calculated high band sub-band power to the coefficient estimation circuit 24.

The characteristic amount calculation circuit 23 calculates the same characteristic amount as the characteristic amount calculated by the characteristic amount calculation circuit 14 of the frequency band expansion apparatus 10 in FIG. 3 for the same respective time frames as a constant time frames in which the high band sub-band power is calculated by the high band sub-band power calculation circuit 22. That is, the characteristic amount calculation circuit 23 calculates one or more characteristic amounts using at least one of a plurality of sub-band signals from the band pass filter 21, and the broadband instruction signal, and supplies the calculated characteristic amounts to the coefficient estimation circuit 24.

The coefficient estimation circuit 24 estimates coefficient (coefficient data) used at the high band sub-band power estimation circuit 15 of the frequency band expansion apparatus 10 in FIG. 3 based on the high band sub-band power from the high band sub-band power calculation circuit 22 and the characteristic amount from the characteristic amount calculation circuit 23 for each constant time frame.

[Coefficient Learning Process of Coefficient Learning Apparatus]

Figure 10:
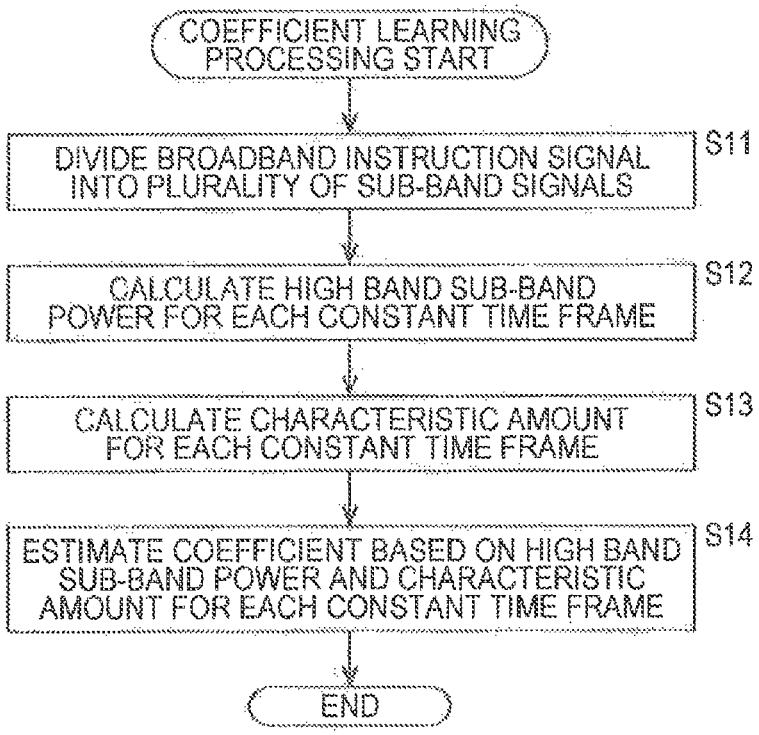
FIG. 10 is a flowchart describing an example of a coefficient learning process by a coefficient learning apparatus in FIG. 9.

Next, referring to a flowchart in FIG. 10, coefficient learning process by a coefficient learning apparatus in FIG. 9 will be described.

In step S11, the band pass filter 21 divides the input signal (expansion band instruction signal) into (K+N) sub-band signals. The band pass filters 21-1 to 21-K supply a plurality of sub-band signals of the high band higher than the expansion initial band to the high band sub-band power calculation circuit 22. In addition, the band pass filters 21-(K+1) to 21-(K+N) supply a plurality of sub-band signals of the low band lower than the expansion initial band to the characteristic amount calculation circuit 23.

In step S12, the high band sub-band power calculation circuit 22 calculates the high band sub-band power power(ib, J) of each sub-band for each constant time frame with respect to a plurality of the sub-band signals of the high band from the band pass filters 21 (band pass filter 21-1 to 21-K). The high band sub-band power power(ib, J) is obtained by the above mentioned Equation (1). The high band sub-band power calculation circuit 22 supplies the calculated high band sub-band power to the coefficient estimation circuit 24.

In step S13, the characteristic amount calculation circuit 23 calculates the characteristic amount for the same each time frame as the constant time frame in which the high band sub-band power is calculated by the high band sub-band power calculation circuit 22.

In addition, as described below, in the characteristic amount calculation circuit 14 of the frequency band expansion apparatus 10 in FIG. 3, it is assumed that the four sub-band powers and the dip of the low band are calculated as the characteristic amount and it will be described that the four sub-band powers and the dip of the low band calculated in the characteristic amount calculation circuit 23 of the coefficient learning apparatus 20 similarly.

That is, the characteristic amount calculation circuit 23 calculates four low band sub-band powers using four sub-band signals of the same respective four sub-band signals input to the characteristic amount calculation circuit 14 of the frequency band expansion apparatus 10 from the band pass filter 21 (band pass filter 21-(K+1) to 21-(K+4)). In addition, the characteristic amount calculation circuit 23 calculates the dip from the expansion band instruction signal and calculates the dip $dip_s$ (J) based on the Equation (12) described above. Further, the characteristic amount calculation circuit 23 supplies the four low band sub-band powers and the dip $dip_s$ (J) as the characteristic amount to the coefficient estimation circuit 24.

In step S14, the coefficient estimation circuit 24 performs estimation of coefficients $C_{ib}$ (kb), $D_{ib}$ and $E_{ib}$ based on a plurality of combinations of the (eb−sb) high band sub-band power of supplied to the same time frames from the high band sub-band power calculation circuit 22 and the characteristic amount calculation circuit 23 and the characteristic amount (four low band sub-band powers and dip $dip_s$ (J)). For example, the coefficient estimation circuit 24 determines the coefficients $C_{ib}$ (kb), $D_{ib}$ and $E_{ib}$ in Equation (13) by making five characteristic amounts (four low band sub-band powers and dip $dip_s$(J)) be an explanatory variable with respect to one of the sub-band of the high bands, and making the high band sub-band power power(ib,J) be an explained variable and performing a regression analysis using a least-squares method.

In addition, naturally the estimation method of coefficients $C_{ib}$ (kb), $D_{ib}$ and $E_{ib}$ is not limited to the above-mentioned method and various common parameter identification methods may be applied.

According to the processes described above, since the learning of the coefficients used in estimating the high band sub-band power is set to be performed by using a predetermined expansion band instruction signal, there is possibility to obtain a preferred output result with respect to various input signals input to the frequency band expansion apparatus 10 and thus it may be possible to reproduce a music signal having a better quality.

In addition, it is possible to calculate the coefficients $A_{ib}$(kb) and $B_{ib}$ in the above-mentioned Equation (2) by the coefficient learning method.

As described above, the coefficient learning processes was described premising that each estimation value of the high band sub-band power is calculated by the linear combination such as the four low band sub-band powers and the dip in the high band sub-band power estimation circuit 15 of the frequency band expansion apparatus 10.

However, a method for estimating the high band sub-band power in the high band sub-band power estimation circuit 15 is not limited to the example described above. For example, since the characteristic amount calculation circuit 14 calculates one or more of the characteristic amounts other than the dip (time variation of a low band sub-band power, slope, time variation of the slope and time variation of the dip), the high band sub-band power may be calculated, the linear combination of a plurality of characteristic amount of a plurality of frames before and after time frames J may be used, or a non-linear function may be used. That is, in the coefficient learning process, the coefficient estimation circuit 24 may calculate (learn) the coefficient on the same condition as that regarding the characteristic amount, the time frames and the function used in a case where the high band sub-band power is calculated by the high band sub-band power estimation circuit 15 of the frequency band expansion apparatus 10.

2. Second Embodiment

In a second embodiment, encoding processing and decoding processing in the high band characteristic encoding method by the encoder and the decoder are performed.

[Functional Configuration Example of Encoder]

Figure 11:
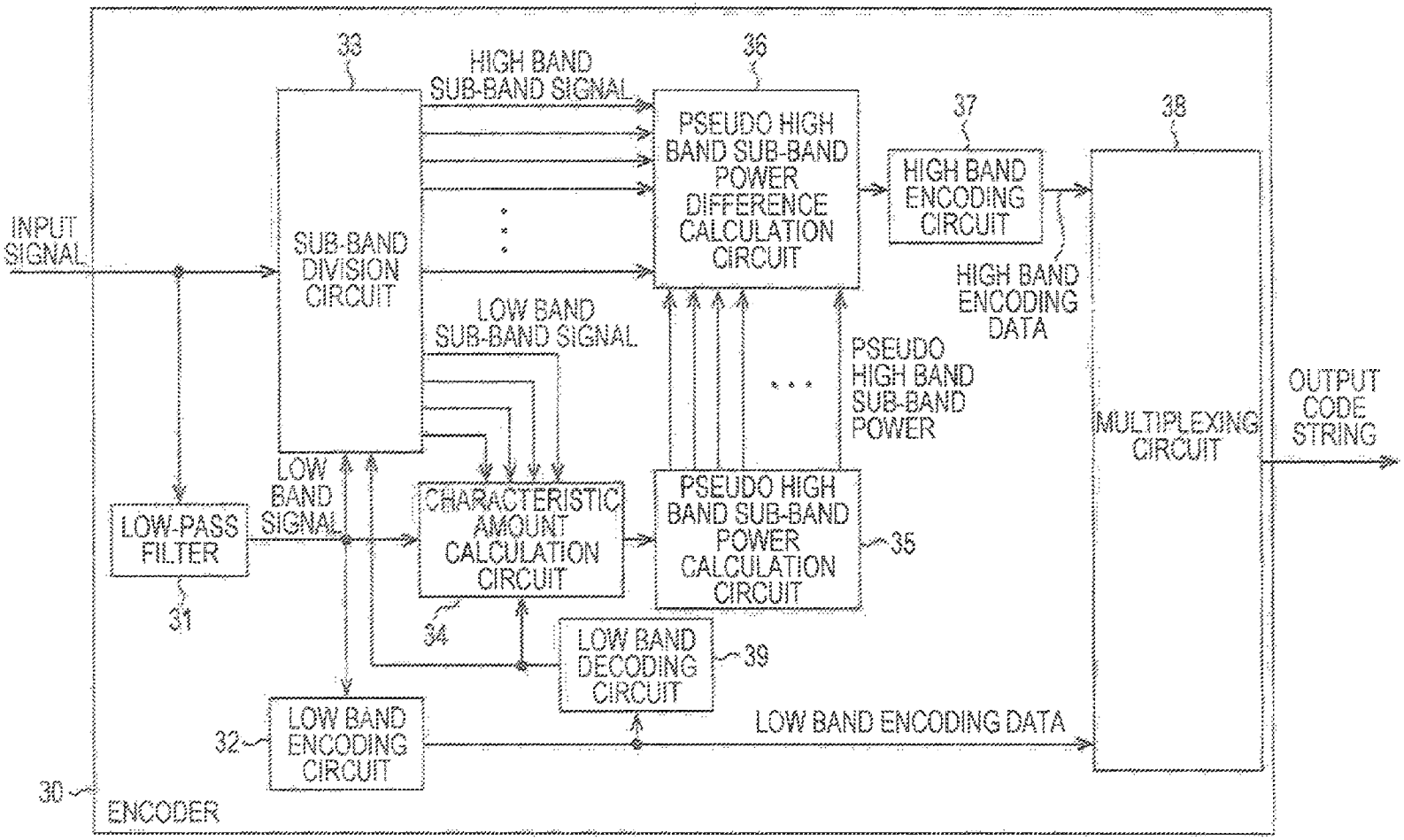
FIG. 11 is a block diagram illustrating a functional configuration example of an encoder in a second embodiment of the present invention.

FIG. 11 illustrates a functional configuration example of the encoder to which the present invention is applied.

An encoder 30 includes a 31, a low band encoding circuit 32, a sub-band division circuit 33, a characteristic amount calculation circuit 34, a pseudo high band sub-band power calculation circuit 35, a pseudo high band sub-band power difference calculation circuit 36, a high band encoding circuit 37, a multiplexing circuit 38 and a low band decoding circuit 39.

The low-pass filter 31 filters an input signal using a predetermined cutoff frequency and supplies a signal of a low band lower than a cutoff frequency (hereinafter, referred to as a low band signal) as signal after filtering to the low band encoding circuit 32, a sub-band division circuit 33, and a characteristic amount calculation circuit 34.

The low band encoding circuit 32 encodes a low band signal from the low-pass filter 31 and supplies low band encoded data obtained from the result to the multiplexing circuit 38 and the low band decoding circuit 39.

The sub-band division circuit 33 equally divides the input signal and the low band signal from the low-pass filter 31 into a plurality of sub-band signals having a predetermined band width and supplies the divided signals to the characteristic amount calculation circuit 34 or the pseudo high band sub-band power difference calculation circuit 36. In particular, the sub-band division circuit 33 supplies a plurality of sub-band signals (hereinafter, referred to as a low band sub-band signal) obtained by inputting to the low band signal, to the characteristic amount calculation circuit 34. In addition, the sub-band division circuit 33 supplies the sub-band signal thereinafter, referred to as a high band sub-band signal) of the high band higher than a cutoff frequency set by the low-pass filter 31 among a plurality of the sub-band signals obtained by inputting an input signal to the pseudo high band sub-band power difference calculation circuit 36.

The characteristic amount calculation circuit 34 calculates one or more characteristic amounts using any one of a plurality of sub-band signals of the low band sub-band signal from the sub-band division circuit 33 and the low band signal from the low-pass filter 31 and supplies the calculated characteristic amounts to the pseudo high band sub-band power calculation circuit 35.

The pseudo high band sub-band power calculation circuit 35 produces a pseudo high band sub-band power based on one or more characteristic amounts from the characteristic amount calculation circuit 34 and supplies the produced pseudo high band sub-band power to the pseudo high band sub-band power difference calculation circuit 36.

The pseudo high band sub-band power difference calculation circuit 36 calculates a pseudo high band sub-band power difference described below based on the high band sub-band signal from the sub-band division circuit 33 and the pseudo high band sub-band power from the pseudo high band sub-band power calculation circuit 35 and supplies the calculated pseudo high band sub-band power difference to the high band encoding circuit 37.

The high band encoding circuit 37 encodes the pseudo high band sub-band power difference from the pseudo high band sub-band power difference calculation circuit 36 and supplies the high band encoded data obtained from the result to the multiplexing circuit 38.

The multiplexing circuit 38 multiples the low band encoded data from the low band encoding circuit 32 and the high band encoded data from the high band encoding circuit 37 and outputs as an output code string.

The low band decoding circuit 39 suitably decodes the low band encoded data from the low band encoding circuit 32 and supplies decoded data obtained from the result to the sub-band division circuit 33 and the characteristic amount calculation circuit 34.

[Encoding Processing of Encoder]

Next, referring to a flowchart in FIG. 12, the encoding processing by the encoder 30 in FIG. 11 will be described.

In step S111, the low-pass filter 31 filters the input signal using a predetermined cutoff frequency and supplies the low band signal as the signal after filtering to the low band encoding circuit 32, the sub-band division circuit 33 and the characteristic amount calculation circuit 34.

In step S112, the low band encoding circuit 32 encodes the low band signal from the low-pass filter 31 and supplies low band encoded data obtained from the result to the multiplexing circuit 38.

In addition, for encoding of the low band signal in step S112, a suitable encoding method should be selected according to an encoding efficiency and a obtained circuit scale, and the present invention does not depend on the encoding method.

In step S113, the sub-band division circuit 33 equally divides the input signal and the low band signal to a plurality of sub-band signals having a predetermined bandwidth. The sub-band division circuit 33 supplies the low band sub-band signal obtained by inputting the low band signal to the characteristic amount calculation circuit 34. In addition, the sub-band division circuit 33 supplies the high band sub-band signal of a band higher than a frequency of the band limit, which is set by the low-pass filter 31 of a plurality of sub-band signals obtained by inputting the input signal to the pseudo high band sub-band power difference calculation circuit 36.

In a step S114, the characteristic amount calculation circuit 34 calculates one or more characteristic amounts using at least any one of a plurality of sub-band signals of the low band sub-band signal from sub-band division circuit 33 and a low band signal from the low-pass filter 31 and supplies the calculated characteristic amounts to the pseudo high band sub-band power calculation circuit 35. In addition, the characteristic amount calculation circuit 34 in FIG. 11 has basically the same configuration and function as those of the characteristic amount calculation circuit 14 in FIG. 3.

Since a process in step S114 is substantially identical with that of step S4 of a flowchart in FIG. 4, the description thereof is omitted.

In step S115, the pseudo high band sub-band power calculation circuit 35 produces a pseudo high band sub-band power based on one or more characteristic amounts from the characteristic amount calculation circuit 34 and supplies the produced pseudo high band sub-band power to the pseudo high band sub-band power difference calculation circuit 36. In addition, the pseudo high band sub-band power calculation circuit 35 in FIG. 11 has basically the same configuration and function as those of the high band sub-band power estimation circuit 15 in FIG. 3. Therefore, since a process in step S115 is substantially identical with that of step S5 of a flowchart in FIG. 4, the description thereof is omitted.

In step S116, a pseudo high band sub-band power difference calculation circuit 36 calculates the pseudo high band sub-band power difference based on the high band sub-band signal from the sub-band division circuit 33 and the pseudo high band sub-band power from the pseudo high band sub-band power calculation circuit 35 and supplies the calculated pseudo high band sub-band power difference to the high band encoding circuit 37.

Specifically, the pseudo high band sub-band power difference calculation circuit 36 calculates the (high band) sub-band power power(ib,J) in a constant time frames J with respect to the high band sub-band signal from the sub-band division circuit 33. In addition, in an embodiment of the present invention, all the sub-band of the low band sub-band signal and the sub-band of the high band sub-band signal distinguishes using the index ib. The calculation method of the sub-band power can apply to the same method as first embodiment, that is, the method used by Equation (1) thereto.

Next, the pseudo high band sub-band power difference calculation circuit 36 calculates a difference value (pseudo high band sub-band power difference) $power_{diff}$ (ib,J) between the high band sub-band power power (ib, J) and the pseudo high band sub-band power $power_{ib}$ (ib,J) from the pseudo high band sub-band power calculation circuit 35 in a time frame J. The pseudo high band sub-band power difference $power_{diff}$(ib,J) is obtained by the following Equation (14).

[Equation 14]

$$power_{diff}(ib,J)=power(ib,J)-power_{ib}(ib,J)$$

$$(J*FSIZE\leq n\leq(J+1)FSIZE-1, sb+1\leq ib\leq eb) \quad (14)$$

In Equation (14), an index sb+1 shows an index of the sub-band of the lowest band in the high band sub-band signal. In addition, an index eb shows an index of the sub-band of the highest band encoded in the high band sub-band signal.

As described above, the pseudo high band sub-band power difference calculated by the pseudo high band sub-band power difference calculation circuit 36 is supplied to the high band encoding circuit 37.

In step S117, the high band encoding circuit 37 encodes the pseudo high band sub-band power difference from the pseudo high band sub-band power difference calculation circuit 36 and supplies high band encoded data obtained from the result to the multiplexing circuit 38.

Specifically, the high band encoding circuit 37 determines that on obtained by making the pseudo high band sub-band power difference from the pseudo high band sub-band power difference calculation circuit 36 be a vector (hereinafter, referred to as a pseudo high band sub-band power difference vector) belongs to which cluster among a plurality of clusters in a characteristic space of the predetermined pseudo high band power sub-band difference. Herein, the pseudo high band sub-band power difference vector in a time frame J has, as a element of the vector, a value of a pseudo high band sub-band power difference $power_{diff}$(ib,J) for each index ib, and shows the vector of an (eb−sb) dimension. In addition, the characteristic space of the pseudo high band sub-band power difference is set as a space of the (eb−sb) dimension in the same way.

Therefore, the high band encoding circuit 37 measures a distance between a plurality of each representative vector of a plurality of predetermined clusters and the pseudo high band sub-band power difference vector in a characteristic space of the pseudo high band sub-band power difference, obtains index of the cluster having the shortest distance (hereinafter, referred to as a pseudo high band sub-band power difference ID) and supplies the obtained index as the high band encoded data to the multiplexing circuit 38.

In step S118, the multiplexing circuit 38 multiples low band encoded data output from the low band encoding circuit 32 and high band encoded data output from the high band encoding circuit 37 and outputs an output code string.

Therefore, as an encoder in the high band characteristic encoding method, Japanese Patent Application Laid-Open No. 2007-17908 discloses a technology producing the pseudo high band sub-band signal from the low band sub-band signal, comparing the pseudo high band sub-band signal and power of the high band sub-band signal with each other for each sub-band, calculating a gain of power for each sub-band to match the power of the pseudo high band sub-band signal to the power of the high band sub-band signal, and causing the calculated gain to be included in the code string as information of the high band characteristic.

According to the process described above, only the pseudo high band sub-band power difference ID may be included in the output code string as information for estimating the high band sub-band power in decoding. That is, for example, if the number of the predetermined clusters is 64, as information for restoring the high band signal in a decoder, 6 bit information may be added to the code string per a time frame and an amount of information included in the code string can be reduced to improve decoding efficiency compared with a method disclosed in Japanese Patent Application Laid-Open No. 2007-17908, and it is possible to reproduce a music signal having a better sound quality.

In addition, in the processes described above, the low band decoding circuit 39 may input the low band signal obtained by decoding the low band encoded data from the low band encoding circuit 32 to the sub-band division circuit 33 and the characteristic amount calculation circuit 34 if there is a margin in the characteristic amount. In the decoding processing by the decoder, the characteristic amount is calculated from the low band signal decoding the low band encoded data and the power of the high band sub-band is estimated based on the characteristic amount. Therefore, even in the encoding processing, if the pseudo high band sub-band power difference ID which is calculated based on the characteristic amount calculated from the decoded low band signal is included in the code string, in the decoding processing by the decoder, the high band sub-band power having a better accuracy can be estimated. Therefore, it is possible to reproduce a music signal having a better sound quality.

[Functional Configuration Example of Decoder]

Next, referring to FIG. 13, a functional configuration example of a decoder corresponding to the encoder 30 in FIG. 11 will be described.

A decoder 40 includes a demultiplexing circuit 41, a low band decoding circuit 42, a sub-band division circuit 43, a characteristic amount calculation circuit 44, and a high band decoding circuit 45, a decoded high band sub-band power calculation circuit 46, a decoded high band signal production circuit 47, and a synthesis circuit 48.

The demultiplexing circuit 41 demultiplexes the input code string into the high band encoded data and the low band encoded data and supplies the low band encoded data to the low band decoding circuit 42 and supplies the high band encoded data to the high band decoding circuit 45.

The low band decoding circuit 42 performs decoding of the low band encoded data from the demultiplexing circuit 41. The low band decoding circuit 42 supplies a signal of a low band obtained from the result of the decoding (hereinafter, referred to as a decoded low band signal) to the sub-band division circuit 43, the characteristic amount calculation circuit 44 and the synthesis circuit 48.

The sub-band division circuit 43 equally divides a decoded low band signal from the low band decoding circuit 42 into a plurality of sub-band signals having a predetermined bandwidth and supplies the sub-band signal (decoded low band sub-band signal) to the characteristic amount calculation circuit 44 and the decoded high band signal production circuit 47.

The characteristic amount calculation circuit 44 calculates one or more characteristic amounts using any one of a plurality of sub-band signals of decoded low band sub-band signals from the sub-band division circuit 43, and a decoded low band signal from a low band decoding circuit 42, and supplies the calculated characteristic amounts to the decoded high band sub-band power calculation circuit 46.

The high band decoding circuit 45 decodes high band encoded data from the demultiplexing circuit 41 and supplies a coefficient (hereinafter, referred to as a decoded high band sub-band power estimation coefficient) for estimating a high band sub-band power using a pseudo high band sub-band power difference ID obtained from the result, which is prepared for each predetermined ID (index), to the decoded high band sub-band power calculation circuit 46.

The decoded high band sub-band power calculation circuit 46 calculates the decoded high band sub-band power based on one or more characteristic amounts from the characteristic amount calculation circuit 44 and the decoded high band sub-band power estimation coefficient from the high band decoding circuit 45 and supplies the calculated decoded high band sub-band power to the decoded high band signal production circuit 47.

The decoded high band signal production circuit 47 produces a decoded high band signal based on a decoded low band sub-band signal from the sub-band division circuit 43 and the decoded high band sub-band power from the decoded high band sub-band power calculation circuit 46 and supplies the produced signal and power to the synthesis circuit 48.

The synthesis circuit 48 synthesizes a decoded low band signal from the low band decoding circuit 42 and the decoded high band signal from the decoded high band signal production circuit 47 and outputs the synthesized signals as an output signal.

[Decoding Process of Decoder]

Next, a decoding process using the decoder in FIG. 13 will be described with reference to a flowchart in FIG. 14.

In step S131, the demultiplexing circuit 41 demultiplexes an input code string into the high band encoded data and the low band encoded data, supplies the low band encoded data to the low band decoding circuit 42 and supplies the high band encoded data to the high band decoding circuit 45.

In step S132, the low band decoding circuit 42 decodes the low band encoded data from the demultiplexing circuit 41 and supplies the decoded low band signal obtained from the result to the sub-band division circuit 43, the characteristic amount calculation circuit 44 and the synthesis circuit 48.

In step S133, the sub-band division circuit 43 equally divides the decoded low band signal from the low band decoding circuit 42 into a plurality of sub-band signals having a predetermined bandwidth and supplies the obtained decoded low band sub-band signal to the characteristic amount calculation circuit 44 and the decoded high band signal production circuit 47.

In step S134, the characteristic amount calculation circuit 44 calculates one or more characteristic amount from any one of a plurality of the sub-band signals of the decoded low band sub-band signals from the sub-band division circuit 43 and the decoded low band signal from the low band decoding circuit 42 and supplies the signals to the decoded high band sub-band power calculation circuit 46. In addition, the characteristic amount calculation circuit 44 in FIG. 13 basically has the same configuration and function as the characteristic amount calculation circuit 14 in FIG. 3 and the process in step S134 has the same process in step S4 of a flowchart in FIG. 4. Therefore, the description thereof is omitted.

In step S135, the high band decoding circuit 45 decodes the high band encoded data from the demultiplexing circuit 41 and supplies the decoded high band sub-band power estimation coefficient prepared for each predetermined TD (index) using the pseudo high band sub-band power difference ID obtained from the result to the decoded high band sub-band power calculation circuit 46.

In step S136, the decoded high band sub-band power calculation circuit 46 calculates the decoded high band sub-band power based on one or more characteristic amount from the characteristic amount calculation circuit 44 and the decoded high band sub-band power estimation coefficient from the high band decoding circuit 45 and supplies the power to the decoded high band signal production circuit 47. In addition, since the decoding high band, decoding high bans sub-band calculation circuit 46 in FIG. 13 has the same configuration and a function as those of the high band sub-band power estimation circuit. 15 in FIG. 3 and process in step S136 has the same process in step S5 of a flowchart in FIG. 4, the detailed description is omitted.

In step S137, the decoded high band signal production circuit 47 outputs a decoded high band signal based on a decoded low band sub-band signal from the sub-band division circuit 43 and a decoded high band sub-band power from the decoded high band sub-band power calculation circuit 46. In addition, since the decoded high band signal production circuit 47 in FIG. 13 basically has the same configuration and function as the high band signal production circuit 16 in FIG. 3 and the process in step S137 has the same process as step S6 of the flowchart in FIG. 4, the detailed description thereof is omitted.

In step S138, the synthesis circuit 48 synthesizes a decoded low band signal from the low band decoding circuit 42 and a decoded high band signal from the decoded high band signal production circuit 47 and outputs synthesized signal as an output signal.

According to the process described above, it is possible to improve estimation accuracy of the high band sub-band power and thus it is possible to reproduce music signals having a good quality in decoding by using the high band sub-band power estimation coefficient in decoding in response to the difference characteristic between the pseudo high band sub-band power calculated in advance in encoding and an actual high band sub-band power.

In addition, according to the process, since information for producing the high band signal included in the code string has only a pseudo high band sub-band power difference ID, it is possible to effectively perform the decoding processing.

As described above, although the encoding process and decoding processing according to the present invention are described, hereinafter, a method of calculates each representative vector of a plurality of clusters in a specific space of a predetermined pseudo high band sub-band power difference in the high band encoding circuit 37 of the encoder 30 in FIG. 11 and a decoded high band sub-band power estimation coefficient output by the high band decoding circuit 45 of the decoder 40 in FIG. 13 will be described.

[Calculation Method of Calculating Representative Vector of a plurality of Clusters in Specific Space of Pseudo High Band Sub-Band Power Difference and Decoding High Bond Sub-Band Power Estimation Coefficient Corresponding to Each Cluster]

As a way for obtaining the representative vector of a plurality of clusters and the decoded high band sub-band power estimation coefficient of each cluster, it is necessary to prepare the coefficient so as to estimate the high band sub-band power in a high accuracy in decoding in response to a pseudo high band sub-band power difference vector calculated in encoding. Therefore, learning is performed by a broadband instruction signal in advance and the method of determining the learning is applied based on the learning result.

[Functional Configuration Example of Coefficient Learning Apparatus]

Figure 15:
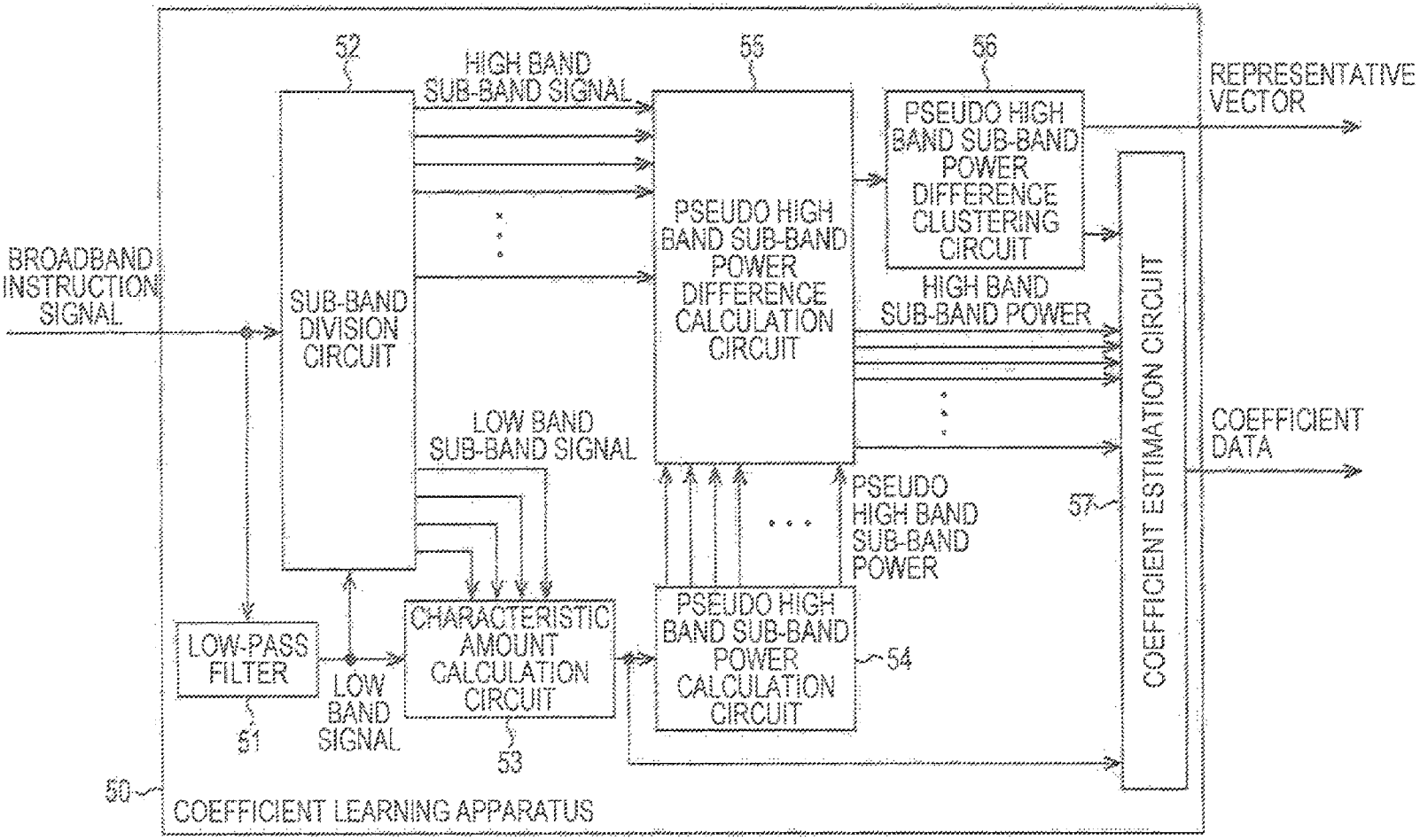
FIG. 15 is a block diagram illustrating a functional configuration example of a coefficient learning apparatus for performing learning of a representative vector used in a high band encoding circuit of an encoder in FIG. 11 and decoded high band sub-band power estimation coefficient used in a high band decoding circuit of decoder in FIG. 13.

FIG. 15 illustrates a functional configuration example of a coefficient learning apparatus performing learning of a representative vector of a plurality of cluster and a decoded high band sub-band power estimation coefficient of each cluster.

It is preferable that a signal component of the broadband instruction signal input to the coefficient learning apparatus 50 in FIG. 15 and of a cutoff frequency or less set by a low-pass filter 31 of the encoder 30 is a decoded low band signal in which the input signal to the encoder 30 passes through the low-pass filter 31, that is encoded by the low band encoding circuit 32 and that is decoded by the low band decoding circuit 42 of the decoder 40.

A coefficient learning apparatus 50 includes a low-pass filter 51, a sub-band division circuit 52, a characteristic amount calculation circuit 53, a pseudo high band sub-band power calculation circuit 54, a pseudo high band sub-band power difference calculation circuit 55, a pseudo high band sub-band power difference clustering circuit 56 and a coefficient estimation circuit 57.

In addition, since each of the low-pass filter 51, the sub-band division circuit 52, the characteristic amount calculation circuit 53 and the pseudo high band sub-band power calculation circuit 54 in the coefficient learning apparatus 50 in FIG. 15 basically has the same configuration and function as each of the low-pass filter 31, the sub-band division circuit 33, the characteristic amount calculation circuit 34 and the pseudo high band sub-band power calculation circuit 35 in the encoder 30 in FIG. 11, the description thereof is suitably omitted.

In other word, although the pseudo high band sub-band power difference calculation circuit 55 provides the same configuration and function as the pseudo high band sub-band power difference calculation circuit 36 in FIG. 11, the calculated pseudo high band sub-band power difference is supplied to the pseudo high band sub-band power difference clustering circuit 56 and the high band sub-band power calculated when calculating the pseudo high band sub-band power difference is supplied to the coefficient estimation circuit 57.

The pseudo high band sub-band power difference clustering circuit 56 clusters a pseudo high band sub-band power difference vector obtained from a pseudo high band sub-band power difference from the pseudo high band sub-band power difference calculation circuit 55 and calculates the representative vector at each cluster.

The coefficient estimation circuit 57 calculates the high band sub-band power estimation coefficient for each cluster clustered by the pseudo high band sub-band power difference clustering circuit 56 based on a high band sub-band power from the pseudo high band sub-band power difference calculation circuit 55 and one or more characteristic amount from the characteristic amount calculation circuit 53.

[Coefficient Learning Process of Coefficient Learning Apparatus]

Next, a coefficient learning process by the coefficient learning apparatus 50 in FIG. 15 will be described with reference to a flowchart in FIG. 16.

Figure 12:
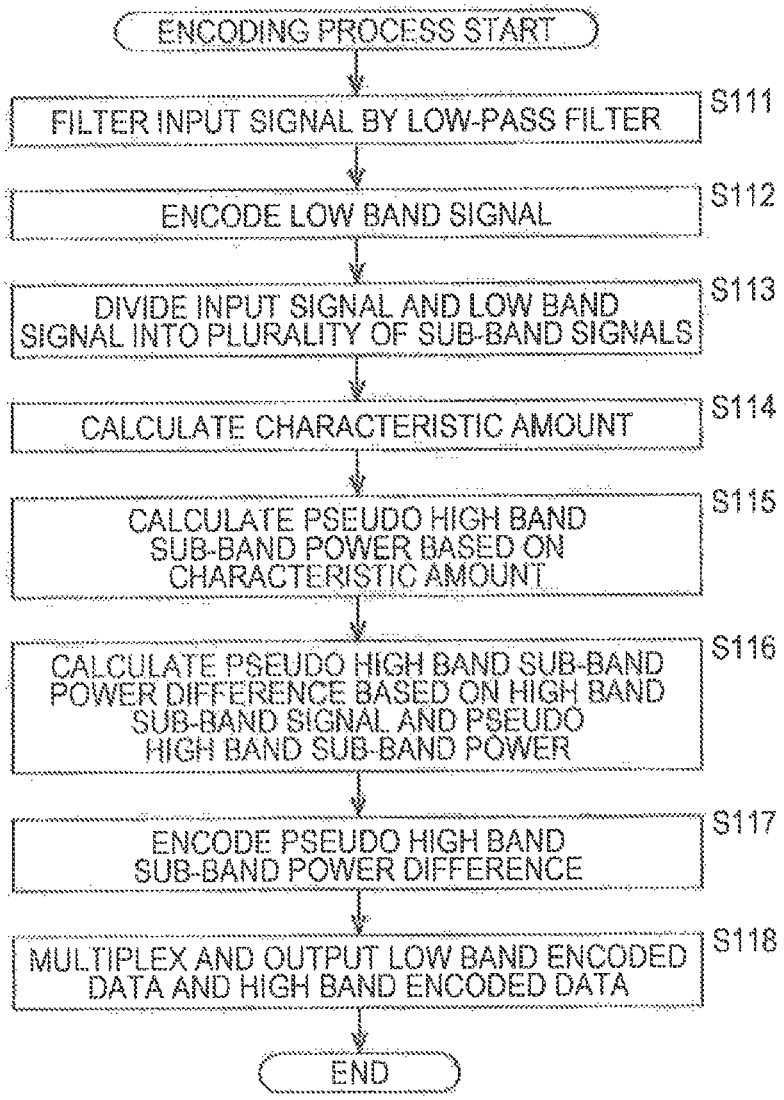
FIG. 12 is a flowchart describing an example of an encoding process by an encoder in FIG. 11.
Figure 16:
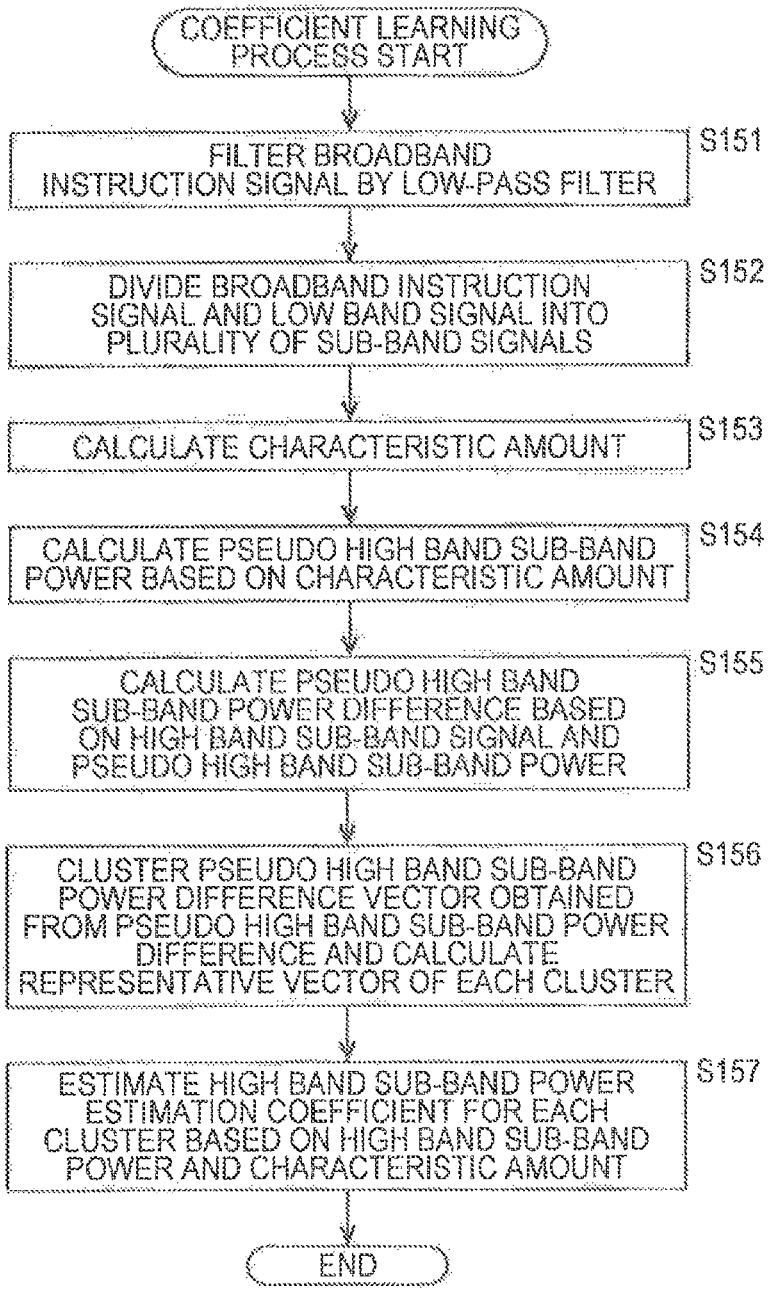
FIG. 16 is a flowchart describing an example of a coefficient learning process by a coefficient learning apparatus in FIG. 15.

In addition, the process of step S151 to S155 of a flowchart in FIG. 16 is identical with those of step S111, S113 to S116 of a flowchart in FIG. 12 except that signal input to the coefficient learning apparatus 50 is a broadband instruction signal, and thus the description thereof is omitted.

That is, in step S156, the pseudo high band sub-band power difference clustering circuit 56 clusters a plurality of pseudo high band sub-band power difference vectors (a lot of time frames) obtained from a pseudo high band sub-band power difference from the pseudo high band sub-band power difference calculation circuit 55 to 64 clusters and calculates the representative vector for each cluster. As an example of a clustering method, for example, clustering by k-means method can be applied. The pseudo high band sub-band power difference clustering circuit 56 sets a center vector of each cluster obtained from the result performing clustering by k-means method to the representative vector of each cluster. In addition, a method of the clustering or the number of cluster is not limited thereto, but may apply other method.

In addition, the pseudo high band sub-band power difference clustering circuit 56 measures distance between 64 representative vectors and the pseudo high band sub-band power difference vector obtained from the pseudo high band sub-band power difference from the pseudo high band sub-band power difference calculation circuit 55 in the time frames J and determines index CID(J) of the cluster included in the representative vector that has is the shortest distance. In addition, the index CID(J) takes an integer value of 1 to the number of the clusters (for example, 64). Therefore, the pseudo high band sub-band power difference clustering circuit 56 outputs the representative vector and supplies the index CID(J) to the coefficient estimation circuit 57.

In step S157, the coefficient estimation circuit 57 calculates a decoded high band sub-band power estimation coefficient at each cluster every set having the same index CID (J) (included in the same cluster) in a plurality of combinations of a number (eb−sb) of the high band sub-band power and the characteristic amount supplied to the same time frames from the pseudo high band sub-band power difference calculation circuit 55 and the characteristic amount calculation circuit 53. A method for calculating the coefficient by the coefficient estimation circuit 57 is identical with the method by the coefficient estimation circuit 24 of the coefficient learning apparatus 20 in FIG. 9. However, the other method may be used.

Figure 13:
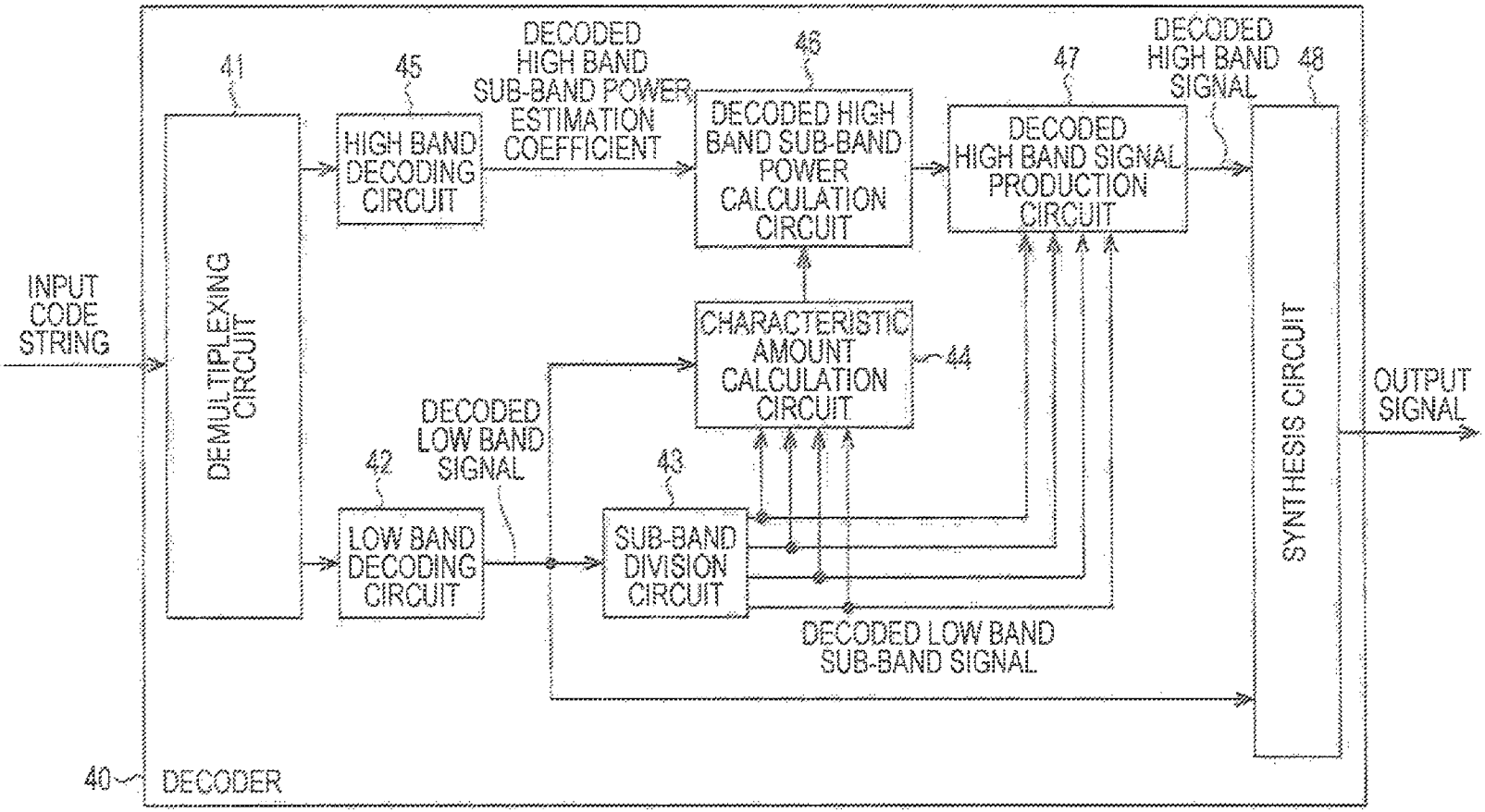
FIG. 13 is a block diagram illustrating a functional configuration example of a decoder in a second embodiment of the present invention.
Figure 14:
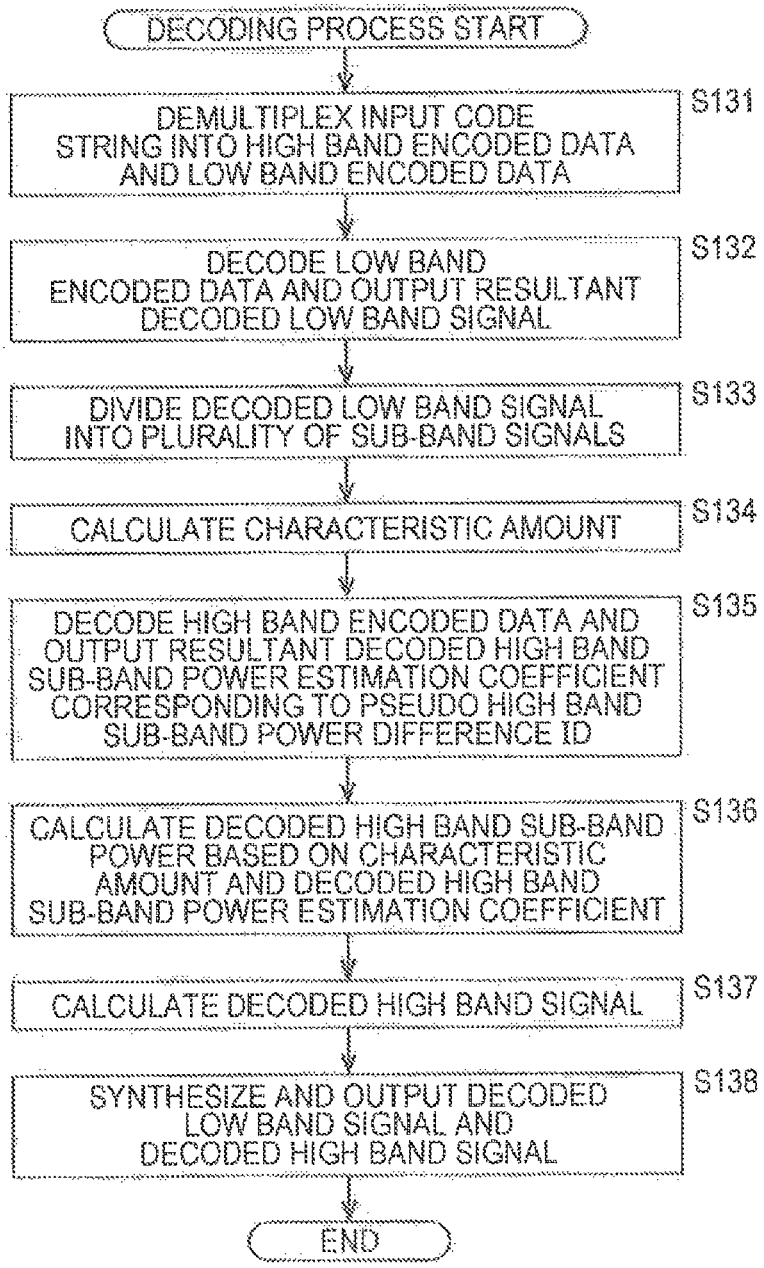
FIG. 14 is a flowchart describing an example of a decoding processing by a decoder in FIG. 13.

According to the processing described above, by using a predetermined broadband instruction signal, since a learning for the each representative vector of a plurality of clusters in the specific space of the pseudo high band sub-band power difference predetermined in the high band encoding circuit 37 of the encoder 30 in FIG. 11 and a learning for the decoded high band sub-band power estimation coefficient output by the high band decoding circuit 45 of the decoder 40 in FIG. 13 is performed, it is possible to obtain the desired output result with respect to various input signals input to the encoder 30 and various input code string input to the decoder 40 and it is possible to reproduce a music signal having the high quality.

In addition, with respect to encoding and decoding of the signal, the coefficient data for calculating the high band sub-band power in the pseudo high band sub-band power calculation circuit 35 of encoder 30 and the decoded high band sub-band power calculation circuit 46 of the decoder 40 can be processed as follows. That is, it is possible to record the coefficient in the front position of code string by using the different coefficient data by the kind of the input signal.

For example, it is possible to achieve an encoding efficiency improvement by changing the coefficient data by a signal such as speech and jazz.

Figure 17:
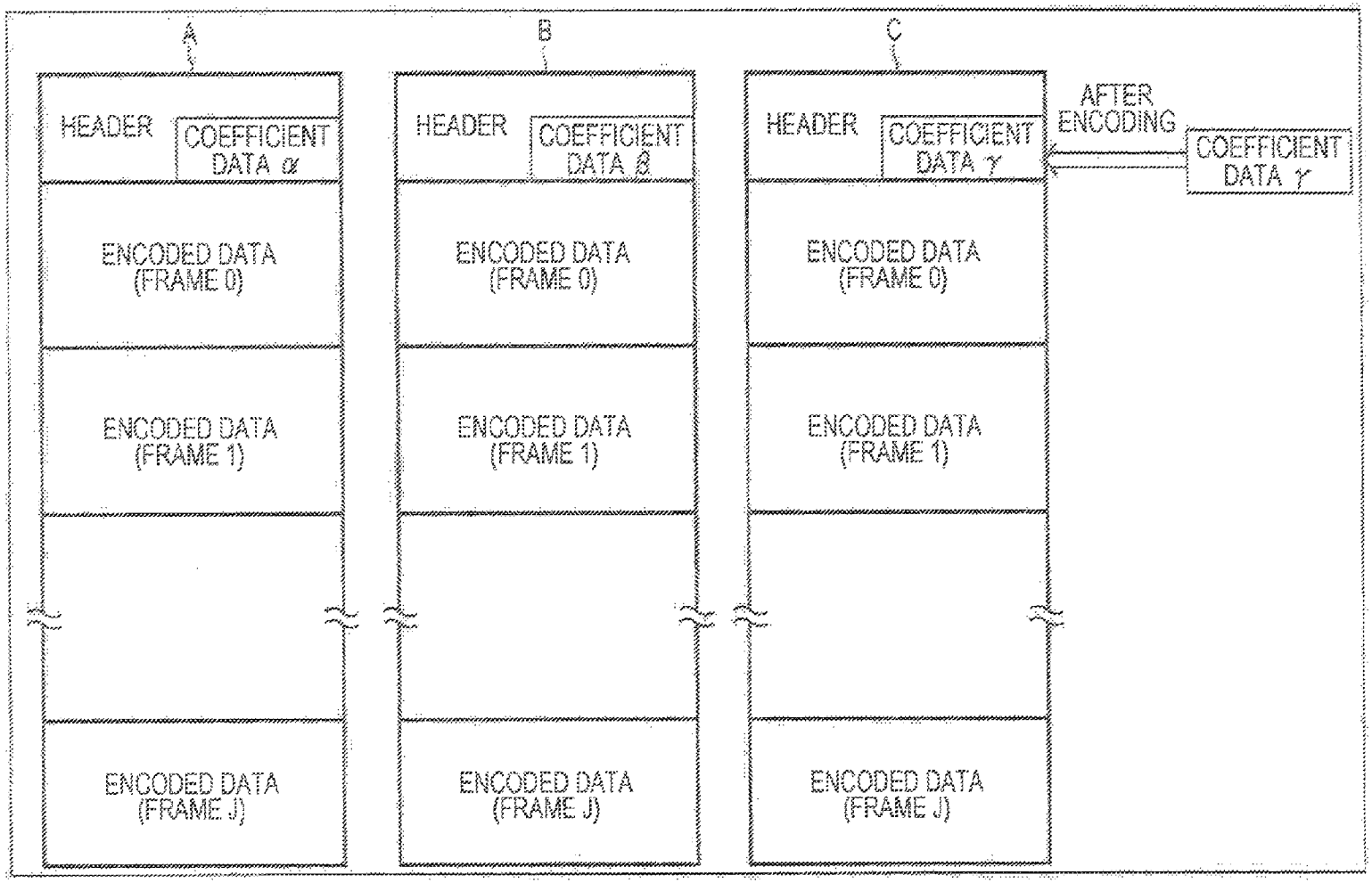
FIG. 17 is a view illustrating an example of an encoded string to which an encoder in FIG. 11 is output.

FIG. 17 illustrates the code string obtained from the above method.

The code string A in FIG. 17 encodes the speech and an optimal coefficient data $\alpha$ in the speech is recorded in a header.

In this contrast, since the code string B in FIG. 17 encodes jazz, the optimal coefficient data $\beta$ in the jazz is recorded in the header.

The plurality of coefficient data described above can be easily learned by the same kind of the music signal in advance and the encoder 30 may select the coefficient data from genre information recorded in the header of the input signal. In addition, the genre is determined by performing a waveform analysis of the signal and the coefficient data may be selected. That is, a genre analysis method of signal is not limited in particular.

When calculation time allows, the encoder 30 is equipped with the learning apparatus described above and thus the process is performed by using the coefficient dedicated to the signal and as illustrated in the code string C in FIG. 17, finally, it is also possible to record the coefficient in the header.

An advantage using the method will be described as follow.

A shape of the high band sub-band power includes a plurality of similar positions in one input signal. By using characteristic of a plurality of input signals, and by performing the learning of the coefficient for estimating of the high band sub-band power every the input signal, separately, redundancy due to in the similar position of the high band sub-band power is reduced, thereby improving encoding efficiency. In addition, it is possible to perform estimation of the high band sub-band power with higher accuracy than the learning of the coefficient for estimating the high band sub-band power using a plurality of signals statistically.

Further, as described above, the coefficient data learned from the input signal in decoding can take the form to be inserted once into every several frames.

3. Third Embodiment

Functional Configuration Example of Encoder

In addition, although it was described that the pseudo high band sub-band power difference ID is output from the encoder 30 to the decoder 40 as the high band encoded data, the coefficient index for obtaining the decoded high band sub-band power estimation coefficient may be set as the high band encoded data.

Figure 18:
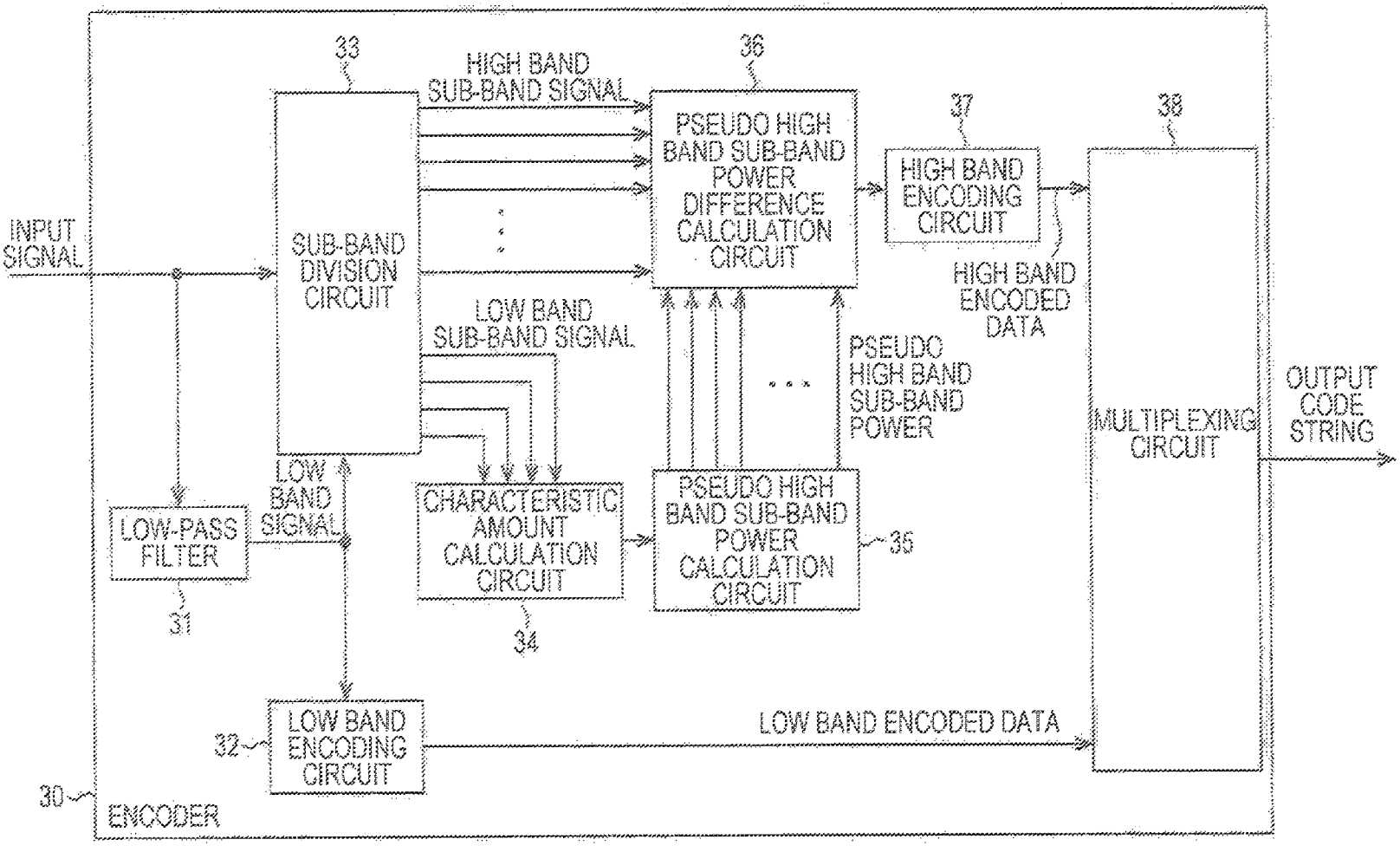
FIG. 18 is a block diagram illustrating a functional configuration example of the encoder.

In this case, the encoder 30, for example, is configured as illustrated in FIG. 18. In addition, in FIG. 18, parts corresponding to parts in FIG. 1 has the same numeral reference and the description thereof is suitably omitted.

The encoder 30 in FIG. 18 is the same expect that the encoder 30 in FIG. 11 and the low band decoding circuit 39 are not provided and the remainder is the same.

In the encoder 30 in FIG. 18, the characteristic amount calculation circuit 34 calculates the low band sub-band power as the characteristic amount by using the low band sub-band signal supplied from the sub-band division circuit 33 and is supplied to the pseudo high band sub-band power calculation circuit 35.

In addition, in the pseudo high band sub-band power calculation circuit 35, a plurality of decoded high band sub-band power estimation coefficients obtained by the predetermined regression analysis is corresponded to a coefficient index specifying the decoded high band sub-band power estimation coefficient to be recorded.

Specifically, sets of a coefficient $A_{ib}$(kb) and a coefficient $B_{ib}$ for each sub-band used in operation of Equation (2) described above are prepared in advance as the decoded high band sub-band power estimation coefficient. For example, the coefficient $A_{ib}$(kb) and the coefficient $B_{ib}$ are calculated by an regression analysis using a least-squares method by setting the low band sub-band power to an explanation variable and the high band sub-band power to an explained variable in advance. In the regression analysis, an input signal including the low band sub-band signal and the high band sub-band signal is used as the broadband instruction signal.

The pseudo high band sub-band power calculation circuit 35 calculates the pseudo high band sub-band power of each sub-band of the high band side by using the decoded high band sub-band power estimation coefficient and the characteristic amount from the characteristic amount calculation circuit 34 for each of a decoded high band sub-band power estimation coefficient recorded and supplies the sub-band power to the pseudo high band sub-band power difference calculation circuit 36.

The pseudo high band sub-band power difference calculation circuit 36 compares the high band sub-band power obtained from the high band sub-band signal supplied from the sub-band division circuit 33 with the pseudo high band sub-band power from the pseudo high band sub-band power calculation circuit 35.

In addition, the pseudo high band sub-band power difference calculation circuit 36 supplies the coefficient index of the decoded high band sub-band power estimation coefficient, in which the pseudo high band sub-band power closed to the highest pseudo high band sub-band power is obtained among the result of the comparison and a plurality of decoded high band sub-band power estimation coefficient to the high band encoding circuit 37. That is, the coefficient index of decoded high band sub-band power estimation coefficient from which the high band signal of the input signal to be reproduced in decoding that is the decoded high band signal closest to a true value is obtained.

[Encoding Process of Encoder]

Figure 19:
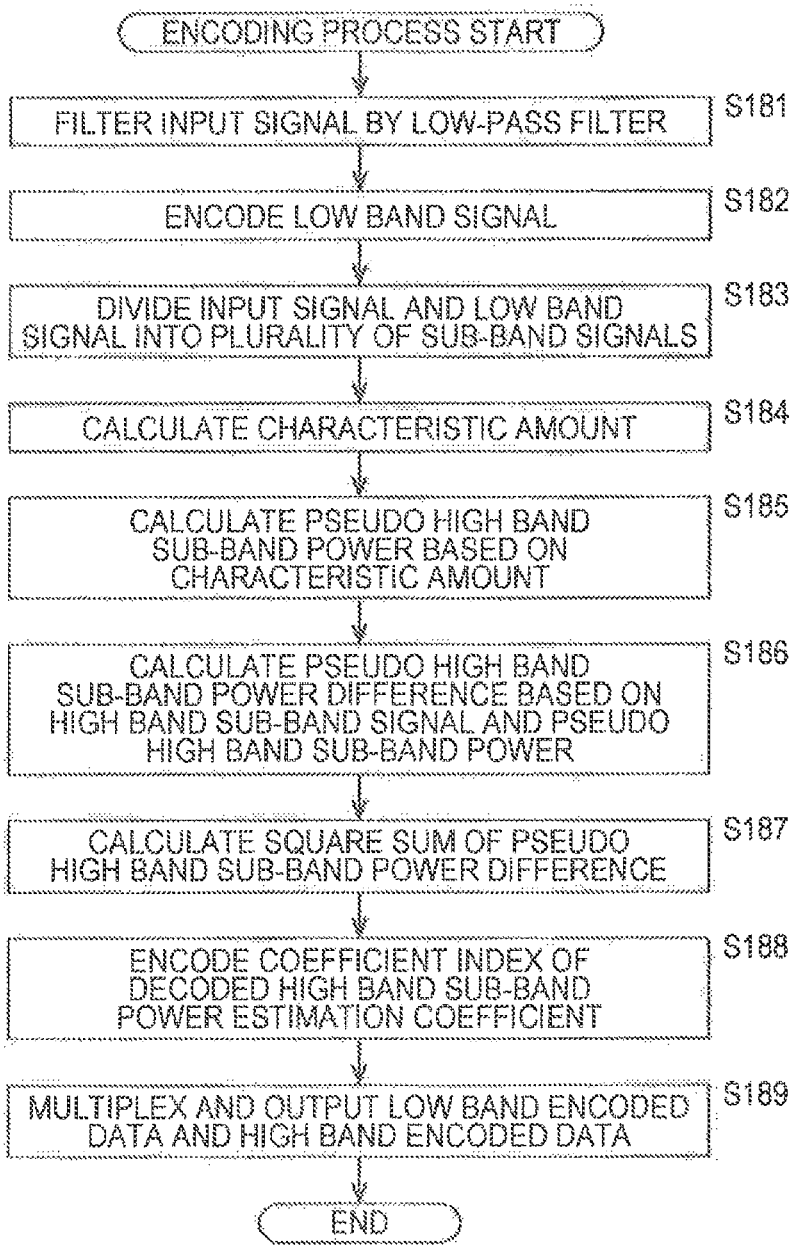
FIG. 19 is a flowchart describing of encoding processing.

Next, referring to a flow chart in FIG. 19, an encoding process performing by the encoder 30 in FIG. 18 will be described. In addition, processing of step S181 to step S183 are identical with those of step S111 to S113 in FIG. 12. Therefore, the description thereof is omitted.

In step S184, the characteristic amount calculation circuit 34 calculates characteristic amount by using the low band sub-band signal from the sub-band division circuit 33 and supplies the characteristic amount to the pseudo high band sub-band power calculation circuit 35.

Specially, the characteristic amount calculation circuit 34 calculates as a characteristic amount, the low band sub-band power power(ib,J) of the frames J (where, 0≤J) with respect to each sub-band ib (where, sb−3≤ib≤sb) in a low band side by performing operation of Equation (1) described above. That is, the low band sub-band power power(ib,J) calculates by digitizing a square mean value of the sample value of each sample of the low band sub-band signal constituting the frames J.

In step S185, the pseudo high band sub-band power calculation circuit 35 calculates the pseudo high band sub-band power based on the characteristic amount supplied from the characteristic amount calculation circuit 34 and supplies the pseudo high band sub-band power to the pseudo high band sub-band power difference calculation circuit 36.

For example, the pseudo high band sub-band power calculation circuit 35 calculates the pseudo high band sub-band power $power_{est}$(ib,J), which performs above-mentioned Equation (2) by using the coefficient $A_{ib}$ (kb) and the coefficient $B_{ib}$ recorded as the decoded high band sub-band power coefficient in advance and the pseudo high band sub-band power $power_{est}$(ib,J) which performs the operation the above-mentioned Equation (2) by using the low band sub-band power power(kb,J) (where, sb−s≤kb≤sb).

That is, coefficient $A_{ib}$(kb) for each sub-band multiplies the low band sub-band power power(kb,J) of each sub-band of the low band side supplied as the characteristic amount and the coefficient $B_{ib}$ is added to the sum of the low band sub-band power by which the coefficient is multiplied and then becomes the pseudo high band sub-band power $power_{est}$(ib,J). This pseudo high band sub-band power is calculated for each sub-band of the high band side in which the index is sb+1 to eb In addition, the pseudo high band sub-band power calculation circuit 35 performs the calculation of the pseudo high band sub-band power for each decoded high band sub-band power estimation coefficient recorded in advance. For example, it is assumed that the coefficient index allows 1 to K (where, 2≤K) number of decoding high band sub-band estimation coefficient to be prepared in advance. In this case, the pseudo high band sub-band power of each sub-band is calculated for each of the K decoded high band sub-band power estimation coefficients.

In step S186, the pseudo high band sub-band power difference calculation circuit 36 calculates the pseudo high band sub-band power difference based on a high band sub-band signal from the sub-band division circuit 33, and the pseudo high band sub-band power from the pseudo high band sub-band power calculation circuit 35.

Specifically, the pseudo high band sub-band power difference calculation circuit 36 does not perform the same operation as the Equation (1) described above and calculates the high band sub-band power power(ib,J) in the frames J with respect to high band sub-band signal from the sub-band division circuit 33. In addition, in the embodiment, the whole of the sub-band of the low band sub-band signal and the high band sub-band signal is distinguished by using index ib.

Next, the pseudo high band sub-band power difference calculation circuit 36 performs the same operation as the Equation (14) described above and calculates the difference between the high band sub-band power power(ib, J) in the frames J and the pseudo high band sub-band power $power_{est}$ (ib,J). In this case, the pseudo high band sub-band power difference $power_{diff}$(ib,J) is obtained for each decoded high band sub-band power estimation coefficient with respect to each sub-band of the high band side which index is sb+1 to eb.

In step S187, the pseudo high band sub-band power difference calculation circuit 36 calculates the following Equation (15) for each decoded high band sub-band power estimation coefficient and calculates a sum of squares of the pseudo high band sub-band power difference.

[Equation 15]

$$E(J, id) = \sum_{ib=sb+1}^{eb} \{power_{diff}(ib, J, id)\}^2 \tag{15}$$

In addition, in Equation (15), the square sum for a difference E (J, id) is obtained with respect to the decoded high band sub-band power estimation coefficient in which the coefficient index is id and the frames J. In addition, in Equation (15), $power_{diff}$(ib,J,id) is obtained with respect to the decoded high band sub-band power estimation coefficient in which the coefficient index is id decoded high band sub-band power and shows the pseudo high band sub-band power difference ($power_{diff}$(ib,J)) of the pseudo high band sub-band power difference $power_{diff}$(ib,J) of the frames J of the sub-band which the index is ib. The square sum of a difference E(J, id) is calculated with respect to the number of K of each decoded high band sub-band power estimation coefficient.

The square sum for a difference E(J, id) obtained above shows a similar degree of the high band sub-band power calculated from the actual high band signal and the pseudo high band sub-band power calculated using the decoded high band sub-band power estimation coefficient, which the coefficient index is id.

That is, the error of the estimation value is shown with respect to the true value of the high band sub-band power. Therefore, the smaller the square sum for the difference E(J, id), the more the decoded high band signal closed by the actual high band signal is obtained by the operation using the decoded high band sub-band power estimation coefficient. That is, the decoded high band sub-band power estimation coefficient in which the square sum for the difference E(J, id) is minimum is an estimation coefficient most suitable for the frequency band expansion process performed in decoding the output code string.

The pseudo high band sub-band power difference calculation circuit 36 selects the square sum for difference having a minimum value among the K square sums for difference E (J, id) and supplies the coefficient index showing the decoded high band sub-band power estimation coefficient corresponding to the square sum for difference to the high band encoding circuit 37.

In step S188, the high band encoding circuit 37 encodes the coefficient index supplied from the pseudo high band sub-band power difference calculation circuit 36 and supplies obtained high band encoded data to the multiplexing circuit 38.

For example, step S188, an entropy encoding and the like is performed with respect to the coefficient index. Therefore, information amount of the high band encoded data output to the decoder 40 can be compressed. In addition, if high band encoded data is information that an optimal decoded high band sub-band power estimation coefficient is obtained, any information is preferable; for example, the index may be the high band encoded data as it is.

In step S189, the multiplexing circuit 38 multiplexes the low band encoded data supplied from the low band encoding circuit 32 and the high band encoded data supplied from the high band encoding circuit 37 and outputs the output code string and the encoding process is completed.

As described above, the decoded high band sub-band power estimation coefficient mostly suitable to process can be obtained by outputting the high band encoded data obtained by encoding the coefficient index as the output code string in decoder 40 receiving an input of the output code string, together with the low frequency encoded data. Therefore, it is possible to obtain signal having higher quality.

[Functional Configuration Example of Decoder]

Figure 20:
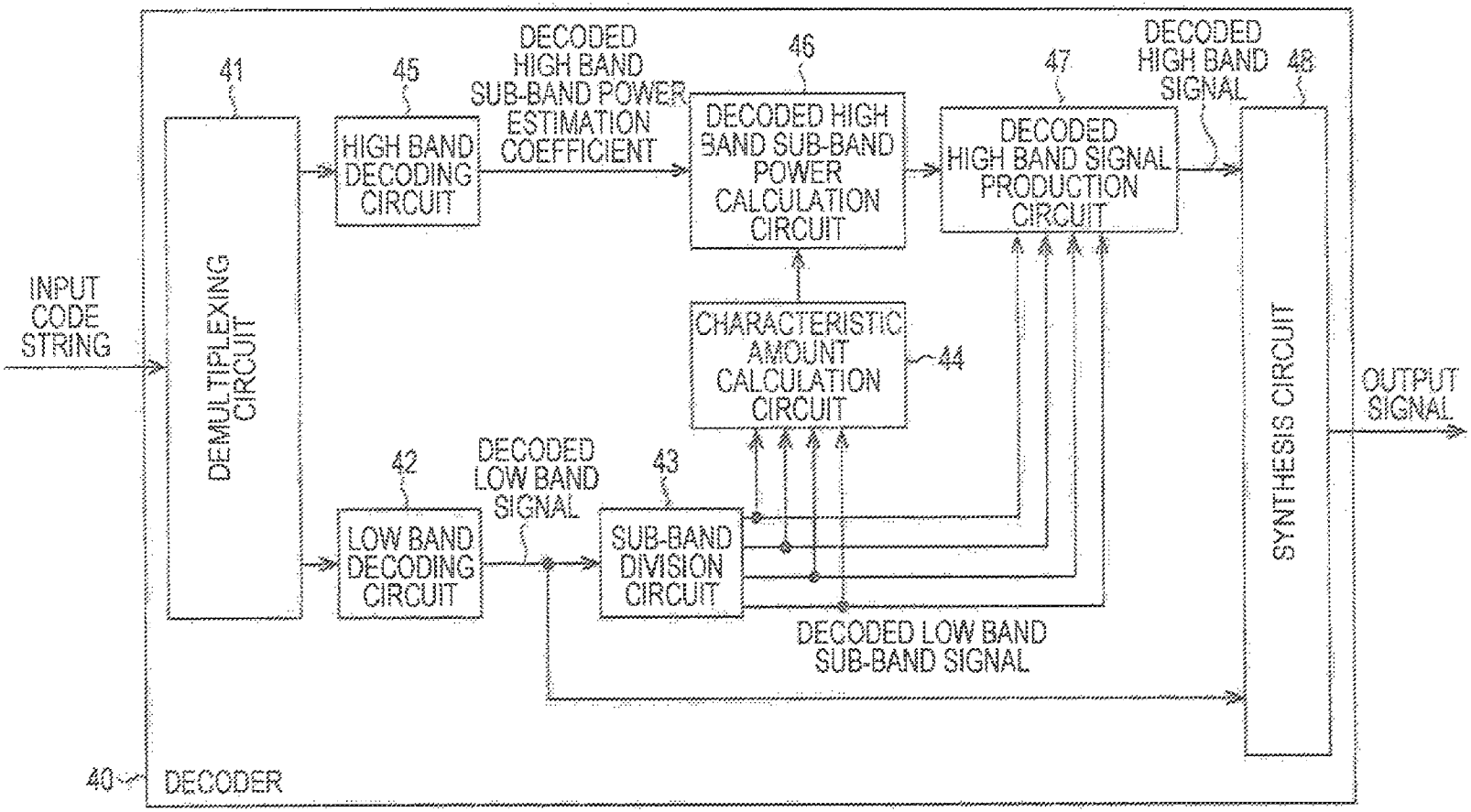
FIG. 20 is a block diagram illustrating a functional configuration example of a decoder.

In addition, the output code string output from the encoder 30 in FIG. 18 is input as the input code string and for example, the decoder 40 for decoding is configuration illustrated in FIG. 20. In addition, in FIG. 20, the parts corresponding to the case FIG. 13 use the same symbol and the description is omitted.

The decoder 40 in FIG. 20 is identical with the decoder 40 in FIG. 13 in that the demultiplexing circuit 41 to the synthesis circuit 48 is configured, but is different from the decoder 40 in FIG. 13 in that the decoded low band signal from the low band decoding circuit 42 is supplied to the characteristic amount calculation circuit 44.

In the decoder 40 in FIG. 20, the high band decoding circuit 45 records the decoded high band sub-band power estimation coefficient identical with the decoded high band sub-band power estimation coefficient in which the pseudo high band sub-band power calculation circuit 35 in FIG. 18 is recorded in advance. That is, the set of the coefficient $A_{ib}$(kb) and coefficient $B_{ib}$ as the decoded high band sub-band power estimation coefficient by the regression analysis is recorded to correspond to the coefficient index.

The high band decoding circuit 45 decodes the high band encoded data supplied from the demultiplexing circuit 41 and supplies the decoded high band sub-band power estimation coefficient indicated by the coefficient index obtained from the result to the decoded high band sub-band power calculation circuit 46.

[Decoding Process of Decoder]

Figure 21:
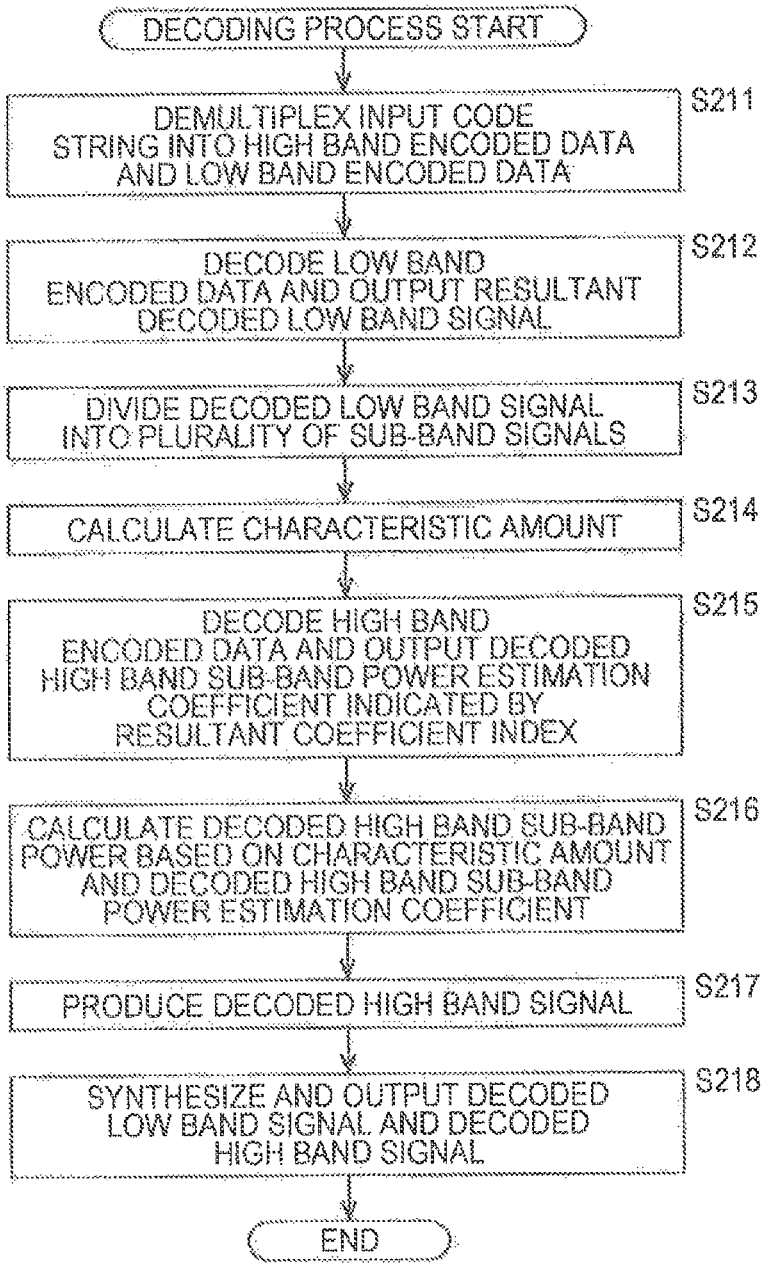
FIG. 21 is a flowchart describing a decoding process.

Next, the decoding process performs by decoder 40 in FIG. 20 will be described with reference to a flowchart in FIG. 21.

The decoding process starts if the output code string output from the encoder 30 is provided as the input code string to the decoder 40. In addition, since the processes of step S211 to step S213 is identical with those of step S131 to step S133 in FIG. 14, the description is omitted.

In step S214, the characteristic amount calculation circuit 44 calculates the characteristic amount by using the decoded low band sub-band signal from the sub-band division circuit 43 and supplies it decoded high band sub-band power calculation circuit 46. In detail, the characteristic amount calculation circuit 44 calculates the characteristic amount of the low band sub-band power power(ib,J) of the frames J (but, 0≤J) by performing operation of the Equation (1) described above with respect to the each sub-band ib of the low band side.

In step S215, the high band decoding circuit 45 performs decoding of the high band encoded data supplied from the demultiplexing circuit 41 and supplies the decoded high band sub-band power estimation coefficient indicated by the coefficient index obtained from the result to the decoded high band sub-band power calculation circuit 46. That is, the decoded high band sub-band power estimation coefficient is output, which is indicated by the coefficient index obtained by the decoding in a plurality of decoded high band sub-band power estimation coefficient recorded to the high band decoding circuit 45 in advance.

In step S216, the decoded high band sub-band power calculation circuit 46 calculates the decoded high band sub-band power based on the characteristic amount supplied from the characteristic amount calculation circuit 44 and the decoded high band sub-band power estimation coefficient supplied from the high band decoding circuit 45 and supplies it to the decoded high band signal production circuit 47.

That, the decoded high band sub-band power calculation circuit 46 performs operation the Equation (2) described above using the coefficient $A_{ib}$(kb) as the decoded high band sub-band power estimation coefficient and the low band sub-band power power(kb,J) and the coefficient $B_{ib}$ (where, sb−3≤kb≤sb) as characteristic amount and calculates the decoded high band sub-band power. Therefore, the decoded high band sub-band power is obtained with respect to each sub-band of the high band side, which the index is sb+1 to eb.

In step S217, the decoded high band signal production circuit 47 produces the decoded high band signal based on the decoded low band sub-band signal supplied from the sub-band division circuit 43 and the decoded high band sub-band power supplied from the decoded high band sub-band power calculation circuit 46.

In detail, the decoded high band signal production circuit 47 performs operation of the above-mentioned Equation (1) using the decoded low band sub-band signal and calculates the low band sub-band power with respect to each sub-band of the low band side. In addition, the decoded high band signal production circuit 47 calculates the gain amount G(ib, J) for each sub-band of the high band side by performing operation of the Equation (3) described above using the low band sub-band power and the decoded high band sub-band power obtained.

Further, the decoded high band signal production circuit 47 produces the high band sub-band signal x3(ib, n) by performing the operation of the Equations (5) and (6) described above using the gain amount G(ib, J) and the decoded low band sub-band signal with respect to each sub-band of the high band side.

That is, the decoded high band signal production circuit 47 performs an amplitude modulation of the decoded high band sub-band signal x(ib, n) in response to the ratio of the low band sub-band power to the decoded high band sub-band power and thus performs frequency-modulation the decoded low band sub-band signal (x2(ib, n) obtained.

Therefore, the signal of the frequency component of the sub-band of the low band side is converted to signal of the frequency component of the sub-band of the high band side and the high band sub-band signal x3(ib, n) is obtained.

As described above, the processes for obtaining the high band sub-band signal of each sub-band is a process described blow in more detail.

The four sub-bands being a line in the frequency area is referred to as the band block and the frequency band is divided so that one band block (hereinafter, referred to as a low band block) is configured from four sub-bands in which the index existed in the low side is sb to sb−3. In this case, for example, the band including the sub-band in which the index of the high band side includes sb+1 to sb+4 is one band block. In addition, the high band side, that is, a band block including sub-band in which the index is sb+1 or more is particularly referred to as the high band block.

In addition, attention is paid to one sub-band constituting the high band block and the high band sub-band signal of the sub-band (hereinafter, referred to as attention sub-band) is produced. First, the decoded high band signal production circuit 47 specifies the sub-band of the low band block that has the same position relation to the position of the attention sub-band in the high band block.

For example, if the index of the attention sub-band is sb+1, the sub-band of the low band block having the same position relation with the attention sub-band is set as the sub-band that the index is sb−3 since the attention sub-band is a band that the frequency is the lowest in the high band blocks.

As described above, the sub-band, if the sub-band of the low band block sub-band having the same position relationship of the attention sub-band is specific, the low band sub-band power and the decoded low band sub-band signal and the decoded high band sub-band power is used and the high band sub-band signal of the attention sub-band is produced.

That is, the decoded high band sub-band power and the low band sub-band power are substituted for Equation (3), so that the gain amount according to the rate of the power thereof is calculated. In addition, the calculated gain amount is multiplied by the decoded low band sub-band signal, the decoded low band sub-band signal multiplied by the gain amount is set as the frequency modulation by the operation of the Equation (6) to be set as the high band sub-band signal of the attention sub-band.

In the processes, the high band sub-band signal of the each sub-band of the high band side is obtained. In addition, the decoded high band signal production circuit 47 performs the Equation (7) described above to obtain sum of the each high band sub-band signal and to produce the decoded high band signal. The decoded high band signal production circuit 47 supplies the obtained decoded high band signal to the synthesis circuit 48 and the process precedes from step S217 to the step S218 and then the decoding process is terminated.

In step S218, the synthesis circuit 48 synthesizes the decoded low band signal from the low band decoding circuit 42 and the decoded high band signal from the decoded high band signal production circuit 47 and outputs as the output signal.

As described above, since decoder 40 obtained the coefficient index from the high band encoded data obtained from the demultiplexing of the input code string and calculates the decoded high band sub-band power by the decoded high band sub-band power estimation coefficient indicated by using the decoded high band sub-band power estimation coefficient indicated by the coefficient index, it is possible to improve the estimation accuracy of the high band sub-band power. Therefore, it is possible to produce the music signal having high quality.

4. Fourth Embodiment

Encoding Processes of Encoder

First, in as described above, the case that only the coefficient index is included in the high band encoded data is described. However, the other information may be included.

For example, if the coefficient index is included in the high band encoded data, the decoding high band sub-band power estimation coefficient that the decoded high band sub-band power closest to the high band sub-band power of the actual high band signal is notified of the decoder 40 side.

Therefore, the actual high band sub-band power (true value) and the decoded high band sub-band power (estimation value) obtained from the decoder 40 produces difference substantially equal to the pseudo high band sub-band power difference $power_{diff}(ib,J)$ calculated from the pseudo high band sub-band power difference calculation circuit 36.

Herein, if the coefficient index and the pseudo high band sub-band power difference of the sub-band is included in the high band encoded data, the error of the decoded high band sub-band power regarding the actual high band sub-band power is approximately known in the decoder 40 side. If so, it is possible to improve the estimation accuracy of the high band sub-band power using the difference.

Figure 22:
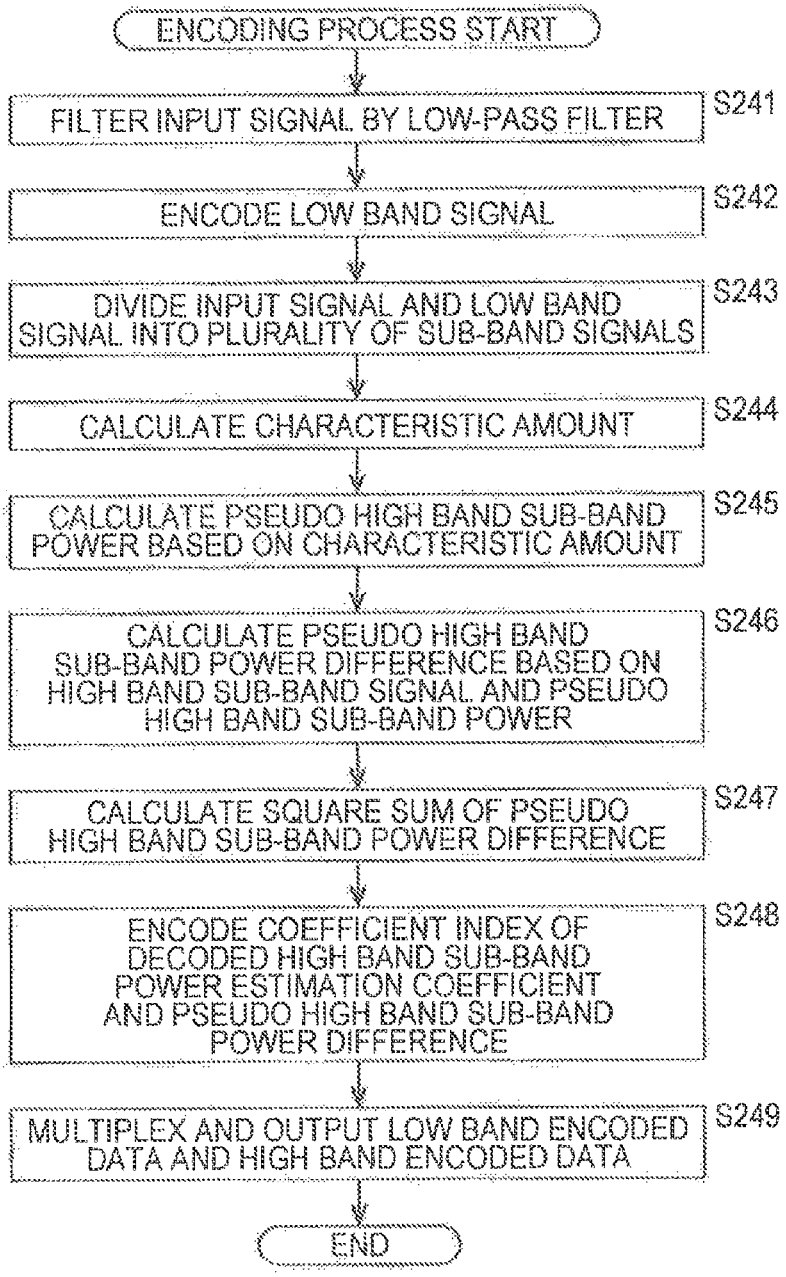
FIG. 22 is a flowchart describing an encoding process.
Figure 23:
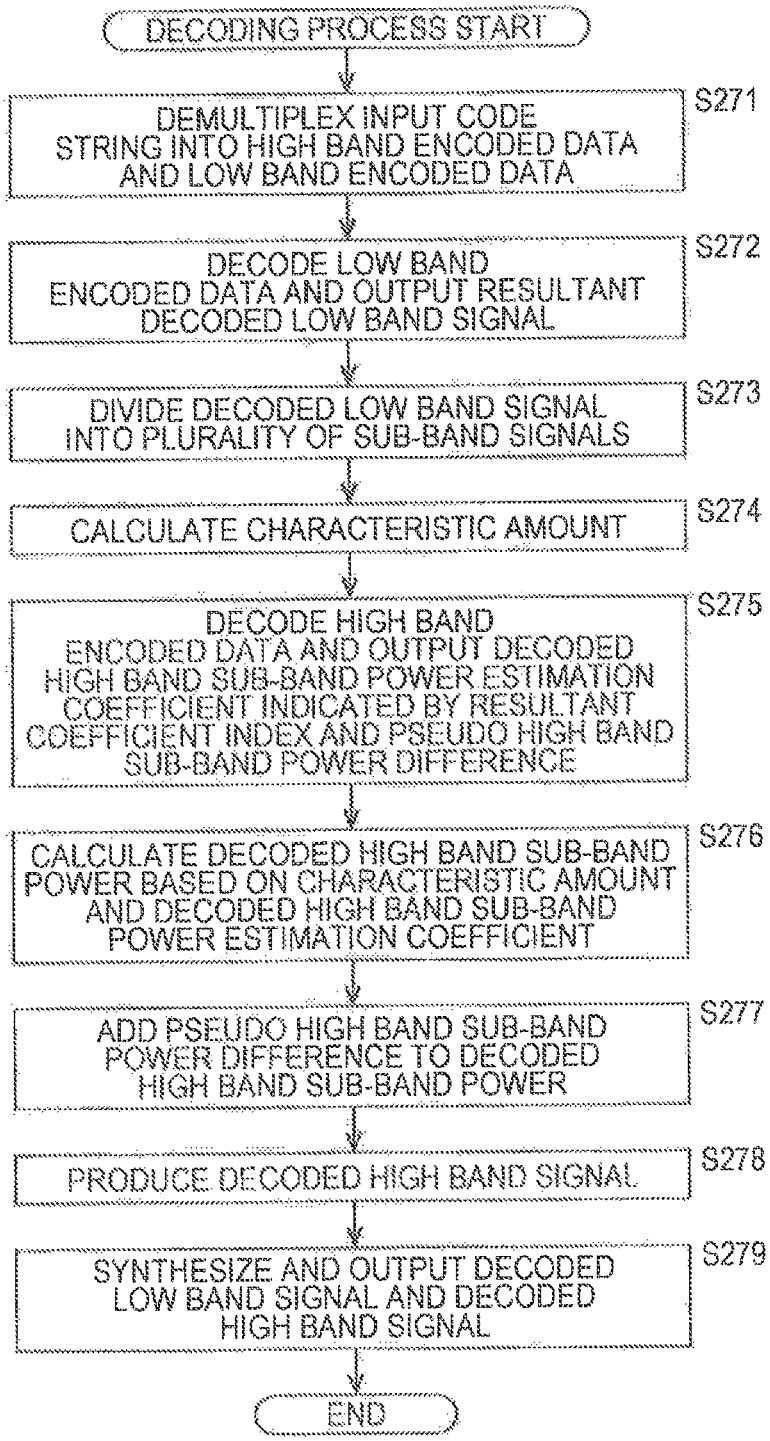
FIG. 23 is a flowchart describing a decoding process.

The encoding process and the decoding process in a case where the pseudo high band sub-band power difference is included in the high band encoded data will be described with reference with a flow chart of FIGS. 22 and 23.

First, the encoding process performed by encoder 30 in FIG. 18 will be described with reference to the flowchart in FIG. 22. In addition, the processes of step S241 to step S246 is identical with those of step S181 to step S186 in FIG. 19. Therefore, the description thereof is omitted.

In step S247, the pseudo high band sub-band power difference calculation circuit 36 performs operation of the Equation (15) described above to calculate sum E (J, id) of squares for difference for each decoded high band sub-band power estimation coefficient.

In addition, the pseudo high band sub-band power difference calculation circuit 36 selects sum of squares for difference where the sum of squares for difference is set as a minimum in the sum of squares for difference among sum E(J, id) of squares for difference and supplies the coefficient index indicating the decoded high band sub-band power estimation coefficient corresponding to the sum of square for difference to the high band encoding circuit 37.

In addition, the pseudo high band sub-band power difference calculation circuit 36 supplies the pseudo high band sub-band power difference $power_{diff}(ib,J)$ of the each sub-band obtained with respect to the decoded high band sub-band power estimation coefficient corresponding to selected sum of squares of residual error to the high band encoding circuit 37.

In step S248, the high band encoding circuit 37 encodes the coefficient index and the pseudo high band sub-band power difference supplied from the pseudo high band sub-band power difference calculation circuit 36 and supplies the high band encoded data obtained from the result to the multiplexing circuit 38.

Therefore, the pseudo high band sub-band power difference of the each sub-band power of the high band side where the index is sb+1 to eb, that is, the estimation difference of the high band sub-band power is supplied as the high band encoded data to the decoder 40.

If the high band encoded data is obtained, after this, encoding process of step S249 is performed to terminate encoding process. However, the process of step S249 is identical with the process of step S189 in FIG. 19. Therefore, the description is omitted.

As described above, if the pseudo high band sub-band power difference is included in the high band encoded data, it is possible to improve estimation accuracy of the high band sub-band power and to obtain music signal having good quality in the decoder 40.

[Decoding Processing of Decoder]

Next, a decoding process performed by the decoder 40 in FIG. 20 will be described with reference to a flowchart in FIG. 23. In addition, the process of step S271 to step S274 is identical with those of step S211 to step S214 in FIG. 21. Therefore, the description thereof is omitted.

In step S275, the high band decoding circuit 45 performs the decoding of the high band encoded data supplied from the demultiplexing circuit 41. In addition, the high band decoding circuit 45 supplies the decoded high band sub-band power estimation coefficient indicated by the coefficient index obtained by the decoding and the pseudo high band sub-band power difference of each sub-band obtained by the decoding to the decoded high band sub-band power calculation circuit 46.

In a step S716, the decoded high band sub-band power calculation circuit 46 calculates the decoded high band sub-band power based on the characteristic amount supplied from the characteristic amount calculation circuit 44 and the decoded high band sub-band power estimation coefficient 216 supplied from the high band decoding circuit 45. In addition, step S276 has the same process as step S216 in FIG. 21.

In step S277, the decoded high band sub-band power calculation circuit 46 adds the pseudo high band sub-band power difference supplied from the high band decoding circuit 45 to the decoded high band sub-band power and supplies the added result as an ultimate decoded high band sub-band power to decoded high band signal production circuit 47.

That is, the pseudo high band sub-band power difference of the same sub-band is added to the decoding high band sub-band power of the each calculated sub-band.

In addition, after that, processes of step S278 and step S279 is performed and the decoding process is terminated. However, their processes are identical with step S217 and step S218 in FIG. 21. Therefore, the description will be omitted.

By doing the above, the decoder 40 obtains the coefficient index and the pseudo high band sub-band power from the high band encoded data obtained by the demultiplexing of the input code string. In addition, decoder 40 calculates the decode high band sub-band power using the decoded high band sub-band power estimation coefficient indicated by the coefficient index and the pseudo high band sub-band power difference. Therefore, it is possible to improve accuracy of the high band sub-band power and to reproduce music signal having high sound quality.

In addition, the difference of the estimation value of the high band sub-band power producing between encoder 30 and decoder 40, that is, the difference (hereinafter, referred to as an difference estimation between device) between the pseudo high band sub-band power and decoded high band sub-band power may be considered.

In this case, for example, the pseudo high band sub-band power difference serving as the high band encoded data is corrected by the difference estimation between devices and the estimation difference between devices is included in the high band encoded data, the pseudo high band sub-band power difference is corrected by the estimation difference between apparatus in decoder 40 side. In addition, the estimation difference between apparatus may be recorded in decoder 40 side in advance and the decoder 40 may make correction by adding the estimation difference between devices to the pseudo high band sub-band power difference. Therefore, it is possible to obtain the decoded high band signal closed to the actual high band signal.

5. Fifth Embodiment

In addition, in the encoder 30 in FIG. 18, it is described that the pseudo high band sub-band power difference calculation circuit 36 selects the optimal index from a plurality of coefficient indices using the square sum E(J,id) of for a difference. However, the circuit may select the coefficient index using the index different from the square sum for a difference.

For example, as an index selecting a coefficient index, mean square value, maximum value and an average value of a residual error of the high band sub-band power and the pseudo high band sub-band power may be used. In this case, the encoder 30 in FIG. 18 performs encoding process illustrated in a flowchart in FIG. 24.

Figure 24:
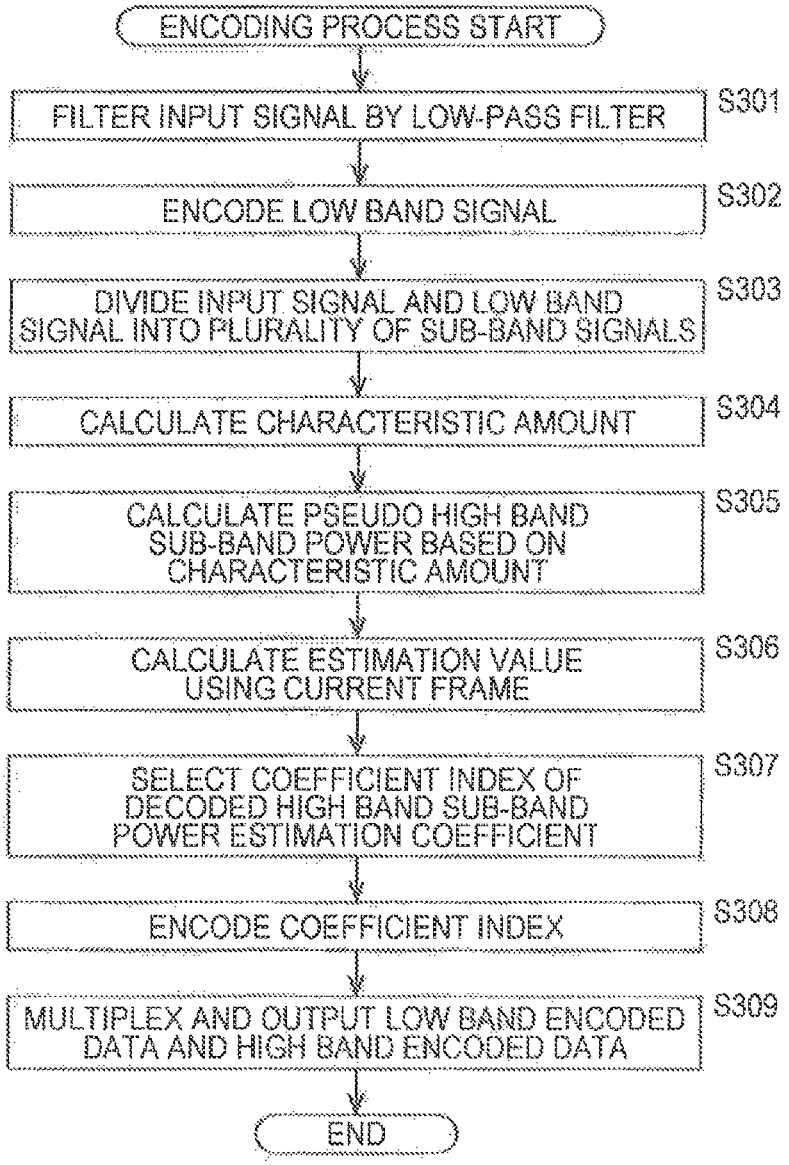
FIG. 24 is a flowchart describing an encoding process.

An encoding process using the encoder 30 will described with reference to a flowchart in FIG. 24. In addition, processes of step S301 to step S305 are identical with those of step S181 to step S185 in FIG. 19. Therefore, the description will be omitted. If the processes of step S301 to step S305 are performed, the pseudo high band sub-band power of each sub-band is calculated for each K number of decoded high band sub-band power estimation coefficient.

In step S306, the pseudo high band sub-band power difference calculation circuit 36 calculates an estimation value Res(id,J) using a current frame J to be processed for each K number of decoded high band sub-band power estimation coefficient.

In detail, the pseudo high band sub-band power difference calculation circuit 36 calculates the high band sub-band power power(ib,J) in frames J by performing the same operation as the Equation (1) described above using the high band sub-band signal of each sub-band supplied from the sub-band division circuit 33. In addition, in an embodiment of the present invention, it is possible to discriminate all of the sub-band of the low band sub-band signal and the high band sub-band using index ib.

If the high band sub-band power power(ib,J) is obtained, the pseudo high band sub-band power difference calculation circuit 36 calculates the following Equation (16) and calculates the residual square mean square value $Res_{std}$(id,J).

[Equation 16]

$$Res_{std}(id, J) = \sum_{ib=sb+1}^{eb} [\text{power}(ib, J) - \text{power}_{est}(ib, id, J)]^2 \tag{16}$$

That is, the difference between the high band sub-band power power(ib,J) and the pseudo high band sub-band power $\text{power}_{est}$(ib,id,J) is obtained with respect to each sub-band on the high band side where the index sb+1 to eb and square sum for the difference becomes the residual square mean value $Res_{std}$ (id, J). In addition, the pseudo high band sub-band power $power_{rest}$(ibh,id,J) indicates the pseudo high band sub-band power of the frames J of the sub-band where the index is ib, which is obtained with respect to the decoded high band sub-band power estimation coefficient where index is ib.

Continuously, the pseudo high band sub-band power difference calculation circuit 36 calculates the following Equation (17) and calculates the residual maximum value $Res_{max}$(id,J).

[Equation 17]

$$Res_{max}(id,J)=\max_{ib}[|power(ib,J)-power_{est}(ib,id,J)|] \quad (17)$$

In addition, in an Equation (17), $\max_{ib}$(|power(ib,J)−$power_{est}$(ib,id,J)|) indicates a maximum value among absolute value of the difference between the high band sub-band power power(ib,J) of each sub-band where the index is sb+1 to eb and the pseudo high band sub-band power $power_{est}$ (ib,id,J). Therefore, a maximum value of the absolute value of the difference between the high band sub-band power power(ib,J) in the frames J and the pseudo high band sub-band power $power_{est}$(ib,id,J) is set as the residual difference maximum value $Res_{max}$(id,J).

In addition, the pseudo high band sub-band power difference calculation circuit 36 calculates the following Equation (18) and calculates the residual average value $Res_{ave}$(id,J).

[Equation 18]

$$Res_{ave}(id,J)=\left|\sum_{ib=sb+1}^{eb}\{power(ib,J)-power_{est}(ib,id,J)\}/(eb-sb)\right| \quad (18)$$

That is, for each sub-band on the high band side in which the index is sb+1 to eb, the difference between the high band sub-band power power(ib,J) of the frames J and the pseudo high band sub-band power $power_{est}$(ib,id,J) is obtained and the sum of the difference is obtained. In addition, the absolute value of a value obtained by dividing the sum of the obtained difference by the number of the sub-bands (eb−sb) of the high band side is set as the residual average value $Res_{ave}$(id,J). The residual average value $Res_{ave}$(id,J) indicates a size of the average value of the estimation error of each sub-band that a symbol is considered.

In addition, if the residual square mean $Res_{std}$(id,J), the residual difference maximum value $Res_{max}$(id,J), and the residual average value $Res_{ave}$(id,J) are obtained, the pseudo high band sub-band power difference calculation circuit 36 calculates the following Equation (19) and calculates an ultimate estimation value Res(id,J).

[Equation 19]

$$Res(id,J)=Res_{std}(id,J)+W_{max}\times Res_{max}(id,J)+W_{ave}\times Res_{ave}(id,J) \quad (19)$$

That is, the residual square average value $Res_{std}$(id,J), the residual maximum value $Res_{max}$(id,J) and the residual average value $Res_{ave}$(id,J) are added with weight and set as an ultimate estimation value Res(id,J). In addition, in the Equation (19), $W_{max}$ and $W_{ave}$ is a predetermined weight and for example, $W_{max}$=0.5, $W_{ave}$=0.5.

The pseudo high band sub-band power difference calculation circuit 36 performs the above process and calculates the estimation value Res(id,J) for each of the K numbers of the decoded high band sub-band power estimation coefficient, that is, the K number of the coefficient index id.

In step S307, the pseudo high band sub-band power difference calculation circuit 36 selects the coefficient index id based on the estimation value Res for each of the obtained (id,J) coefficient index id.

The estimation value Res(id,J) obtained from the process described above shows a similarity degree between the high band sub-band power calculated from the actual high band signal and the pseudo high band sub-band power calculated using the decoded high band sub-band power estimation coefficient which is the coefficient index id. That is, a size of the estimation error of the high band component is indicated.

Accordingly, as the evaluation Res(id,J) become low, the decoded high band signal closer to the actual high band signal is obtained by an operation using the decoded high band sub-band power estimation coefficient. Therefore, the pseudo high band sub-band power difference calculation circuit 36 selects the estimation value which is set as a minimum value among the K numbers of the estimation value Res(id,J) and supplies the coefficient index indicating the decoded high band sub-band power estimation coefficient corresponding to the estimation value to the high band encoding circuit 37.

If the coefficient index is output to the high band encoding circuit 37, after that, the processes of step S308 and step S309 are performed, the encoding process is terminated. However, since the processes are identical with step S188 in FIG. 19 and step S189, the description thereof will be omitted.

As described above, in the encoder 30, the estimation value $Res_{std}$(id,J), calculated by using the residual square average value $Res_{std}$(id,J), the residual maximum value $Res_{max}$(id,J) and the residual average value $Res_{ave}$(id,J) is used, and the coefficient index of the an optimal decoded high band sub-band power estimation coefficient is selected.

If the estimation value Res(id,J) is used, since an estimation accuracy of the high band sub-band power is able to be evaluated using the more estimation standard compared with the case using the square sums for difference, it is possible to select more suitable decoded high band sub-band power estimation coefficient. Therefore, when using, the decoder 40 receiving the input of the output code string, it is possible to obtain the decoded high band sub-band power estimation coefficient, which is mostly suitable to the frequency band expansion process and signal having higher sound quality.

Modification Example 1

In addition, if the encoding process described above is performed for each frame of the input signal, There may be a case where the coefficient index different in each consecutive frame is selected in a stationary region that the time variation of the high band sub-band power of each sub-band of the high band side of the input signal is small.

That is, since the high band sub-band power of each frame has almost identical values in consecutive frames constituting the standard region of the input signal, the same coefficient index should be continuously selected in their frame. However, the coefficient index selected for each frame in a section of the consecutive frames is changed and thus the high band component of the voice reproduced in the decoder 40 side may be no long stationary. If so, incongruity in auditory occurs in the reproduced sound.

Accordingly, if the coefficient index is selected in the encoder 30, the estimation result of the high band component in the previous frame in time may be considered. In this case, encoder 30 in FIG. 18 performs the encoding process illustrated in the flowchart in FIG. 25.

Figure 25:
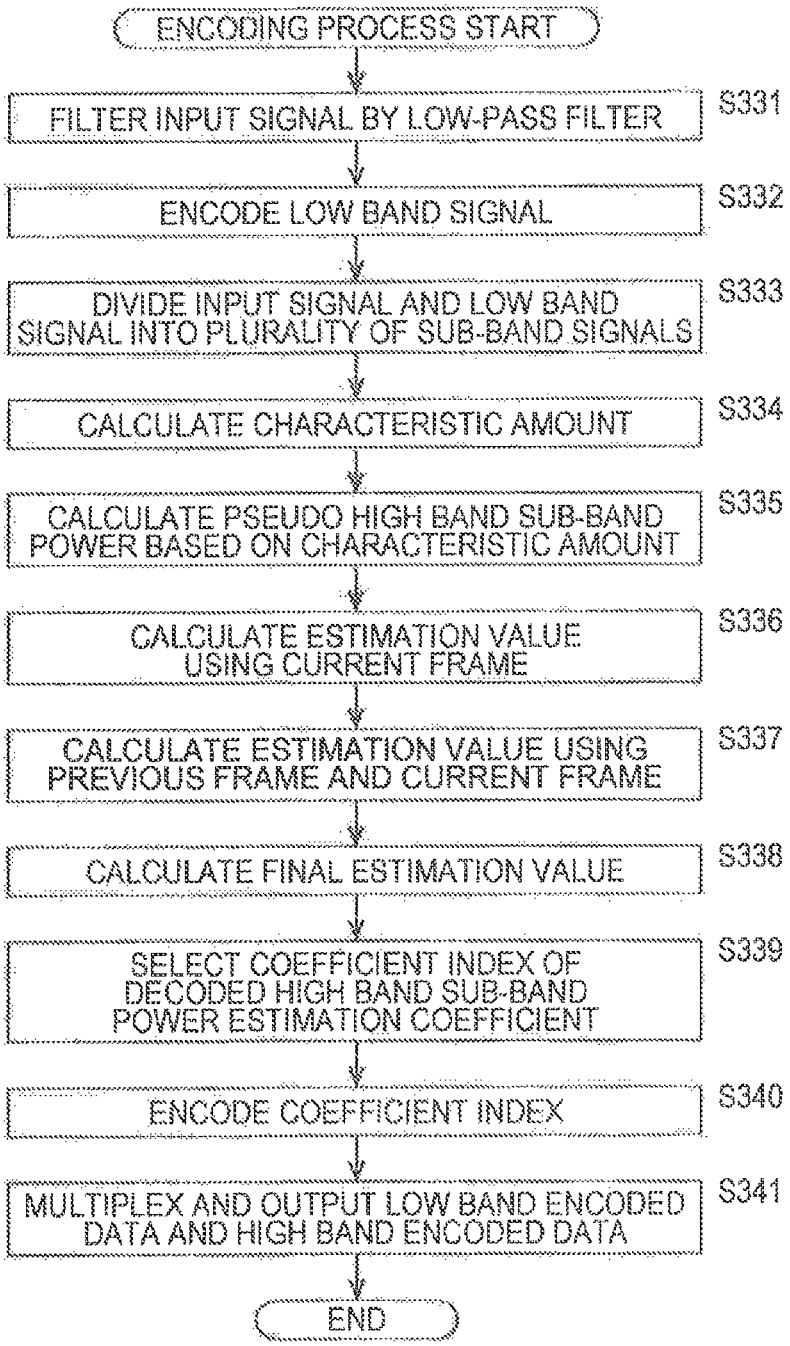
FIG. 25 is a flowchart describing an encoding process.

As described below, an encoding process by the encoder 30 will be described with reference to the flowchart in FIG. 25. In addition, the processes of step S331 to step S336 are identical with those of step S301 to step S306 in FIG. 24. Therefore, the description thereof will be omitted.

The pseudo high band sub-band power difference calculation circuit 36 calculates the estimation value ResP(id,J) using a past frame and a current frame in step S337.

Specifically, the pseudo high band sub-band power difference calculation circuit 36 records the pseudo high band sub-band power of each sub-band obtained by the decoded high band sub-band power estimation coefficient of the coefficient index selected finally with respect to frames J−1 earlier than frame J to be processed by one in time. Herein, the finally selected coefficient index is referred to as a coefficient index output to the decoder 40 by encoding using the high band encoding circuit 37.

As described below, in particular, the coefficient index id selected in frame (J−1) is set to as $id_{selected}(J-1)$. In addition, the pseudo high band sub-band power of the sub-band that the index obtained by using the decoded high band sub-band power estimation coefficient of the coefficient index $id_{selected}(J-1)$ is ib (where, sb+1≤ib≤eb) is continuously explained as $power_{est}(ib,id_{selected}(J-1),J-1)$.

The pseudo high band sub-band power difference calculation circuit 36 calculates firstly following Equation (20) and then the estimation residual square mean value $ResP_{std}$(id,J).

[Equation 20]

$$ResP_{std}(id, J) = \sum_{ib=sb+1}^{eb} \{power_{est}(ib, id_{selected}(J-1), J-1) - power_{est}(ib, id, J)\}^2 \quad (20)$$

That is, the difference between the pseudo high band sub-band power $power_{est}(ib,id_{selected}(J-1),J-1)$ of the frame J−1 and the pseudo high band sub-band power−$power_{est}$(ib, id,J) of the frame J is obtained with respect to each sub-band of the high band side where the index is sb+1 to eb. In addition, the square sum for difference thereof is set as estimation error difference square average value $ResP_{std}$(id, J). In addition, the pseudo high band sub-band power−($power_{est}$(ib,id,J) shows the pseudo high band sub-band power of the frames (J) of the sub-band which the index is ib which is obtained with respect to the decoded high band sub-band power estimation coefficient where the coefficient index is id.

Since this estimation residual square value $ResP_{std}$ (id,J) is the of square sum for the difference of pseudo high band sub-band power between frames that is continuous in time, the smaller the estimation residual square mean $ResF_{std}$(id,J) is, the smaller the time variation of the estimation value of the high band component is.

Continuously, the pseudo high band sub-band power difference calculation circuit 36 calculates the following Equation (21) and calculates the estimation residual maximum value $ResP_{max}$(id,J).

[Equation 21]

$$ResP_{max}(id, J) = \max_{ib} \{|power_{est}(ib, id_{selected}(J-1), J-1) - power_{est}(ib, id, J)|\} \quad (21)$$

In addition, in the Equation (21), $\max_{ib}(|power_{est}(ib, id_{selected}(J-1),J-1)-power_{est}(ib,id,J)|)$ indicates the maximum absolute value of the difference between the pseudo high band sub-band power $power_{est}(ib,id_{selected}(J-1),J-1)$ of each sub-band in which the index is sb+1 to eb and the pseudo high band sub-band power $power_{est}$(ib,id,J). Therefore, the maximum value of the absolute value of the difference between frames which is continuous in time is set as the estimation residual error difference maximum value $ResP_{max}$((id,J).

The smaller the estimation residual error maximum value $ResP_{max}$(id,J) is, the closer estimation result of the high band component between the consecutive frames is closed.

If the estimation residual maximum value $ResP_{max}$(id,J) is obtained, next, the pseudo high band sub-band power difference calculation circuit 36 calculates the following Equation (22) and calculates the estimation residual average value $ResP_{ave}$ (id,J.

[Equation 22]

$$ResP_{ave}(id, J) = \left| \left( \sum_{ib=sb+1}^{eb} \{power_{est}(ib, id_{selected}(J-1), J-1) - power_{est}(ib, id, J)\} \right) \Big/ (eb - sb) \right| \quad (22)$$

That is, the difference between the pseudo high band sub-band power $power_{est}(ib,id_{selected}(J-1),J-1)$ of the frame (J−1) and the pseudo high band sub-band power $power_{est}$ (ib,id,J) of the frame J is obtained with respect to each sub-band of the high band side when the index is sb+1 to eb. In addition, the absolute value of the value obtained by dividing the sum of the difference of each sub-band by the number of the sub-bands (eb−sb) of the high band side is set as the estimation residual average $ResP_{ave}$(id,J). The estimation residual error average value $ResP_{ave}$(id,J) shows the size of the average value of the difference of the estimation value of the sub-band between the frames where the symbol is considered.

In addition, if the estimation residual square mean value $ResP_{std}$(id,J), the estimation residual error maximum value $ResP_{max}$(id,J) and the estimation residual average value $ResP_{ave}$(id,J) are obtained, the pseudo high band sub-band power difference calculation circuit 36 calculates the following Equation (23) and calculates the average value ResP(id,J).

[Equation 23]

$$ResP(id, J) = ResP_{std}(id, J) + W_{max} \times ResP_{max}(id, J) + W_{ave} \times ResP_{ave}(id, J) \quad (23)$$

That is, the estimation residual square value $ResP_{std}$(id,J), the estimation residual error maximum value $ResP_{max}$(id,J) and the estimation residual average value $ResP_{ave}$(id,J) are added with weight and set as the estimation value ResP(id, J). In addition, in Equation (23), $W_{max}$ and $W_{ave}$ are a predetermined weight, for example, $W_{max}$=0.5, $W_{ave}$=0.5.

Therefore, if the evaluation value ResP(id,J) using the past frame and the current value is calculated, the process proceeds from the step S337 to S338.

In step S338, the pseudo high band sub-band power difference calculation circuit 36 calculates the Equation (24) and calculates the ultimate estimation value $Res_{all}$(id,J).

[Equation 24]

$$Res_{all}(id,J)=Res(id,J)+W_p(J)\times ResP(id,J) \quad (24)$$

That is, the obtained estimation value Res(id,J) and the estimation value ResP(id,J) are added with weight. In addition, in the Equation (24), $W_p$(J), for example, is a weight defined by the following Equation (25).

[Equation 25]

$$W_p(J)=\begin{cases}\frac{-power_r(J)}{50}+1 & (0\le power_r(J)\le 50)\\ 0 & (otherwise)\end{cases} \quad (25)$$

In addition, $power_r$(J) in the Equation (25) is a value defined by the following Equation (26).

[Equation 26]

$$power_r(J)=\sqrt{\left(\sum_{ib=sb+1}^{eb}\{power(ib,J)-power(ib,J-1)\}^2\right)\Big/(eb-sb)} \quad (26)$$

This power(J) shows the average of the difference between the high band sub-band powers of frames (J−1) and frames J. In addition, according to the Equation (25), when $power_r$(J) is a value of the predetermined range in the vicinity of 0, the smaller the $power_r$(J), $W_p$(J) is closer to 1 and when $power_r$(J) is larger than a predetermined range value, it is set as 0.

Herein, when $power_r$(J) is a value of a predetermined range in the vicinity of 0, the average of the difference of the high band sub-band power between the consecutive frames becomes small to a degree. That is, the time variation of the high band component of the input signal is small and the current frames of the input signal become steady region.

As the high band component of the input signal is steady, the weight $W_p$(J) becomes a value is close to 1, whereas as the high band component is not steady, the weight ($W_p$(J) becomes a value close to 0. Therefore, in the estimation value $Res_{all}$(id,J) shown in Equation (24), as the time variety of the high band component of the input signal becomes small, the coefficient of determination of the estimation value ResP (id, J) considering the comparison result and the estimation result of the high band component as the evaluation standards in the previous frames become larger.

Therefore, in a steady region of the input signal, the decoded high band sub-band power estimation coefficient obtained in the vicinity of the estimation result of the high band component in previous frames is selected and in the decoder 40 side, it is possible to more naturally reproduce the sound having high quality. Whereas in a non-steady region of the input signal, a term of estimation value ResP(id,J) in the estimation value $Res_{all}$(id,J) is set as 0 and the decoded high band signal closed to the actual high band signal is obtained.

The pseudo high band sub-band power difference calculation circuit 36 calculates the estimation value $Res_{all}$(id,J) for each of the K number of the decoded high band sub-band power evaluation coefficient by performing the above-mentioned processes.

In step S339, the pseudo high band sub-band power difference calculation circuit 36 selects the coefficient index id based on the estimation value $Res_{all}$(id,J) for each obtained decoded high band sub-band power estimation coefficient.

The estimation value $Res_{all}$(id,J) obtained from the process described above linearly combines the estimation value Res(id,J) and the estimation value ResP(id,J) using weight. As described above, the smaller the estimation value Res (id,J), a decoded high band signal closer to an actual high band signal can be obtained. In addition, the smaller the estimation value ResP(id,J), a decoded high band signal closer to the decoded high band signal of the previous frame can be obtained.

Therefore, the smaller the estimation value $Res_{all}$(id,J), a more suitable decoded high band signal is obtained. Therefore, the pseudo high band sub-band power difference calculation circuit 36 selects the estimation value having a minimum value in the K number of the estimation $Res_{all}$ (id,J) and supplies the coefficient index indicating the decoded high band sub-band power estimation coefficient corresponding to this estimation value to the high band encoding circuit 37.

If the coefficient index is selected, after that, the processes of step S340 and step S341 are performed to complete the encoding process. However, since these processes are the same as the processes of step S308 and step S309 in FIG. 24, the description thereof will be omitted.

As described above, in the encoder 30, the estimation value $Res_{all}$(id,J) obtained by linearly combining the estimation value Res(id,J) and the estimation value ResP(id,J) is used, so that the coefficient index of the optimal decoded high band sub-band power estimation coefficient is selected.

If the estimation value $Res_{all}$(id,J) is used, as the case uses the estimation value Res(id,J), it is possible to select a more suitable decoded high band sub-band power estimation coefficient by more many estimation standards. However, if the estimation value $Res_{all}$(id,J) is used, it is possible to control the time variation in the steady region of the high band component of signal to be reproduced in the decoder 40 and it is possible to obtain a signal having high quality.

Modification Example 2

By the way, in the frequency band expansion process, if the sound having high quality is desired to be obtained, the sub-band of the lower band side is also important in term of the audibility. That is, among sub-bands on the high band side as the estimation accuracy of the sub-band close to the low band side become larger, it is possible to reproduce sound having high quality.

Herein, when the estimation value with respect to each decoded high band sub-band power estimation coefficient is calculated, a weight may be placed on the sub-band of the low band side. In this case, the encoder 30 in FIG. 18 performs the encoding process shown in the flowchart in FIG. 26.

Figure 26:
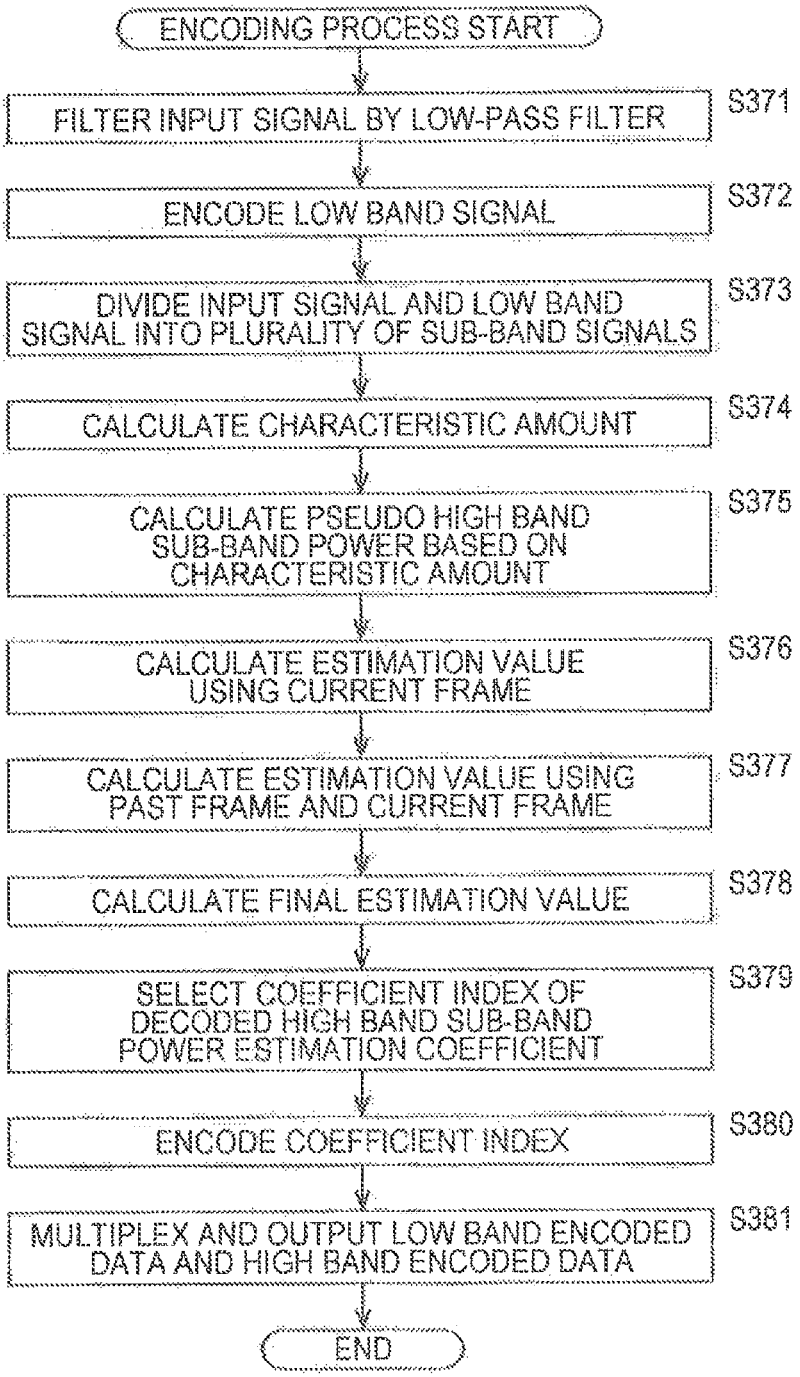
FIG. 26 is a flowchart describing an encoding process.

Hereinafter, the encoding process by the encoder 30 will be described with reference to the flowchart in FIG. 26. In addition, the processes of steps S371 to step S375 are identical with those of step S331 to step S335 in FIG. 25. Therefore, the description thereof will be omitted.

In step S376, the pseudo high band sub-band power difference calculation circuit 36 calculates estimation value $ResW_{band}(id,J)$ using the current frame J to be processed for each of the K number of decoded high band sub-band power estimation coefficient.

Specially, the pseudo high band sub-band power difference calculation circuit 36 calculates high band sub-band power power(ib,J) in the frames J performing the same operation as the above-mentioned Equation (1) using the high band sub-band signal of each sub-band supplied from the sub-band division circuit 33.

If the high band sub-band power power(ib,J) is obtained, the pseudo high band sub-band power difference calculation circuit 36 calculates the following Equation 27 and calculates the residual square average value $Res_{std}W_{band}(id,J)$.

[Equation 27]

$$Res_{std}W_{band}(ib, J) = \sum_{ib=sb+1}^{eb} \{W_{band}(ib) \times \{\text{power}(ib, J) - \text{power}_{est}(ib, id, J)\}\}^2 \quad (27)$$

That is, the difference between the high band sub-band power power(ib,J) of the frames (J) and the pseudo high band sub-band power ($power_{est}(ib,id,J)$ is obtained and the difference is multiplied by the weight $W_{band}(ib)$ for each sub-band, for each sub-band on the high band side where the index is sb+1 to eb. In addition, the sum of square for difference by which the weight $W_{band}(ib)$ is multiplied is set as the residual error square average value $Res_{std}W_{band}(id,J)$.

Herein, the weight $W_{band}(ib)$ (where, $sb+1 \leq ib \leq eb$ is defined by the following Equation 28. For example, the value of the weight $W_{band}(ib)$ becomes as large as the sub-band of the low band side.

[Equation 28]

$$W_{band}(ib) = \frac{-3 \times ib}{7} + 4 \quad (28)$$

Next, the pseudo high band sub-band power difference calculation circuit 36 calculates the residual maximum value $Res_{max}W_{band}(id,J)$. Specifically, the maximum value of the absolute value of the values multiplying the difference between the high band sub-band power power(ib,J) of each sub-band where the index is sb+1 to eb and the pseudo high band sub-band power $power_{est}(ib,id,J)$ by the weight $W_{band}(ib)$ is set as the residual error difference maximum value $Res_{max}W_{band}(id,J)$.

In addition, the pseudo high band sub-band power difference calculation circuit 36 calculates the residual error average value $Res_{ave}W_{band}(id,J)$.

Specially, in each sub-band where the index is sb+1 to eb, the difference between the high band sub-band power power (ib,J) and the pseudo high band sub-band power $power_{est}(ib,id,J)$ is obtained and thus weight $W_{band}(ib)$ is multiplied so that the sum total of the difference by which the weight $W_{band}(ib)$ is multiplied, is obtained. In addition, the absolute value of the value obtained by dividing the obtained sum total of the difference into the sub-band number (eb−sb) of the high band side is set as the residual error average value $Res_{ave}W_{band}(id,J)$.

In addition, the pseudo high band sub-band power difference calculation circuit 36 calculates the evaluation value $ResW_{band}(id,J)$. That is, the sum of the residual squares mean value $Res_{std}W_{band}(id,J)$, the residual error maximum value $Res_{max}W_{band}(id,J)$ that the weight ($W_{max}$) is multiplied, and the residual error average value $Res_{ave}W_{band}(id,J)$ by which the weight ($W_{ave}$) is multiplied, is set as the average value $ResW_{band}(id,J)$.

In step S377, the pseudo high band sub-band power difference calculation circuit 36 calculates the average value $ResPW_{band}(id,J)$ using the past frames and the current frames.

Specially, the pseudo high band sub-band power difference calculation circuit 36 records the pseudo high band sub-band power of each sub-band obtained by using the decoded high band sub-band power estimation coefficient of the coefficient index selected finally with respect to the frames J−1 before one frame earlier than the frame (J) to be processed in time.

The pseudo high band sub-band power difference calculation circuit 36 first calculates the estimation residual error average value $ResP_{std}W_{band}(id,J)$. That is, for each sub-band on the high band side in which the index is sb+1 to eb, the weight $W_{band}(ib)$ is multiplied by obtaining the difference between the pseudo high band sub-band power $power_{est}(ib, id_{selected}(J-1),J-1)$ and the pseudo high band sub-band power $power_{est}(ib,id,J)$. In addition, the squared sum of the difference from which the weigh $W_{band}(ib)$ is calculated, is set as the estimation error difference average value $ResP_{std}W_{band}(id,J)$.

The pseudo high band sub-band power difference calculation circuit 36 continuously calculates the estimation residual error maximum value $ResP_{max}W_{band}(id,J)$. Specially, the maximum value of the absolute value obtained by multiplying the difference between the pseudo high band sub-band power $power_{est}(ib,id_{selected}(J-1),J-1)$ of each sub-band in which the index is sb+1 to eb and the pseudo high band sub-band power−$power_{est}(ib,id,J)$ by the weight $W_{band}(ib)$ is set as the estimation residual error maximum value $ResP_{max}W_{band}(id,J)$.

Next, the pseudo high band sub-band power difference calculation circuit 36 calculates the estimation residual error average value $ResP_{ave}W_{band}(id,J)$. Specially, the difference between the pseudo high band sub-band $power_{est}(ib,id_{selected}(J-1),J-1)$ and the pseudo high band sub-band power $power_{set}(ib,id,J)$ is obtained for each sub-band where the index is sb+1 to eb and the weight $W_{band}(ib)$ is multiplied. In addition, the sum total of the difference by which the weight $W_{band}(ib)$ is multiplied is the absolute value of the values obtained by being divided into the number (eb−sb) of the sub-bands of the high band side. However, it is set as the estimation residual error average value $ResP_{ave}W_{band}$ id,J).

Further, the pseudo high band sub-band power difference calculation circuit 36 obtains the sum of the estimation residual error square average value $R_{es}P_{std}W_{band}(id,J)$ of the estimation residual error maximum value $ResP_{max}W_{band}(id,J)$ by which the weight $W_{max}$ is multiplied and the estimation residual error average value $ResP_{ave}W_{band}(id,J)$ by which the weight $W_{ave}$ is multiplied and the sum is set as the estimation value $ResPW_{band}(id,J)$.

In step S378, the pseudo high band sub-band power difference calculation circuit 36 adds the evaluation value $ResW_{band}(id,J)$ to the estimation value $ResPW_{band}(id,J)$ by which the weight $W_p(J)$ of the Equation (25) is multiplied to calculate the final estimation value $Res_{all}W_{band}$(id,J). This estimation value $Res_{all}W_{band}$(id,J) is calculated for each of the K number decoded high band sub-band power estimation coefficient.

In addition, after that, the processes of step S379 to step S381 are performed to terminate the encoding process. However, since their processes are identical to those of with step S339 to step S341 in FIG. 25, the description thereof is omitted. In addition, the estimation value $Res_{all}W_{band}$(id,J) is selected to be a minimum in the K number of coefficient index in step S379.

As described above, in order to place the weight in the sub-band of the low band side, it is possible to obtain sound having further high quality in the decoder 40 side by providing the weight for each of the sub-band.

In addition, as described above, the selection of the number of the decoded high band sub-band power estimation coefficient has been described as being performed based on the estimation value $Res_{all}W_{band}$(id,J). However, the decoded high band sub-band power evaluation coefficient may be selected based on the estimation value $ResW_{band}$ (id,J).

Modification Example 3

In addition, since the auditory of person has a property that properly perceives a larger frequency band of the amplitude (power), the estimation value with respect to each decoded high band sub-band power estimation coefficient may be calculated so that the weight may be placed on the sub-band having a larger power.

Figure 27:
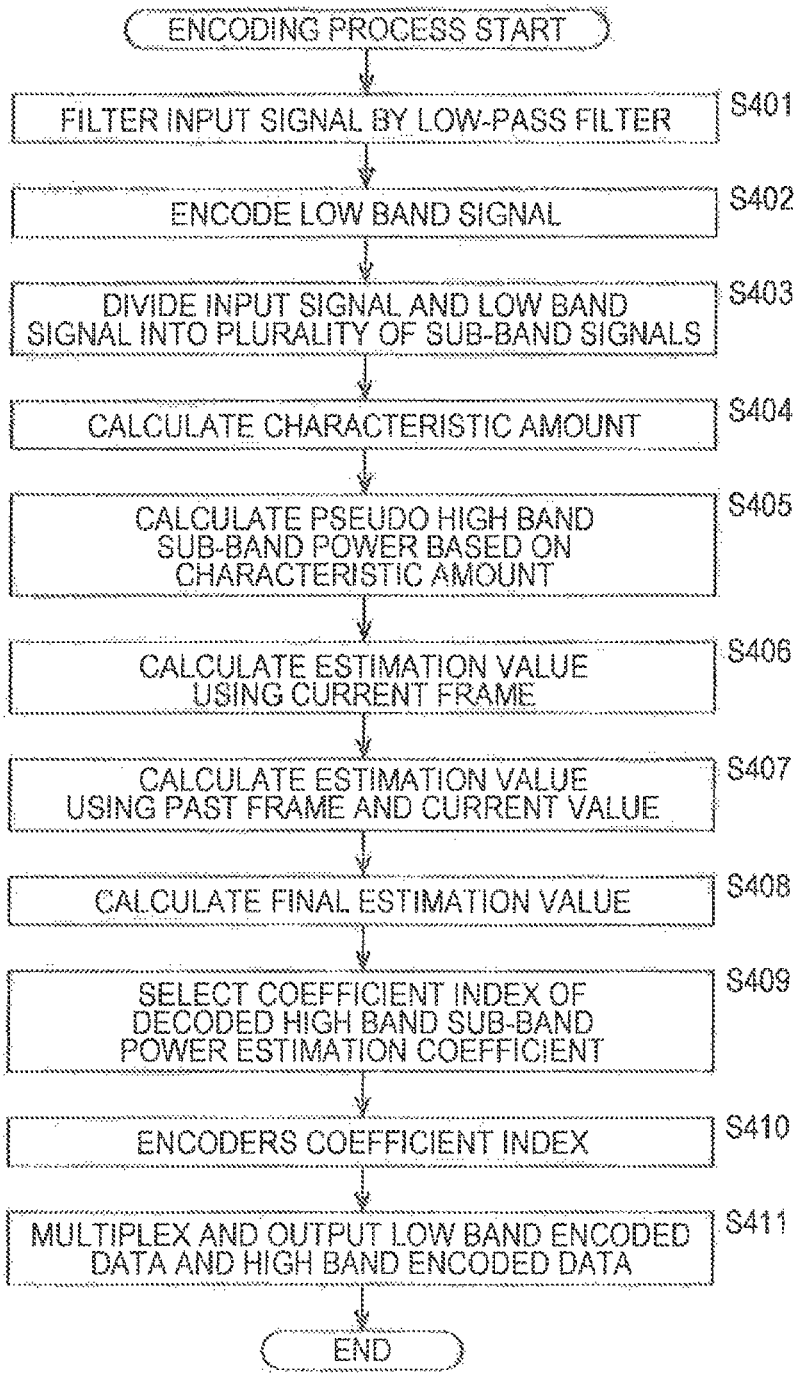
FIG. 27 is a flowchart describing an encoding process.

In this case, the encoder 30 in FIG. 18 performs an encoding process illustrated in a flowchart in FIG. 27. The encoding process by the encoder 30 will be described below with reference to the flowchart in FIG. 27. In addition, since the processes of step S401 to step S405 are identical with those of step S331 to step S335 in FIG. 25, the description thereof will be omitted.

In step S406, the pseudo high band sub-band power difference calculation circuit 36 calculates the estimation value $ResW_{power}$(id,J) using the current frame J to be processed for the K number of decoded high band sub-band power estimation coefficient.

Specifically, the pseudo high band sub-band power difference calculation circuit 36 calculates the high band sub-band power power (ib,J) in the frames J by performing the same operation as the Equation (1) described above by using a high band sub-band signal of each sub-band supplied from the sub-band division circuit 33.

If the high band sub-band power power(ib,J) is obtained, the pseudo high band sub-band power difference calculation circuit 36 calculates the following Equation (29) and calculates the residual error squares average value $Res_{std}W_{power}$ (id,J).

[Equation 29]

$$Res_{std}W_{power}(id, J) = \sum_{ib=sb+1}^{eb} \{W_{power}(\text{power}(ib, J)) \times \{power(id, J) - \text{power}_{est}(ib, id, J)\}\}^2 \quad (29)$$

That is, the difference between the high band sub-band power $power_{est}$(ib,J) and the pseudo high band sub-band power $power_s$(ib,id,J) is obtained and the weight $W_{power}$ (power(ib,J) for each of the sub-bands is multiplied by the difference thereof with respect to each band of the high band side in which the index is sb+1 to eb. In addition, the square sum of the difference by which the weight $W_{power}$(power (ib,J) is multiplied by set as the residual error squares average value $Res_{std}W_{power}$(id,J).

Herein, the weight $W_{power}$(power(ib,J) (where, sb+1≤ib≤eb), for example, is defined as the following Equation (30). As the high band sub-band power power(ib,J) of the sub-band becomes large, the value of weight $W_{power}$ (power(ib,J) becomes larger.

[Equation 30]

$$W_{power}(\text{power}(ib, J)) = \frac{3 \times \text{power}(ib, J)}{80} + \frac{35}{8} \quad (30)$$

Next, the pseudo high band sub-band power difference calculation circuit 36 calculates the residual error maximum value $Res_{max}W_{power}$(id,J). Specially, the maximum value of the absolute value multiplying the difference between the high band sub-band power power(ib,J) of the each sub-band that the index is sb+1 to eb and the pseudo high band sub-band power $power_{est}$(ib,id,J) by the weight $W_{power}$ (power(ib,J)) is set as the residual error maximum value $Res_{max}W_{power}$(id,J).

In addition, the pseudo high band sub-band power difference calculation circuit 36 calculates the residual error average value $Res_{ave}W_{power}$(id,J).

Specially, in each sub-band where the index is sb+1 to eb, the difference between the high band sub-band power power (ib,J) and the pseudo high band sub-band power $power_{est}$ (ib,id,J) is obtained and the weight by which ($W_{power}$(power (ib,J) is multiplied and the sum total of the difference that the weight $W_{power}$(power(ib,J)) is multiplied is obtained. In addition, the absolute value of the values obtained by dividing the sum total of the obtained difference into the number of the high band sub-band and eb−sb) is set as the residual error average $Res_{ave}W_{power}$(id,J).

Further, the pseudo high band sub-band power difference calculation circuit 36 calculates the estimation value $ResW_{power}$(id,J). That is, the sum of residual squares average value $Res_{std}W_{power}$(id,J), the residual error difference value $Res_{max}W_{power}$(id,J) by which the weight ($W_{max}$) is multiplied and the residual error average value $Res_{ave}W_{power}$(id,J) by which the weight ($W_{ave}$) is multiplied, is set as the estimation value $ResW_{power}$(id,J).

In step S407, the pseudo high band sub-band power difference calculation circuit 36 calculates the estimation value $ResPW_{power}$(id,J) using the past frame and the current frames.

Specifically, the pseudo high band sub-band power difference calculation circuit 36 records the pseudo high band sub-band power of each sub-band obtained by using the decoded high band sub-band power estimation coefficient of the coefficient index selected finally with respect to the frames (J−1) before one frame earlier than the frame J to be processed in time.

The pseudo high band sub-band power difference calculation circuit 36 first calculates the estimation residual square average value $ResP_{std}W_{power}$(id,J). That is, the difference between the pseudo high band sub-band power $power_{est}$(ib,idJ) and the pseudo high band sub-band power ($power_{est}$(ib,$id_{selected}$(J−1),J−1) is obtained to multiply the weight $W_{power}$(power(ib,J), with respect to each sub-band the high-band side in which the index is sb+1 and eb. The square sum of the difference that the weight $W_{power}$(power (ib,J) is multiplied is set as the estimation residual square average value $ResP_{std}W_{power}$(id,J).

Next, the pseudo high band sub-band power difference calculation circuit 36 calculates the estimation residual error maximum value $ResP_{max}W_{power}$(id,J). Specifically, the absolute value of the maximum value of the values multiplying the difference between the pseudo high band sub-band power $power_{est}(ib,id_{selected}(J-1),J-1)$ of each sub-band in which the index is sb+1 to as eb and the pseudo high band sub-band power $power_{est}$(ib,id,J) by the weight $W_{power}$ (power(ib,J) is set as the estimation residual error maximum value $ResP_{max}W_{power}$(id,J).

Next, the pseudo high band sub-band power difference calculation circuit 36 calculates the estimation residual error average value $ResP_{ave}W_{power}$(id,J). Specifically, the difference between the pseudo high band sub-band power $power_{est}(ib,id_{selected}(J-1),J-1)$ and the pseudo high band sub-band power $power_{est}$(ib,id,J) is obtained with respect to each sub-band in which the index is sb+1 to eb and the weight $W_{power}$(power(ib,J) is multiplied. In addition, the absolute values of the values obtained by dividing the sum total of the multiplied difference of the weight $W_{power}$(power(ib,J) into the number (eb−sb) of the sub-band of high band side is set as the estimation residual error average value $ResP_{ave}W_{power}$(id,J).

Further, the pseudo high band sub-band power difference calculation circuit 36 obtains the sum of the estimation residual squares mean value $ResP_{std}W_{power}$(id,J), the estimation residual error maximum value $R_{es}P_{max}W_{power}$(id,J) by which the weight ($W_{max}$) is multiplied and the estimation residual error average value $ResP_{ave}W_{power}$(id,J) that the weight ($W_{ave}$) is multiplied is obtained and the sum is set as the estimation value $R_{es}PW_{power}$(id,J).

In step S408, the pseudo high band sub-band power difference calculation circuit 36 adds the estimation value ResWpower(id,J) to the estimation value $ResPW_{power}$(id,J) by which the weight $W_p$(J) of the Equation (25) is multiplied to calculate the final estimation value $Res_{all}W_{power}$(id,J). The estimation value $Res_{all}W_{power}$(id,J) is calculated from each K number of the decoded high band sub-band power estimation coefficient.

In addition, after that, the processes of step S409 to step S411 are performed to terminate the encoding process. However, since these processes are identical with those of step S339 to step S341 in FIG. 25, the description thereof is omitted. In addition, in step S409, the coefficient index in which the estimation value $Res_{all}W_{power}$(id,J) is set as a minimum is selected among the K number of the coefficient index.

As described above, in order for weight to be placed on the sub-band having a large sub-band, it is possible to obtain sound having high quality by providing the weight for each sub-band in the decoder 40 side.

In addition, as described above, the selection of the decoded high band sub-band power estimation coefficient has been described as being performed based on the estimation value $Res_{all}W_{power}$(id,J). However, the decoded high band sub-band power estimation coefficient may be selected based on the estimation value $ResW_{power}$(id,J).

6. Sixth Embodiment

Configuration of Coefficient Learning Apparatus

By the way, a set of a coefficient $A_{ib}$(kb) as the decoded high band sub-band power estimation coefficient and a coefficient $B_{ib}$ is recorded in a decoder 40 in FIG. 20 to correspond to the coefficient index. For example, if the decoded high band sub-band power estimation coefficient of 128 coefficient index is recorded in decoder 40, a large area is needed as the recording area such as memory for recording the decoded high band sub-band power estimation coefficient thereof.

Figure 28:
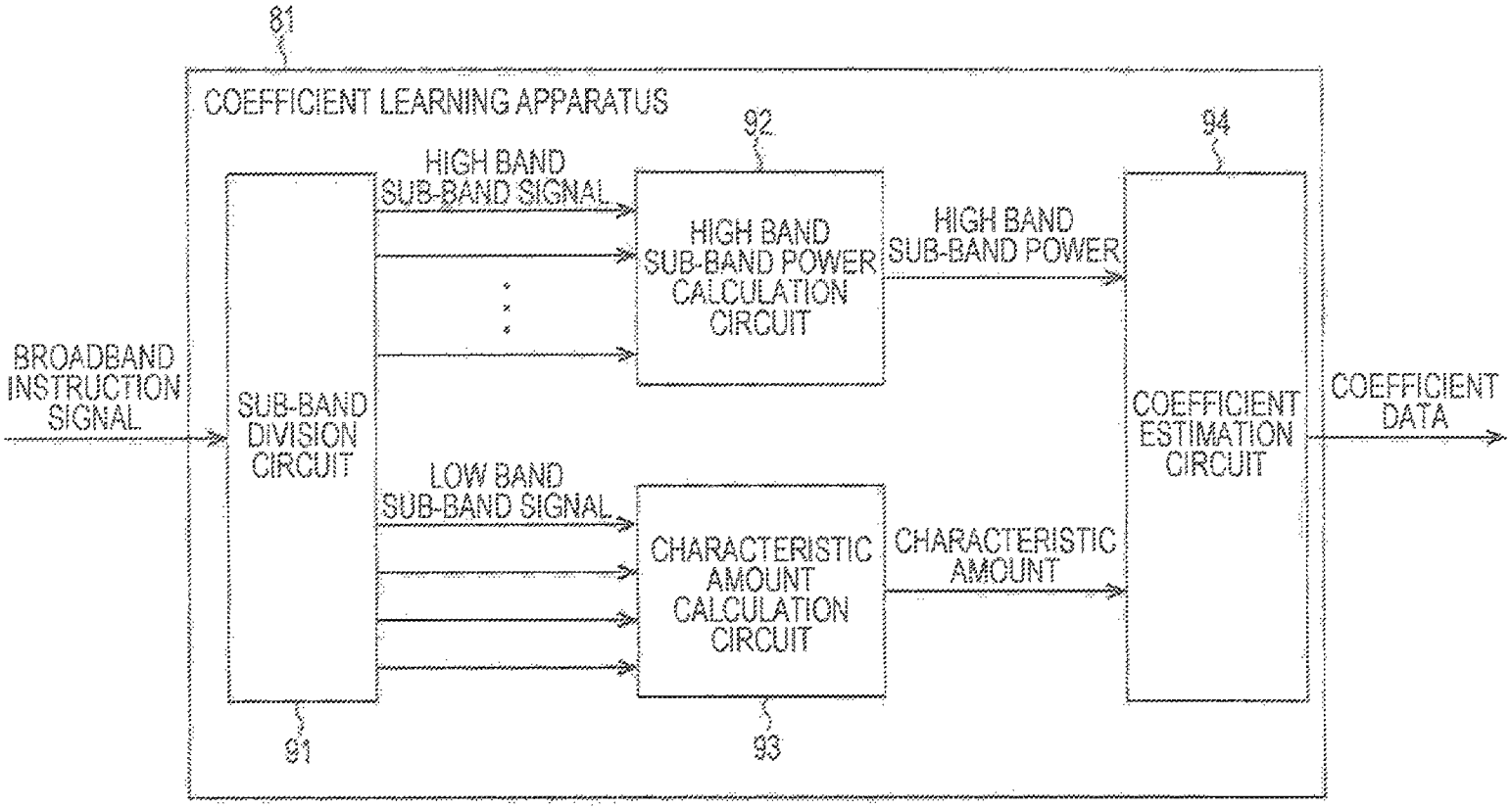
FIG. 28 is a view illustrating a configuration example of a coefficient learning apparatus.

Herein, a portion of a number of the decoded high band sub-band power estimation coefficient is set as common coefficient and the recording area necessary to record the decoded high band sub-band power estimation coefficient may be made smaller. In this case, the coefficient learning apparatus obtained by learning the decoded high band sub-band power estimation coefficient, for example, is configured as illustrated in FIG. 28.

The coefficient learning apparatus 81 includes a sub-band division circuit 91, a high band sub-band power calculation circuit 92, a characteristic amount calculation circuit 93 and a coefficient estimation circuit 94.

A plurality of composition data using learning is provided in a plurality of the coefficient learning apparatus 81 as a broadband instruction signal. The broadband instruction signal is a signal including a plurality of sub-band component of the high band and a plurality of the sub-band components of the low band.

The sub-band division circuit 91 includes the band pass filter and the like, divides the supplied broadband instruction signal into a plurality of the sub-band signals and supplies to the signals the high band sub-band power calculation circuit 92 and the characteristic amount calculation circuit 93. Specifically, the high band sub-band signal of each sub-band of the high band side in which the index is sb+1 to eb is supplied to the high band sub-band power calculation circuit 92 and the low band sub-band signal of each sub-band of the low band in which the index is sb−3 to sb is supplied to the characteristic amount calculation circuit 93.

The high band sub-band power calculation circuit 92 calculates the high band sub-band power of each high band sub-band signal supplied from the sub-band division circuit 91 and supplies it to the coefficient estimation circuit 94. The characteristic amount calculation circuit 93 calculates the low band sub-band power as the characteristic amount, the low band sub-band power based on each low band sub-band signal supplied from the sub-band division circuit 91 and supplies it to the coefficient estimation circuit 94.

The coefficient estimation circuit 94 produces the decoded high band sub-band power estimation coefficient by performing a regression analysis using the high band sub-band power from the high band sub-band power calculation circuit 92 and the characteristic amount from the characteristic amount calculation circuit 93 and outputs to decoder 40.

[Description of Coefficient Learning Process]

Next, a coefficient learning process performed by a coefficient learning apparatus 81 will be described with reference to a flowchart in FIG. 29.

In step S431, the sub-band division circuit 91 divides each of a plurality of the supplied broadband instruction signal into a plurality of sub-band signals. In addition, the sub-band division circuit 91 supplies a high band sub-band signal of the sub-band that the index is sb+1 to eb to the high band sub-band power calculation circuit 92 and supplies the low band sub-band signal of the sub-band that the index is sb−3 to sb to the characteristic amount calculation circuit 93.

In step S432, the high band sub-band power calculation circuit 92 calculates the high band sub-band power by performing the same operation as the Equation (1) described above with respect to each high band sub-band signal supplied from the sub-band division circuit 91 and supplies it to the coefficient estimation circuit 94.

In step S433, the characteristic amount calculation circuit 93 calculates the low band sub-band power as the characteristic amount by performing the operation of the Equation (1) described above with respect each low band sub-band signal supplied from the sub-band division circuit 91 and supplies to it the coefficient estimation circuit 94.

Accordingly, the high band sub-band power and the low band sub-band power are supplied to the coefficient estimation circuit 94 with respect to each frame of a plurality of the broadband instruction signal.

In step S434, the coefficient estimation circuit 94 calculates a coefficient. $A_{ib}$(kb) and a coefficient $B_{ib}$ by performing the regression of analysis using least-squares method for each of the sub-band ib (where, sb+1≤ib≤eb) of the high band in which the index is sb+1 to eb.

In the regression analysis, it is assumed that the low band sub-band power supplied from the characteristic amount calculation circuit 93 is an explanatory variable and the high band sub-band power supplied from the high band sub-band power calculation circuit 92 is an explained variable. In addition, the regression analysis is performed by using the low band sub-band power and the high band sub-band power of the whole frames constituting the whole broadband instruction signal supplied to the coefficient learning apparatus 61.

In step S435, the coefficient estimation circuit 94 obtains the residual vector of each frame of the broadband instruction signal using a coefficient $A_{ib}$(kb and a coefficient ($B_{ib}$) for each of obtained sub-band ib.

For example, the coefficient estimation circuit 94 obtains the residual error by subtracting the sum of total of the lower band sub-band power power(kb, J) (where, sb−3≤kb≤sb) that is acquired by the coefficient is Aib$A_{ib}$(kb) thereto coefficient $B_{ib}$ multiplied from the high band power ((power (ib,J) for each of the sub-band ib (where, sb+1≤ib≤eb) of the frame J and. In addition, vector including the residual error of each sub-band ib of the frame J is set as the residual vector.

In addition, the residual vector is calculated with respect to the frame constituting the broadband instruction signal supplied to the coefficient learning apparatus 81.

In step S436, the coefficient estimation circuit 94 normalizes the residual vector obtained with respect to each frame. For example, the coefficient estimation circuit 94 normalizes, for each sub-band ib, the residual vector by obtaining variance of the residual of the sub-band ib of the residual vector of the whole frame and dividing a residual error of the sub-band ib in each residual vector into the square root of the variance.

In step S437, the coefficient estimation circuit 94 clusters the residual vector of the whole normalized frame by the k-means method or the like.

For example, the average frequency envelope of the whole frame obtained when performing the estimation of the high band sub-band power using the coefficient $A_{ib}$(kb) and the coefficient $B_{ib}$ is referred to as an average frequency envelope SA. In addition, it is assumed that a predetermined frequency envelope having larger power than the average frequency envelope SA is frequency envelope SH and a predetermined frequency envelope having smaller power than the average frequency envelope SA is frequency envelope SL.

In this case, each residual vector of the coefficient in which the frequency envelope close to the average frequency envelop SA, the frequency envelop SH and the frequency envelop SL is obtained, performs clustering of the residual vector so as to be included in a cluster CA, a cluster CH, and a cluster CL. That is, the residual vector of each frame performs clustering so as to be included in any one of cluster CA, a cluster CH or a cluster CL.

In the frequency band expansion process for estimating the high band component based on a correlation of the low band component and the high band component, in terms of this, if the residual vector is calculated using the coefficient $A_{ib}$ (kb) and the coefficient $B_{ib}$ obtained from the regression analysis, the residual error increases as much as large as the sub-band of the high band side. Therefore, the residual vector is clustered without changing, the weight is placed in as much as sub-band of the high band side to perform process.

In this contrast, in the coefficient learning apparatus 81, variance of the residual error of each sub-band is apparently equal by normalizing the residual vector as the variance of the residual error of the sub-band and clustering can be performed by providing the equal weight to each sub-band.

In step S438, the coefficient estimation circuit 94 selects as a cluster to be processed of any one of the cluster CA, the cluster CH and the cluster CL.

In step S439, the coefficient estimation circuit 94 calculates $A_{ib}$(kb) and the coefficient $B_{ib}$ of each sub-band ib (where, sb+1≤ib≤eb) by the regression analysis using the frames of the residual vector included in the cluster selected as the cluster to be processed.

That is, if the frame of the residual vector included in the cluster to be processed is referred to as the frame to be processed, the low band sub-band power and the high band sub-band power of the whole frame to be processed is set as the exploratory variable and the explained variable and the regression analysis used the least-squares method is performed. Accordingly, the coefficient $A_{ib}$(kb) and the coefficient $B_{ib}$ is obtained for each sub-band ib.

In step S440, the coefficient estimation circuit 94 obtains the residual vector using the coefficient $A_{ib}$(kb) and the coefficient $B_{ib}$ obtained by the process of step S439 with respect the whole frame to be processed. In addition, in step S440, the same process as the step S435 is performed and thus the residual vector of each frame to be processed is obtained.

In step S441, the coefficient estimation circuit 94 normalizes the residual vector of each frame to be processed obtained by process of step S440 by performing the same process as step S436. That is, normalization of the residual vector is performed by dividing the residual error by the variance for each the sub-band.

In step S442, the coefficient estimation circuit 94 clusters the residual vector of the whole normalized frame to be processed using k-means method or the like. The number of this cluster number is defined as following. For example, in the coefficient learning apparatus 81, when decoded high band sub-band power estimation coefficients of 128 coefficient indices are produced, 128 is multiplied by the frame number to be processed and the number obtained by dividing the whole frame number is set as the cluster number. Herein, the whole frame number is referred to as sum of the whole frame of the broadband instruction signal supplied to the coefficient learning apparatus 81.

In step S443, the coefficient estimation circuit 94 obtains a center of gravity vector of each cluster obtained by process of step S442.

For example, the cluster obtained by the clustering of the step S442 corresponds to the coefficient index and in the coefficient learning apparatus 81, the coefficient index is assigned for each cluster to obtain the decoded high band sub-band power estimation coefficient of the each coefficient index.

Specifically, in step S438, it is assumed that the cluster CA is selected as a cluster to be processed and F clusters are obtained by clustering in step S442. When one cluster CF of F clusters is focused, the decoded high band sub-band power estimation coefficient of a coefficient index of the cluster CF is set as the coefficient $A_{ib}$(kb) in which the coefficient $A_{ib}$(kb) obtained with respect to the cluster CA in step S439 is a linear correlative term. In addition, the sum of the vector performing a reverse process (reverse normalization) of a normalization performed at step S441 with respect to center of gravity vector of the cluster CF obtained from step S443 and the coefficient $B_{ib}$ obtained at step S439 is set as the coefficient $B_{ib}$ which is a constant term of the decoded high band sub-band power estimation coefficient. The reverse normalization is set as the process multiplying the same value (root square for each sub-band) as when being normalized with respect to each element of center of gravity vector of the cluster CF when the normalization, for example, performed at step S441 divides the residual error into the root square of the variance for each sub-band.

That is, the set of the coefficient $A_{ib}$(kb) obtained at step S439 and the coefficient $B_{ib}$ obtained as described is set as the decoded high band sub-band power estimation coefficient of the coefficient index of the cluster CF. Accordingly, each of the F clusters obtained by clustering commonly has the coefficient $A_{ib}$(kb) obtained with respect to the cluster CA as the linear correlation term of the decoded high band sub-band power estimation coefficient.

In step S444, the coefficient learning apparatus 81 determines whether the whole cluster of the cluster CA, the cluster CH and the cluster CL is processed as a cluster to be processed. In addition, in step S444, if it is determined that the whole cluster is not processed, the process returns to step S438 and the process described is repeated. That is, the next cluster is selected to be processed and the decoded high band sub-band power estimation coefficient is calculated.

In this contrast, in step S444, if it is determined that the whole cluster is processed, since a predetermined number of the decoded high band sub-band power to be obtained is calculated, the process proceeds to step S445.

In step S445, the coefficient estimation circuit 94 outputs and the obtained coefficient index and the decoded high band sub-band power estimation coefficient to decoder 40 and thus the coefficient learning process is terminated.

For example, in the decoded high band sub-band power estimation coefficients output to decoder 40, there are several same coefficients $A_{ib}$(kb) as linear correlation term. Herein, the coefficient learn ing apparatus 81 corresponds to the linear correlation term index (pointer) which is information that specifies the coefficient $A_{ib}$(kb) to the coefficient $A_{ib}$(kb) common to thereof and corresponds the coefficient $B_{ib}$ which is the linear correlation index and the constant term to the coefficient index.

In addition, the coefficient learning apparatus 81 supplies the corresponding linear correlation term index (pointer) and a coefficient $A_{ib}$(kb), and the corresponding coefficient index and the linear correlation index (pointer) and the coefficient $B_{ib}$ to the decoder 40 and records them in a memory in the high band decoding circuit 45 of the decoder 40. Like this, when a plurality of the decoded high band sub-band power estimation coefficients are recorded, if the linear correlation term index (pointer) is stored in the recording area for each decoded high band sub-band power estimation coefficient with respect to the common linear correlation term, it is possible to reduce the recording area remarkably.

In this case, since the linear correlation term index and to the coefficient $A_{ib}$(kb) are recorded in the memory in the high band decoding circuit 45 to correspond to each other, the linear correlation term index and the coefficient $B_{ib}$ are obtained from the coefficient index and thus it is possible to obtain the coefficient $A_{ib}$(kb) from the linear correlation term index.

In addition, according to a result of analysis by the applicant, even though the linear correlation term of a plurality of the decoded high band sub-band power estimation coefficients is communized in a three-pattern degree, it has known that deterioration of sound quality of audibility of sound subjected to the frequency band expansion process does not almost occur. Therefore, it is possible for the coefficient learning apparatus 81 to decrease the recording area required in recording the decoded high band sub-band power estimation coefficient without deteriorating sound quality of sound after the frequency band expansion process.

As described above, the coefficient learning apparatus 81 produces the decoded high band sub-band power estimation coefficient of each coefficient index from the supplied broadband instruction signal, and output the produced coefficient.

Figure 29:
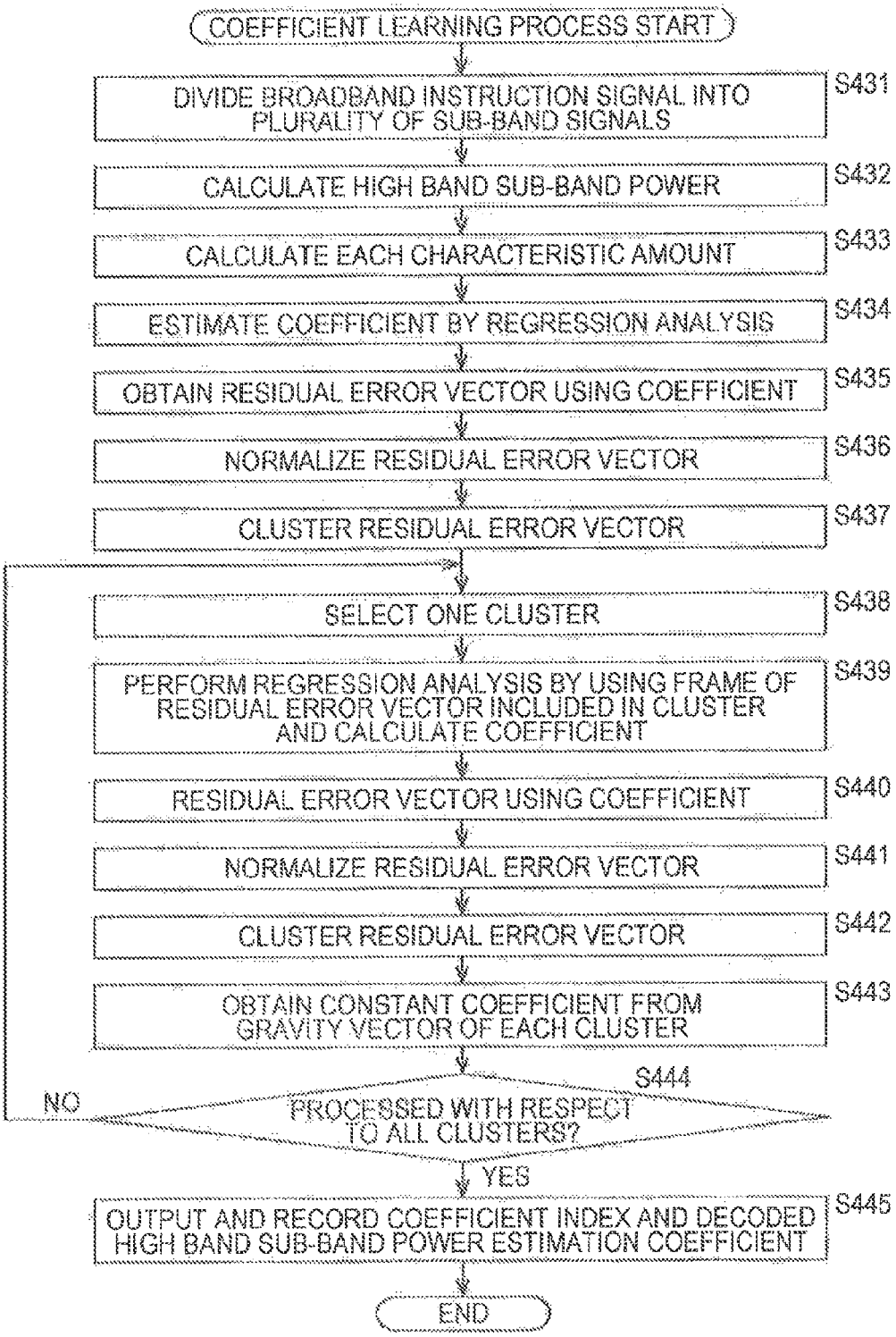
FIG. 29 is a flowchart describing a coefficient learning process.

In addition, in the coefficient learning process in FIG. 29, the description is made that the residual vector is normalized. However, the normalization of the residual vector may not be performed in one or both of step S436 and step S441.

In addition, the normalization of the residual vector is performed and thus communization of the linear correlation term of the decoded high band sub-band power estimation coefficient may not be performed. In this case, the normalization process is performed in step S436 and then the normalized residual vector is clustered in the same number of clusters as that of the decoded high band sub-band power estimation coefficient to be obtained. In addition, the frames of the residual error included in each cluster are used to perform the regression analysis for each cluster and the decoded high band sub-band power estimation coefficient of each cluster is produced.

7. Seventh Embodiment

Regarding Sharing of Coefficient Table

Incidentally, in the above description, it has been described that, in order to obtain the high band sub-band signals of the sub-band ib on the high band side in which the index is ib (wherein, sb+1≤ib≤eb), the coefficients $A_{ib}$(sb−3) to $A_{ib}$(sb) and the coefficient $B_{ib}$ as the decoding high band sub-band power estimation coefficients are used.

Since the high band components includes (eb−sb) sub-bands of the sub-bands sb+1 to eb, a coefficient set illustrated in, for example, FIG. 30 is necessary in order to obtain a decoded high band signal including the high band sub-band signals of the respective sub-bands.

That is, the coefficients $A_{sb+1}$(sb−3) to $A_{sb+1}$(sb) in the uppermost row of FIG. 30 are coefficients which are multiplied by the respective low band sub-band powers of the sub-bands sb−3 to sb on the low band side in order to obtain the decoding high band sub-band power of the sub-band sb+1. In addition, the coefficient $B_{sb+1}$ in the uppermost row of the drawing is a constant term of a linear combination of the low band sub-band powers for obtaining the decoding high band sub-band power of the sub-band sb+1.

Similarly, the coefficients $A_{sb}$(sb−3) to $A_{eb}$(sb) in the lowermost row of the drawing are coefficients which are multiplied by the respective low band sub-band powers of the sub-bands sb−3 to sb on the low band side in order to obtain the decoding high band sub-band power of the sub-band eb. In addition, the coefficient $B_{eb}$ in the lowermost row of the drawing is a constant term of a linear combination of the low band sub-band powers for obtaining the decoding high band sub-band power of the sub-band eb.

In this way, in the encoder 30 and the decoder 40, 5×(eb−sb) coefficient sets are recorded in advance as the decoding high band sub-band power estimation coefficients which are specified by one coefficient index. Hereinafter, these 5×(eb−sb) coefficient sets as the decoding high band sub-band power estimation coefficients will be referred to as the coefficient tables.

For example, when it is attempted to obtain the decoded high band signal including more than (eb−sb) sub-bands, the coefficient table illustrated in FIG. 30 lacks the coefficients and thus the decoded high band signals are not obtained appropriately. Conversely, when it is attempted to obtain the decoded high band signals including less than (eb−sb) sub-bands, the coefficient table illustrated in FIG. 30 have many redundant coefficients.

Therefore, in the encoder 30 and the decoder 40, many coefficient tables should be recorded in advance to correspond to the number of sub-bands constituting the decoded high band signals and thus there is a case where the size of a recoding area where coefficient tables are recorded increases.

Therefore, by recording a coefficient table for obtaining the decoded high band signals of a predetermined number of sub-bands and extending or reducing the coefficient table, the decoded high band signals having different numbers of sub-bands may be handled.

Specifically, for example, it is assumed that a coefficient table of a case where Index eb=sb+8 is recorded in the encoder 30 and the decoder 40. In this case, when the respective coefficients constituting the coefficient table are used, the decoded high band signal having 8 sub-bands can be obtained.

Figure 31:
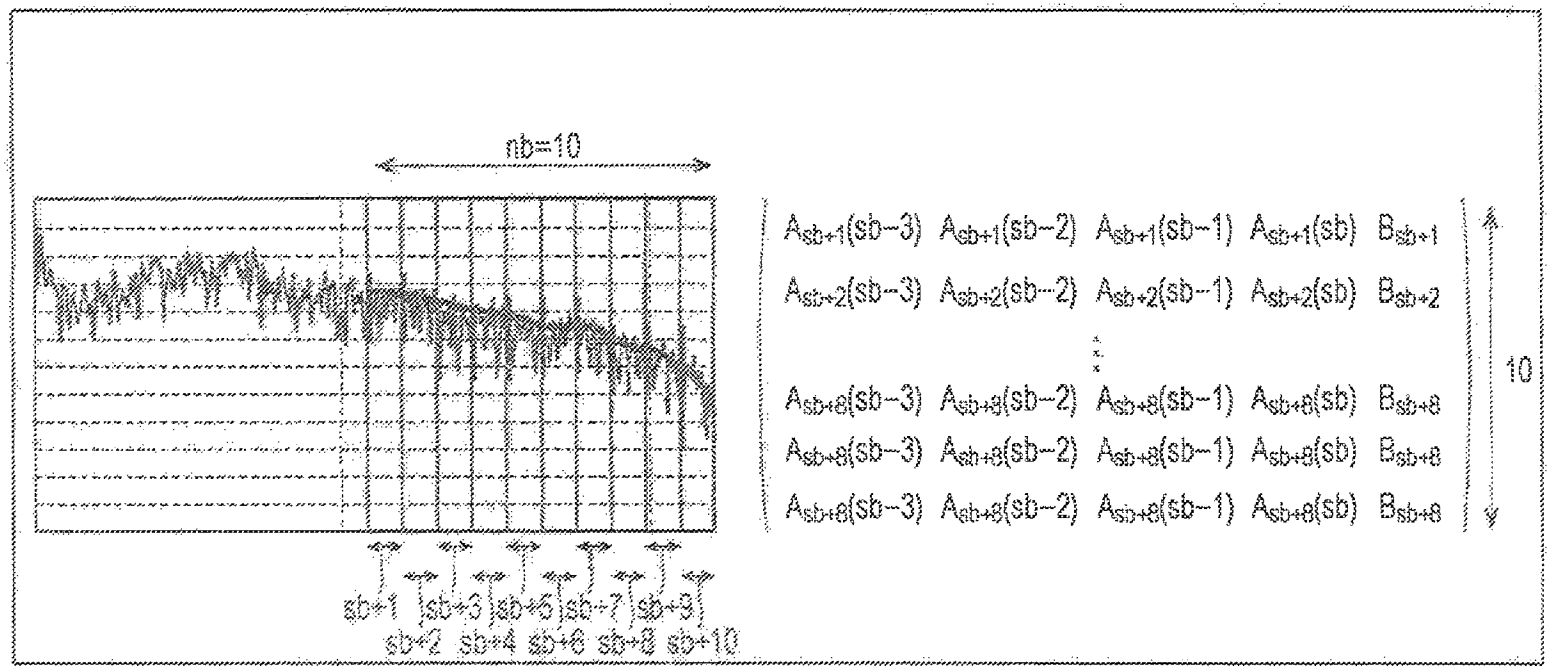
FIG. 31 is a diagram illustrating the extension of a coefficient table.

Here, for example, as illustrated on the left side of FIG. 31, when it is attempted to obtain the decoded high band signal including 10 sub-bands of the sub-bands sb+1 to sb+10, the coefficient table which is recorded in the encoder 30 and the decoder 40 lacks coefficients. That is, the coefficients $A_{ib}$(kb) and $B_{ib}$ of the sub-bands sb+9 and sb+10 are lacking.

Therefore, when the coefficient table is extended as illustrated on the right side of the drawing, by using the coefficient table of the case where there are 8 sub-bands on the high band side, the decoded high band signal including 10 sub-bands can be appropriately obtained. Here, in the drawing, the horizontal axis represents the frequency and the vertical axis represents the power. In addition, the respective frequency components of an input signal are illustrated on the left side of the drawing, and lines in the vertical direction indicate the boundary positions of the respective sub-bands on the high band side.

In an example of FIG. 31, the coefficients $A_{sb+8}$(sb−3) to $A_{sb+8}$(sb) and the coefficient $B_{sb+8}$ of the sub-band sb+8 as the decoding high band sub-band power estimation coefficients are used as the coefficients of the sub-bands sb+9 and sb+10 without any change.

That is, in the coefficient table, the coefficients $A_{sb+8}$(sb−3) to $A_{sb+8}$(sb) and the coefficient $B_{sb+8}$ of the sub-band sb+8 are duplicated and used as the coefficients $A_{sb+9}$(sb−3) to $A_{sb+9}$(sb) and the coefficient $B_{sb+9}$ of the sub-band sb+9 without any change. Similarly, in the coefficient table, the coefficients $A_{sb+8}$(sb−3) to $A_{sb+8}$(sb) and the coefficient $B_{sb+8}$ of the sub-band sb+8 are duplicated and used as the coefficients $A_{sb+10}$(sb−3) to $A_{ab+10}$(sb) and the coefficient $B_{sb+10}$ of the sub-band sb+10 without any change.

In this way, when a coefficient table is extended, the coefficients $A_{ib}$(kb) and $B_{ib}$ of a sub-band having the highest frequency in the coefficient table are used for lacking coefficients of a sub-band without any change.

In addition, even when the estimation accuracy of components of a sub-band having a high frequency of high band components such as the sub-bands sb+9 and sb+10 deteriorates to some degree, there is no deterioration in audibility at the time of the reproduction of an output signal including the decoded high band signals and the decoding low band signals.

In addition, the extension of the coefficient table is not limited to the example of duplicating the coefficients $A_{ib}$(kb) and $B_{ib}$ of the sub-band having the highest frequency and setting the duplicated coefficients to coefficients of other sub-bands. The coefficients of some sub-bands of the coefficient table may be duplicated and set to coefficients of the sub-bands which are to be extended (which are lacking). In addition, the coefficients to be duplicated are not limited to those of one sub-band. The coefficients of plural sub-bands may be duplicated and respectively set to coefficients of plural sub-bands to be extended. Furthermore, the coefficients of sub-bands to be extended may be calculated based on the coefficients of some sub-bands.

Figure 32:
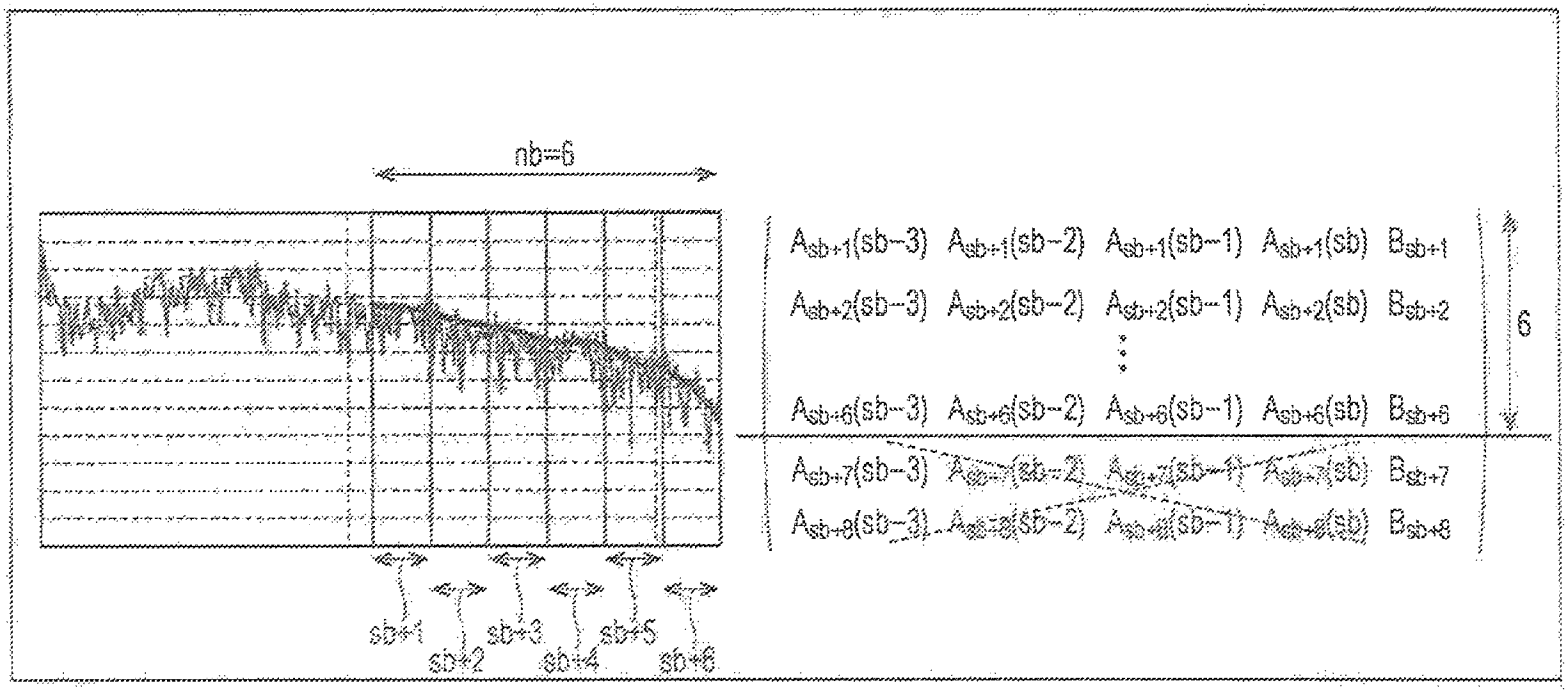
FIG. 32 is a diagram illustrating the reduction of a coefficient table.

On the other hand, for example, it is assumed that a coefficient table of a case where Index eb=sb+8 is recorded in the encoder 30 and the decoder 40 and a decoded high band signal including 6 sub-bands is produced as illustrated on, for example, on the left side of FIG. 32. Here, in the drawing, the horizontal axis represents the frequency and the vertical axis represents the power. In addition, the respective frequency components of an input signal are illustrated on the left side of the drawing, and lines in the vertical direction indicate the boundary positions of the respective sub-bands on the high band side.

In this case, a coefficient table in which there are 6 sub-bands on the high band side is not recorded in the encoder 30 and the decoder 40. Therefore, when the coefficient table is reduced as illustrated on the right side of the drawing, the decoded high band signal including 6 sub-bands can be obtained using the coefficient table in which there are 8 sub-bands on the high band side.

In the example of FIG. 32, from the coefficient table as the decoding high band sub-band power estimation coefficients, the coefficients $A_{sb+7}$(sb−3) to $A_{sb+7}$(sb) and the coefficient $B_{sb+7}$ of the sub-band sb+7 and the coefficients $A_{sb+8}$(sb−3) to $A_{sb+8}$(sb) and the coefficient $B_{sb+8}$ of the sub-band sb+8 are deleted. In addition, a new coefficient table having the coefficients of six sub-bands of the sub-bands sb+1 to sb+6, from which the coefficients of the sub-bands sb+7 and sb+8 are deleted, is used as the decoding high band sub-band power estimation coefficients to produce a decoded high band signal.

In this way, when a coefficient table is reduced, the coefficients $A_{ib}$(kb) and $B_{ib}$ of unnecessary sub-bands in the coefficient table, that is, sub-bands which are not used for the production of a decoded high band signals are deleted and thus the reduced coefficient table is obtained.

As described above, by appropriately extending or reducing the coefficient table, which is recorded in an encoder and a decoder, to correspond to the number of sub-bands of a decoded high band signal which is to be produced, the coefficient table of a predetermined number of sub-bands can be shared for use. As a result, the size of a recording area of coefficient tables can be reduced.

[Functional Configuration Example of Encoder]

Figure 33:
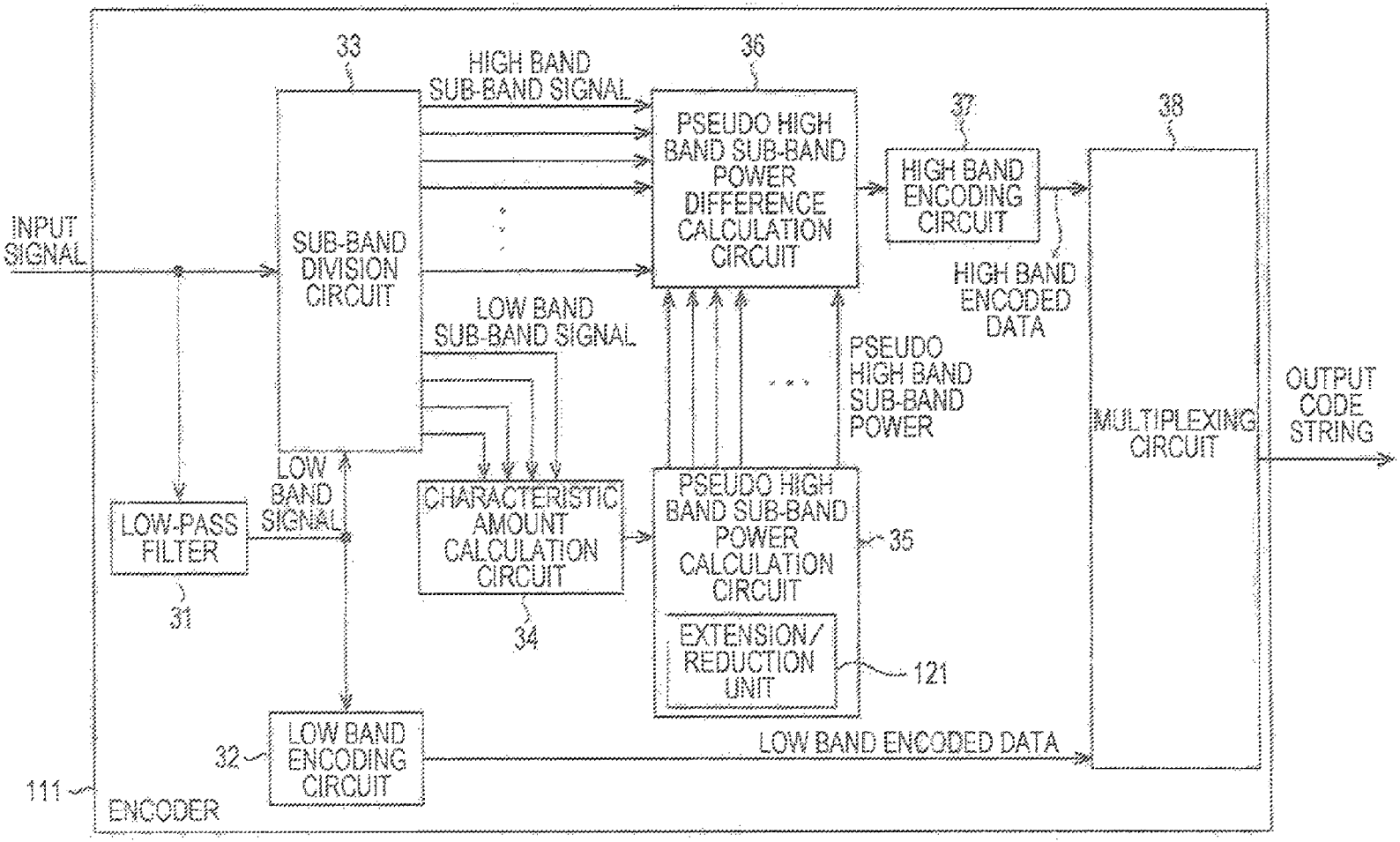
FIG. 33 is a block diagram illustrating a functional configuration example of an encoder.

When a coefficient table is extended or reduced as necessary, an encoder is configured as illustrated in, for example, FIG. 33. In FIG. 33, the same reference numbers are given to parts corresponding to those of the case illustrated in FIG. 18 and the description thereof will be appropriately omitted.

An encoder 111 of FIG. 33 is different front the encoder 30 of FIG. 18 in that the pseudo high band sub-band power calculation circuit 35 of the encoder 111 is provided with an extension/reduction unit 121, and the other configurations are the same.

The extension/reduction unit 121 extends or reduces a coefficient table which is recorded by the pseudo high band sub-band power calculation circuit 35 to correspond to the number of sub-bands into which high band components of an input signal are divided. As necessary, the pseudo high band sub-band power calculation circuit 35 calculates pseudo high band sub-band powers using the coefficient table extended or reduced by the extension or reduction unit 121.

[Description of Encoding Processes]

Figure 34:
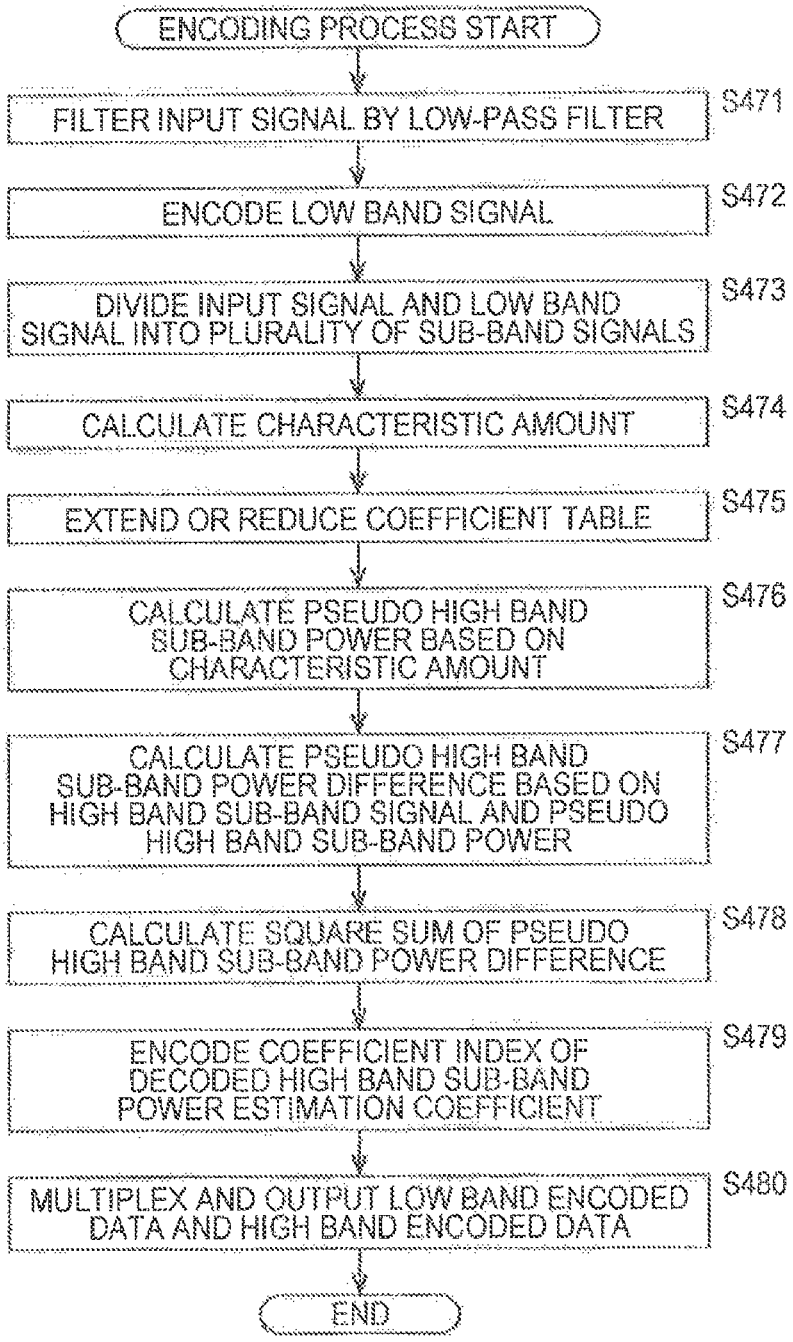
FIG. 34 is a flowchart describing an encoding process.

Next, encoding processes which are performed by the encoder 111 will be described with reference to the flowchart of FIG. 34. Here, since processes of step S471 to step S474 are the same as those of step S181 to S184 of FIG. 19, the description thereof will be omitted.

In step S475, the extension/reduction unit 121 extends or reduces a coefficient table as the decoding high band sub-band power estimation coefficients, which are recorded by the pseudo high band sub-band power calculation circuit 35, to correspond to the number of the high band sub-bands of the input signal, that is, the number of the high band sub-band signals.

For example, it is assumed that the high band components of the input signal are divided into high band sub-band signals of q sub-bands of the sub-bands sb+1 to sb+q. That is, it is assumed that pseudo high band sub-band powers of q sub-bands are calculated based on the low band sub-band signals.

In addition, it is assumed that a coefficient table having the coefficients $A_{ib}$(kb) and $B_{ib}$ of r sub-bands of the sub-bands sb+1 to sb+r is recorded in the pseudo high band sub-band power calculation circuit 35 as the decoding high band sub-band power estimation coefficients.

In this case, when q is greater than r (q>r), the extension/reduction unit 121 extends the coefficient table recorded in the pseudo high band sub-band power calculation circuit 35. That is, the extension/reduction unit 121 duplicates the coefficients $A_{sb+r}$(kb) and $B_{sb+r}$ of the sub-band sb+r included in the coefficient table and sets the duplicated coefficients to coefficients of the respective sub-bands of the sub-bands sb+r+1 to sb+q without any change. As a result, a coefficient table having the coefficients $A_{ib}$(kb) and $B_{ib}$ of q sub-bands is obtained.

In this case, when q is less than r (q<r), the extension/reduction unit 121 reduces the coefficient table recorded in the pseudo high band sub-band power calculation circuit 35. That is, the ex tension/reduction unit 121 deletes the coefficients $A_{ib}$(kb) and $B_{ib}$ of the respective sub-bands of the sub-bands sb+q+1 to sb+r included in the coefficient table. As a result, a coefficient table having the coefficients $A_{ib}$(kb) and $B_{ib}$ of the respective sub-bands of the sub-bands sb+1 to sb+q is obtained.

Furthermore, when q is equal to r (q=r), the extension/reduction unit 121 neither extends nor reduces the coefficient table recorded in the pseudo high band sub-band power calculation circuit 35.

In step S476, the pseudo high band sub-band power calculation circuit 35 calculates pseudo high band sub-band power differences based on the characteristic amounts supplied from the characteristic amount calculation circuit 34 to be supplied to the pseudo high band sub-band power difference calculation circuit 36.

For example, the pseudo high band sub-band power calculation circuit 35 performs the calculation according to the above-described expression (2) using the coefficient table, which is recorded as the decoding high band sub-band power estimation coefficients and, as necessary, is extended or reduced by the extension/reduction unit 121, and the low band sub-band powers power(kb, J) (wherein, sb−3≤kb≤sb); and calculates the pseudo high band sub-band powers $power_{est}$(ib, J).

That is, the low band sub-band powers of the respective sub-bands on the low band side which are supplied as the characteristic amounts are multiplied by the coefficients $A_{ib}$(kb) for the respective sub-bands, the coefficients $B_{ib}$ are further added to the sums of the low band sub-band powers which have been multiplied by the coefficients, and thus the pseudo high band sub-band powers $power_{est}$(ib, J) are obtained.

These pseudo high band sub-band powers are calculated for the respective sub-bands on the high band side.

In addition, the pseudo high band sub-band power calculation circuit 35 performs the calculation of the pseudo high band sub-band powers for the respective decoding high band sub-band power estimation coefficients (coefficient table) which are recorded in advance. For example, it is assumed that K decoding high band sub-band power estimation coefficients in which the coefficient index is 1 to K (wherein, 2≤K) are prepared in advance. In this case, for K decoding high band sub-band power estimation coefficients, as necessary, the coefficient tables is extended or reduced and the pseudo high band sub-band powers of the respective sub-bands are calculated.

In this way, when the coefficient tables is extended or reduced as necessary, the pseudo high band sub-band powers of the sub-bands sb+1 to eb can be appropriately calculated using the coefficient table which is recorded in advance, irrespective of the number of sub-bands on the high band side. Furthermore, the pseudo high band sub-band powers can be obtained with less decoding high band sub-band power estimation coefficients and higher efficiency.

After the pseudo high band sub-band powers are calculated in step S476, processes of step S477 and S478 are performed and the square sums of the pseudo high band sub-band power differences are calculated. Here, since these processes are the same as those of step S186 and step S187 of FIG. 19, the description thereof will be omitted.

In addition, in step S478, for K decoding high band sub-band power estimation coefficients, the sums of square differences E(J, id) are calculated. The pseudo high band sub-band power difference calculation circuit 36 selects the smallest sum of square differences among the calculated K sums of square differences E(J, id) and supplies the coefficient index, which indicates the decoding high band sub-band power estimation coefficients corresponding to the selected sum of square differences, to the high band encoding circuit 37.

After the coefficient index capable of estimating high band signals with highest accuracy is selected and supplied to the high band encoding circuit 37, processes of step S479 and Step S480 are performed and the encoding processes end. Here, since these processes are the same as those of step S188 and step S189 of FIG. 19, the description thereof will be omitted.

In this way, by outputting the low band encoded data and the high band encoded data as an output code string, in a decoder which receives the input of the output code string, the decoding high band sub-band power estimation coefficients, which are optimum for frequency band expansion process, can be obtained. As a result, a signal with higher sound quality can be obtained.

Furthermore, it is not necessary for the encoder 111 to record coefficient tables for the number of sub-bands into which high band components of an input signal are divided and thus a sound can be encoded with less coefficient tables and higher efficiency.

In addition, information indicating the number of sub-bands into which high band components of an input signal are divided may be included in the high band encoded data or information indicating the number of sub-bands may be transmitted to a decoder as separate data from the output code string.

[Functional Configuration Example of Decoder]

Figure 35:
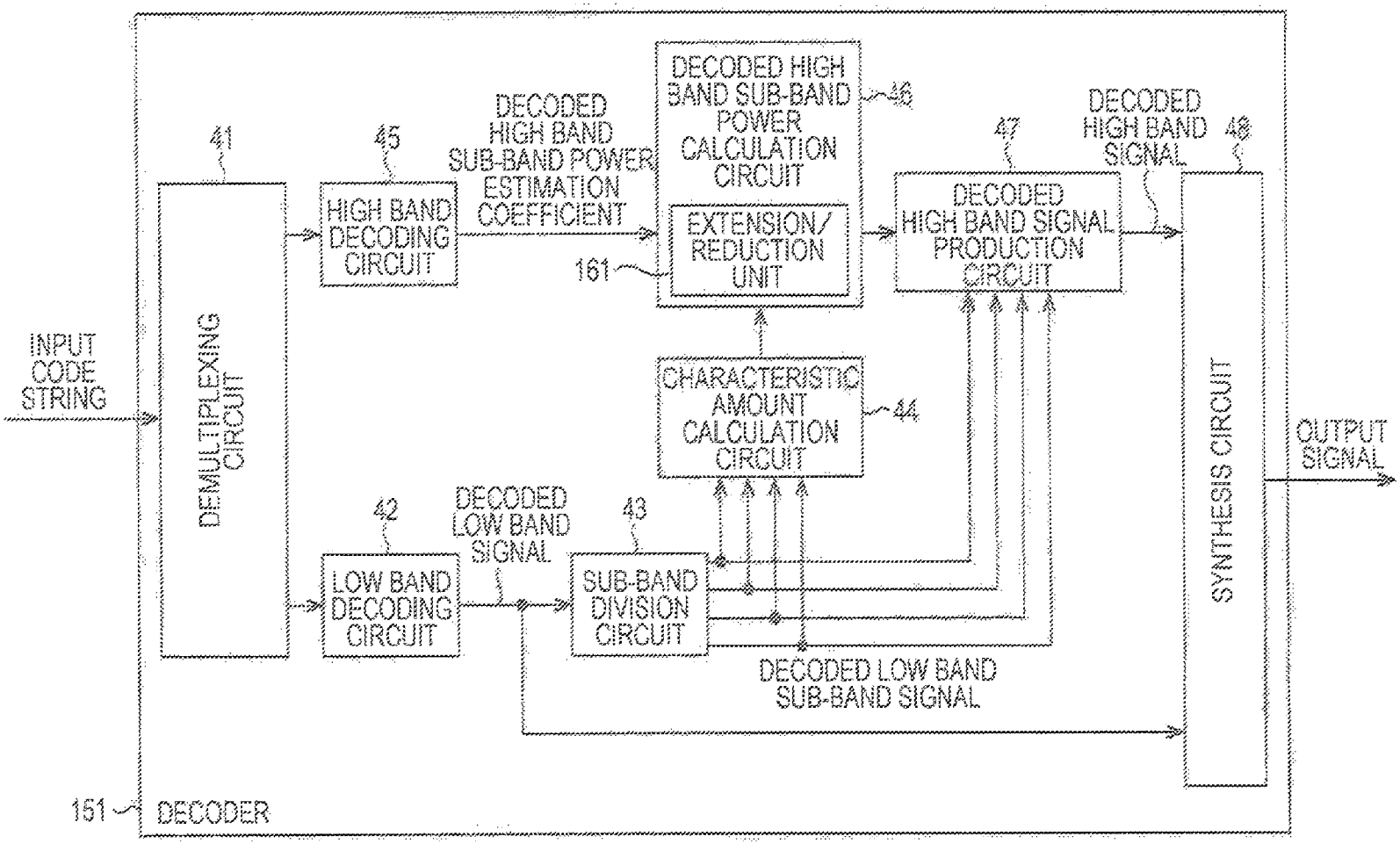
FIG. 35 is a block diagram illustrating a functional configuration example of a decoder.

In addition, a decoder which receives the output code string, output from the encoder 111 of FIG. 33, as an input code string to be decoded is configured as illustrated in, for example, FIG. 35. In FIG. 35, the same reference numbers are given to parts corresponding to those of the case illustrated in FIG. 20 and the description thereof will be appropriately omitted.

A decoder 151 of FIG. 35 is the same as the decoder 40 of FIG. 20 in that the demultiplexing circuit 41 to the synthesis unit 48 are provided, but is different from the decoder 40 of FIG. 20 in that the decoding high band sub-band power calculation circuit 46 is provided with an extension and reduction unit 161.

As necessary, the extension and reduction unit 161 extends or reduces a coefficient table as the decoding high band sub-band power estimation coefficients, which is supplied from the high band decoding circuit 45. The decoding high band sub-band power calculation circuit 46 calculates the decoded high band sub-band powers using the coefficient table extended or reduced as necessary.

[Description of Decoding Process]

Figure 36:
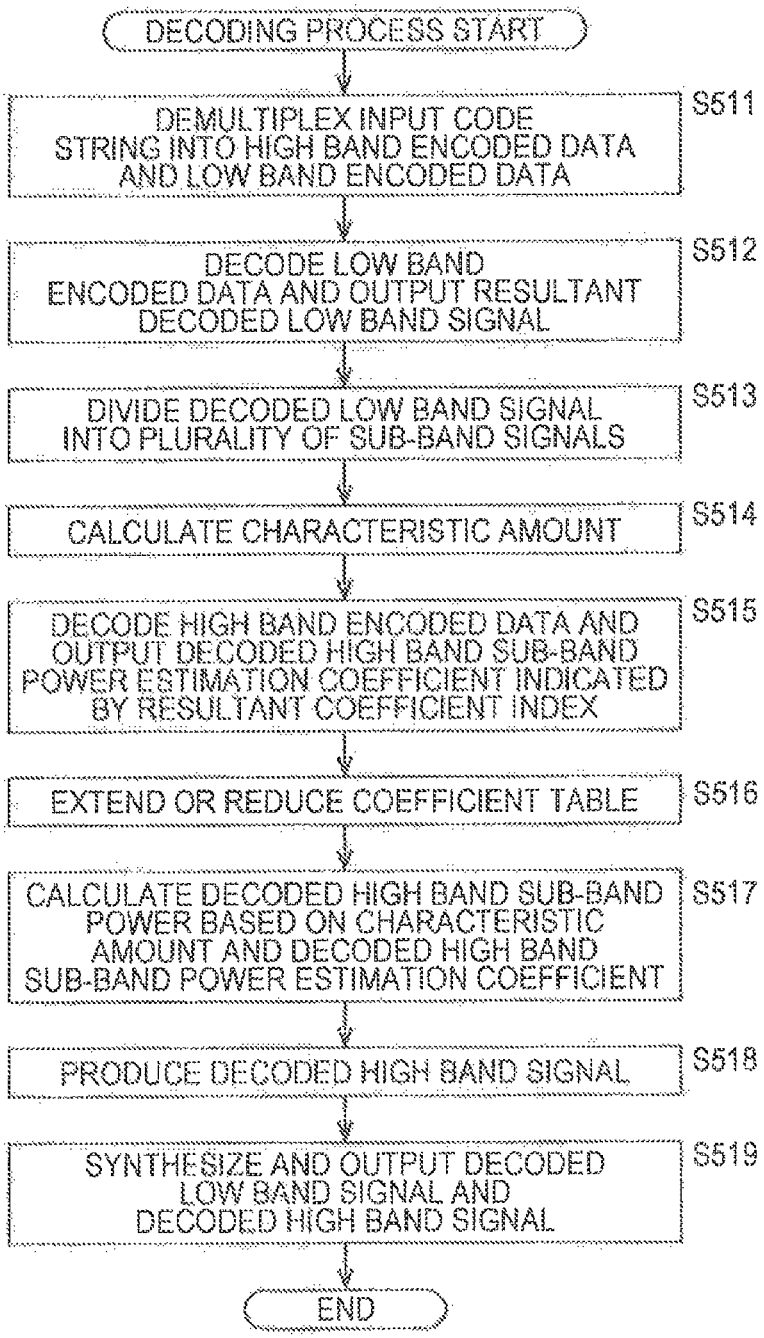
FIG. 36 is a flowchart describing a decoding process.

Next, decoding processes which are performed by the decoder 151 of FIG. 35 will be described with reference to the flowchart of FIG. 36. Since processes of step S511 to step S515 are the same as those of step S211 to step S215 of FIG. 21, the description thereof will be omitted.

In step S516, as necessary, the extension and reduction unit 161 extends or reduces the coefficient table as the decoding high band sub-band power estimation coefficients supplied from the high band decoding circuit 45.

Specifically, the decoding high band sub-band power calculation circuit 46 calculates decoded high band sub-band powers of q sub-bands of the sub-bands sb+1 to sb+q on the high band side. That is, it is assumed that the decoded high band signal includes components of q sub-bands.

Here, the number of sub-bands "q" on the high band side may be specified in advance in the decoder 151 or may be specified by the user. In addition, the information indicating the number of sub-bands on the high band side may be included in the high band encoded data or the information indicating the number of sub-bands on the high band side may be transmitted from the encoder 111 to the decoder 151 as separate data from the input code string.

In addition, it is assumed that a coefficient table having the coefficients $A_{ib}(kb)$ and $B_{ib}$ of r sub-bands of the sub-bands sb+1 to sb+r is recorded in the high band decoding circuit 45 as the decoding high band sub-band power estimation coefficients.

In this case, when q is greater than r (q>r), the extension and reduction unit 161 extends the coefficient table supplied from the high band decoding circuit 45. That is, the extension and reduction unit 161 duplicates the coefficients $A_{sb+r}(kb)$ and $B_{sb+r}$ of the sub-band sb+r included in the coefficient table and sets the duplicated coefficients to coefficients of the respective sub-bands of the sub-bands sb+r+1 to sb+q without any change. As a result, a coefficient table having the coefficients $A_{ib}(kb)$ and $B_{ib}$ of q sub-bands is obtained.

In this case, when q is less than r (q<r), the extension and reduction unit 161 reduces the coefficient table supplied from the high band decoding circuit 45. That is, the extension and reduction unit 161 deletes the coefficients $A_{ib}(kb)$ and $B_{ib}$ of the respective sub-bands of the sub-bands sb+q+1 to sb+r included in the coefficient table. As a result, a coefficient table having the coefficients $A_{ib}(kb)$ and $B_{ib}$ of the respective sub-bands of the sub-bands sb+1 to sb+q is obtained.

Furthermore, when q is equal to r (q=r), the extension and reduction unit 161 neither extends nor reduces the coefficient table supplied from the high band decoding circuit 45.

After the coefficient table is extended or reduced as necessary, processes of step S517 to step S519 are performed and the decoding processes end. However, since these processes are the same as those of step S216 to step S218 in FIG. 21, the description thereof will be omitted.

In this way, according to the decoder 151, the coefficient index is obtained from the high band encoded data obtained from the demultiplexing of the input code string; using the decoding high band sub-band power estimation coefficients indicated by the coefficient index, the decoded high band sub-band powers are calculated; and thus the estimation accuracy of the high band sub-band powers can be improved. As a result, a sound signal with higher quality can be reproduced.

Furthermore, in the decoder 151, it is not necessary that coefficient tables are recorded for the number of sub-bands constituting a decoded high band signal; and as a result, a sound can be decoded with less coefficient tables and higher efficiency.

8. Eighth Embodiment

Regarding Blended Learning Method

In the above-described cases, coefficient sets capable of dealing with the differences of the band-limited frequency, the sampling frequency, the coding, and the encoding algorithms are prepared, but there is a problem in that the size of tables increases. To deal with this problem, a method is contrived in which, using various band-limited frequencies, sampling frequencies, codings, and encoding algorithms as input, explanatory variables (sb−3 to sb) and explained variables (sb+1 to eb) are prepared and these are blended to perform learning. According to this method, for signals of various sampling frequencies, codings, and encoding algorithms, high band powers can be accurately estimated on average with one table.

Specifically, for example, as illustrated in FIG. 37, for the respective conditions A to D, explanatory variables and explained variables are obtained from broadband instruction signals and decoding high band sub-band power estimation coefficients (coefficient table) are obtained by learning.

In addition, in FIG. 37, the band-limited frequency represents the highest frequency among frequencies of components included in a low band signal or a decoding low band signal, and the sampling frequency represents the sampling frequency of an input signal or an output signal. In addition, the coding represents a coding system of an input signal, and the encoding algorithm represents an encoding method of a sound. For example, when encoding algorithms are different, decoding low band signals are different. As a result, for example, values of low band sub-band powers which are used as explained variables are different.

In a case where coefficient tables are obtained for the respective conditions, when a sound is encoded or decoded, one coefficient table is selected according to the conditions such as the coding and the encoding algorithm from the coefficient tables obtained for the conditions.

When the coefficient tables are obtained for the respective conditions as described above, in an encoder and a decoder, many coefficient tables should be recorded in advance for the respective conditions. Accordingly, there is a case where the size of a recording area where the coefficient tables are recorded increases.

Therefore, explanatory variables and explained variables, which are obtained from broadband instruction signals for the respective conditions, may be blended and perform learning; and using a coefficient table thus obtained, high band powers may be accurately estimated on average, irrespective of the conditions.

[Functional Configuration Example of Coefficient Learning Apparatus]

Figure 38:
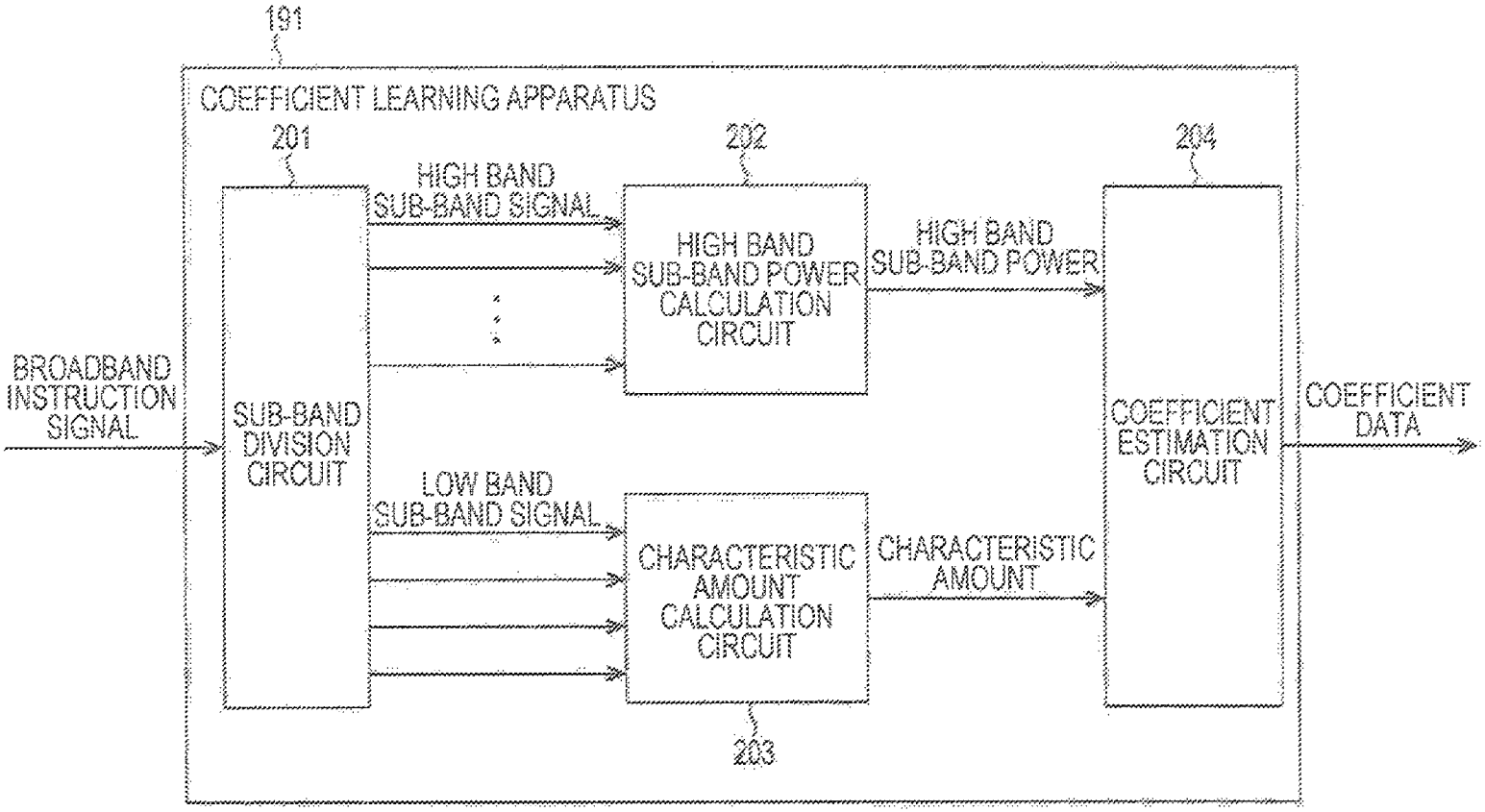
FIG. 38 is a view illustrating a configuration example of a coefficient learning apparatus.

In such a case, a coefficient learning apparatus, which produces a coefficient table as the decoding high band sub-band power estimation coefficients by learning, is configured as illustrated in, for example, FIG. 38.

A coefficient learning apparatus 191 includes a sub-band division circuit 201, a high band sub-band power calculation circuit 202, a characteristic amount calculation circuit 203, and a coefficient estimation circuit 204.

To this coefficient learning apparatus 191, a plurality of musical data with plural conditions which have different conditions such as conditions A to D illustrated in FIG. 37 are supplied as the broadband instruction signals. The broadband instruction signal represents a signal including plural high band sub-band components and plural low band sub-band components.

The sub-band division circuit 201 includes a band pass filter and divides a supplied broadband instruction signal into plural sub-band signals to be output to the high band sub-band power calculation circuit 202 and the characteristic amount calculation circuit 203. Specifically, high band sub-band signals of the respective sub-band on the high band side in which the index is sb+1 to eb are supplied to the high band sub-band power calculation circuit 202, and low band sub-band signals of the respective sub-band on the low band side in which the index is sb−3 to sb are supplied to the characteristic amount calculation circuit 203.

The high band sub-band power calculation circuit 202 calculates high band sub-band powers of the respective high band sub-band signals supplied from the sub-band division circuit 201 to be output to the coefficient estimation circuit 204.

The characteristic amount calculation circuit 203 calculates low band sub-band powers as the characteristic amounts based on the low band sub-band signals supplied from the sub-band division circuit 201 to be output to the coefficient estimation circuit 204.

The coefficient estimation circuit 204 performs regression analysis using the high band sub-band powers supplied from the high band sub-band power calculation circuit 202 and the characteristic amounts supplied from the characteristic amount calculation circuit 203, thereby generating and outputting decoding high band sub-band power estimation coefficients.

[Description of Coefficient Learning Processes]

Figure 39:
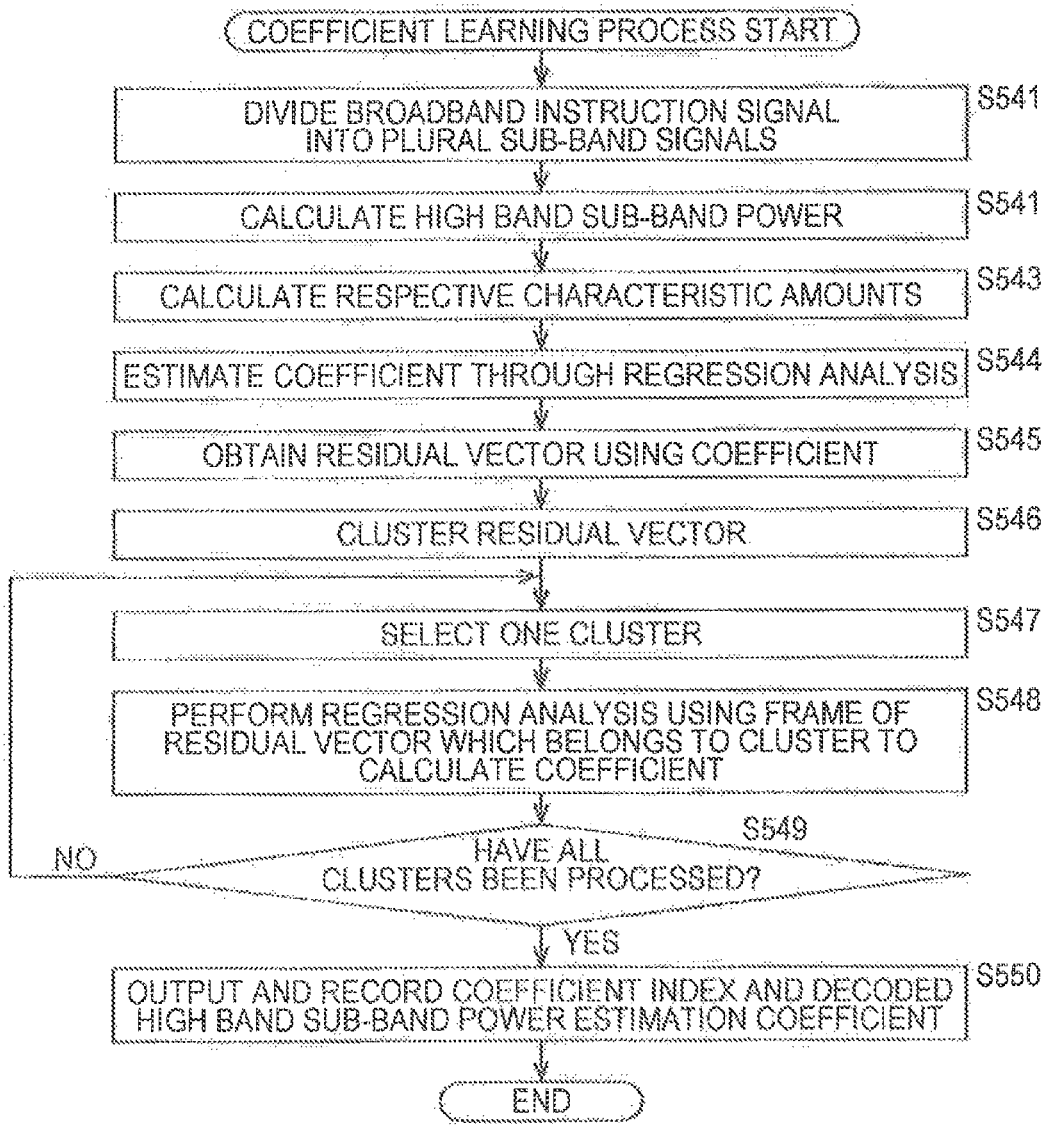
FIG. 39 is a flowchart describing a coefficient learning process.

Next, coefficient learning processes which are performed by the coefficient learning apparatus 191 will be described with reference to the flowchart of FIG. 39.

In step S541, the sub-band division circuit 201 divides plural supplied broadband instruction signals into plural sub-band signals, respectively. In addition, the sub-band division circuit 201 supplies high band signals of sub-bands, in which the index is sb+1 to eb, to the high band sub-band power calculation circuit 202 and supplies low band signals of sub-bands, in which the index is sb−3 to sb, to the characteristic amount calculation circuit 203.

The broadband instruction signal supplied to the sub-band division circuit 201 includes a plurality of musical data which have different conditions such as the sampling frequency. In addition, the broadband instruction signal is divided according to the different conditions, for example, is divided into the low band sub-band signals and high band sub-band signals according to different band-limited frequencies.

In step S542, the high band sub-band power calculation circuit 202 performs the same calculation as that of the above-described expression (1) with respect to the respective high band sub-band signals supplied from the sub-band division circuit 201; and thus calculates high band sub-band powers to be output to the coefficient estimation circuit 204.

In step S543, the characteristic amount calculation circuit 203 performs the same calculation as that of the above-described expression (1) with respect to the respective low band sub-band signals supplied from the sub-band division circuit 201; and thus calculates low band sub-band powers as the characteristic amounts to be output to the coefficient estimation circuit 204.

As a result, with respect to the respective frames of plural broadband instruction signals, the high band sub-band powers and the low band sub-band powers are supplied to the coefficient estimation circuit 204.

In step S544, the coefficient estimation circuit 204 performs regression analysis using a least-squares method to calculate the coefficients $A_{ib}(kb)$ and $B_{ib}$ for the respective sub-bands ib (wherein, $sb+1 \leq ib \leq eb$) on the high band side in which the index is sb+1 to eb.

In the regression analysis, the low band sub-band powers supplied from the characteristic amount calculation circuit 203 are set to explanatory variables, and the high band sub-band powers supplied from the high band sub-band power calculation circuit 202 are set to explained variables. In addition, the regression analysis is performed using the low band sub-band powers and the high band sub-band powers of all the frames, which constitute all the broadband instruction signals supplied to the coefficient learning apparatus 191.

In step S545, the coefficient estimation circuit 204 obtains residual vectors of the respective frames of the broadband instruction signals using the obtained coefficients $A_{ib}(kb)$ and $B_{ib}$ of the respective sub-bands ib.

For example, the coefficient estimation circuit 204 subtracts the sums between the sum total of the low band sub-band powers power(kb, J) (wherein, sb−3≤kb≤sb) which are multiplied by the coefficients $A_{ib}$(kb); and the sum of the coefficients $B_{ib}$, from the high band sub-band powers power(ib, J) for the respective sub-bands ib (wherein, sb+1≤ib≤eb) of the frame J, thereby calculating residual errors. In addition, vectors including the residual errors of the respective sub-bands ib of the frame J are set to the residual vectors.

In addition, the residual vectors are calculated for all the frames, which constitute all the broadband instruction signals supplied to the coefficient learning apparatus 191.

In step S546, the coefficient estimation circuit 204 clusters the residual vectors, obtained for the respective frames, into some clusters according to a k-means method or the like.

In addition, the coefficient estimation circuit 204 calculates central vectors of the clusters for the respective clusters and calculates the distances between the central vectors and the residual vectors of the clusters with respect to the residual vectors of the respective frames. In addition, the coefficient estimation circuit 204 specifies the clusters belonging to the respective frames, based on the calculated distances. That is, a cluster having a central vector, which has the shortest distance with a residual vector of a frame, is set to the cluster which belongs to the frame.

In step S547, the coefficient estimation circuit 204 selects one of the plural clusters, obtained by clustering, as a process target cluster.

In step S548, the coefficient estimation circuit 204 calculates the coefficients $A_{ib}$(kb) and $B_{ib}$ of the respective sub-bands ib (wherein, sb+1≤ib≤eb) by regression analysis using a frame of a residual vector which belongs to the cluster selected as the process target cluster.

That is, when the frame of the residual vector which belongs to the process target cluster is referred to as the process target frame, the low band sub-band powers and the high band sub-band powers of all the process target frames are set to explanatory variables and explained variables, thereby performing the regression analysis using a least-squares method. As a result, the coefficients $A_{ib}$(kb) and $B_{ib}$ are obtained for the respective sub-bands ib.

A coefficient table having the coefficients $A_{ib}$(kb) and $B_{ib}$ of the respective sub-bands thus obtained are set to the decoding high band sub-band power estimation coefficients and a coefficient index is given to this decoding high band sub-band power estimation coefficients.

In step S549, the coefficient learning apparatus 191 determines whether or not all the clusters are processes as the process target cluster. In step S549, when it is determined that all the clusters has yet to be processed, the process returns to step S547 and the above-described processes are repeated. That is, the next cluster is selected as the process target and the decoding high band sub-band power estimation coefficients are calculated.

On the other hand, in step S549, when it is determined that all the clusters are processed, a predetermined number of decoding high band sub-band power estimation coefficients, which have been desired to be obtained, are obtained. Therefore, the process processes to step S550.

In step S550, the coefficient estimation circuit 204 outputs the obtained coefficient index and the obtained decoding high band sub-band power estimation coefficients to an encoder or a decoder to be recorded and the coefficient learning processes end.

In this way, the coefficient learning apparatus 191 produces the decoding high band sub-band power estimation coefficients (coefficient table) of the respective coefficient indices from the supplied broadband instruction signals to be output. In this way, learning is performed using plural broadband instruction signals which have different conditions to produce a coefficient table; and as a result, the size of a recording area of coefficient tables can be reduced and high band sub-band powers can be accurately estimated on average.

The serial process described above is performed by a hardware and a software. When a serial process is performed by the software, a program constituted by the software is installed to a computer incorporated into an indicated software or a general-purpose personal computer capable of executing various functions by installing various programs from a program recording medium.

Figure 40:
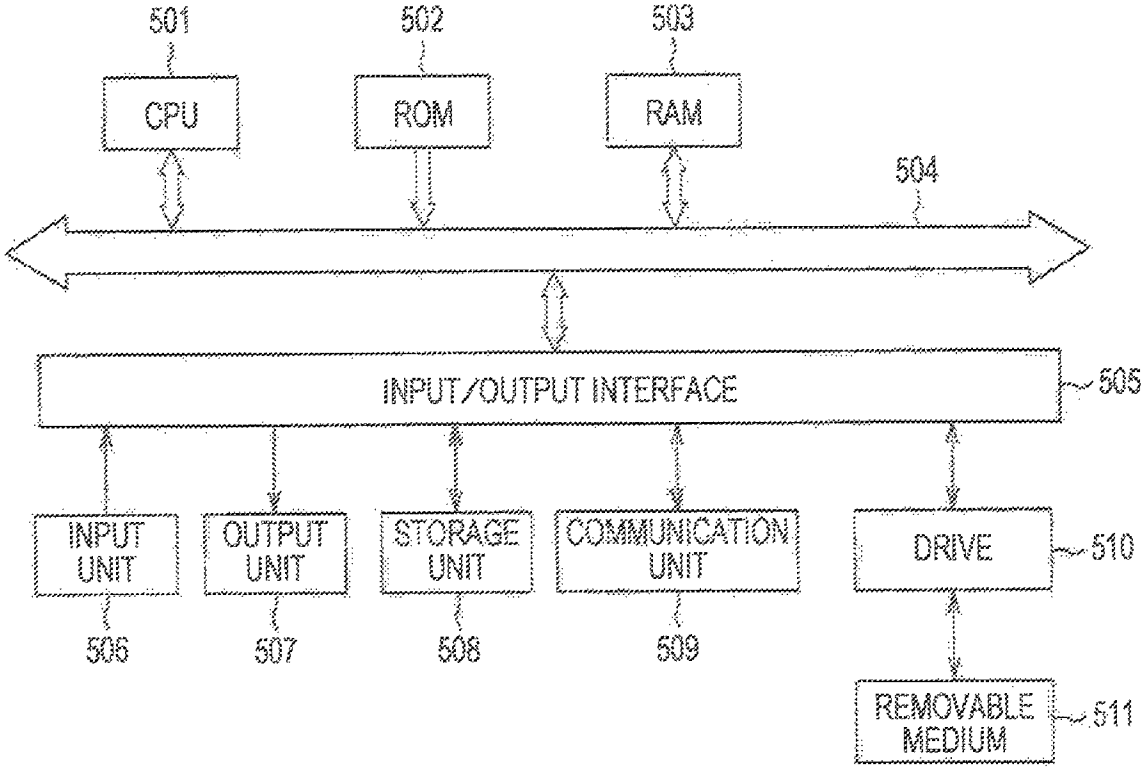
FIG. 40 is a block diagram illustrating a configuration example of hardware of a computer executing a process to which the present invention is applied by a program.

FIG. 40 is block diagram illustrating a configuration example of the hardware of a computer performing a series of processes described above by the computer.

In the computer, a CPU 501, a ROM (Read Only Memory) 502 and a RAM (Random Access Memory) 503 are connected each other by a bus 504.

In addition, an input/output interface 505 is connected to the bus 504. An input unit 506 including a key board, an mouse a microphone and the like, an output unit 507 including a display, a speaker and the like, a storage unit 508 including a hard disk or non-volatile memory and the like, a communication unit 509 including a network interface and the like, and a drive 520 that drives a removable medium 511 of a magnetic disc, an optical disc, a magneto-optical disc and semiconductor memory and the like are connected to the input/output interface 505.

In the computer configured as described above, for example, the CPU 501 loads and executes the program stored in the storage unit 508 to the RAM 503 via the input/output interface 505 and the bus 504 to perform a series of processes described above.

The program to be executed by the computer (CPU 501), for example, is recorded in a removable medium 511 such as a package medium including a magnetic disk, (including a flexible disc), an optical disc ((CD-ROM (Compact Disc-Read Only Memory)), DVD (Digital Versatile Disc) and the like), a magneto-optical disc or a semiconductor memory, or is provided via a wire or wireless transmission medium including a local area network, an internet and a digital satellite broadcasting.

In addition, the program can be installed to the storage unit 508 via the input/output interface 505 by mounting the removable medium 511 to the drive 510. In addition, the program is received in the communication unit 509 via the wire or wireless transmission medium and can be installed to the storage unit 508. In addition, the program can be installed in the ROM 502 or the storage unit 508 in advance.

In addition, the program performed by the computer may be a program where the process is performed in time sequence according the sequence described in the specification and a program where the process is performed in parallel or in timing necessary when a call is made.

In addition, the embodiment of the present invention is not limited the embodiment described above and various modifications is possible within a scope apart from a gist of the present invention.

REFERENCE SIGNS LIST

10 Frequency Band Expansion Apparatus
11 Low-pass filter
12 Delay Circuit
13, 13-1 to 13-N Band Pass Filter
14 Characteristic Amount Calculation Circuit

15 High Band Sub-Band Power Estimation Circuit
16 High Band Signal Production Circuit.
17 High-pass filter
18 Signal Adder
20 Coefficient Learning Apparatus
21, 21-1 to 21-(K+N) Band Pass Filter
22 High Band Sub-Band Power Calculation Circuit
23 Characteristic Amount Calculation Circuit
24 Coefficient Estimation Circuit
30 Encoder
31 Low-pass filter
32 Low Band Encoding Circuit
33 Sub-Band Division Circuit
34 Characteristic Amount Calculation Circuit
35 Pseudo High Band Sub-Band Power Calculation Circuit
36 Pseudo High Band Sub-band Power Difference Calculation Circuit
37 High Band Encoding Circuit
38 Multiplexing Circuit
40 Decoder
41 Demultiplexing Circuit
42 Low Band Decoding Circuit
43 Sub-Band Division Circuit
44 Characteristic Amount Calculation Circuit
45 High Band Decoding Circuit
46 Decoded High Band Sub-Band Power Calculation Circuit
47 Decoded High Band Signal. Production Circuit
48 Synthesis circuit
50 Coefficient Learning Apparatus
51 Low-pass filter
52 Sub-Band Division Circuit
53 Characteristic Amount Calculation Circuit
54 Pseudo High Band Sub-Band Power Calculation Circuit
55 Pseudo High Band Sub-Band Power Difference Calculation Circuit
56 Pseudo High Band Sub-Band Power Difference Clustering Circuit
57 Coefficient Estimation Circuit
101 CPU
102 ROM
103 RAM
104 Bus
105 Input/Output Interface
106 Input Unit
107 Output Unit
108 Storage Unit
109 Communication Unit
110 Drive
111 Removable Medium

The invention claimed is:

1. A decoder comprising:

a demultiplexing unit that demultiplexes input encoded data to at least low band encoded data and coefficient information;

a low band decoding unit that decodes the low band encoded data to produce low band signals;

a selection unit that selects coefficients based on the coefficient information for the production of high band signals;

a high band sub-band power calculation unit that calculates high band sub-band powers of high band sub-band signals constituting the high signals based on low band sub-band signals constituting the low band signals and the coefficients, wherein the coefficient for a sub-band having a highest frequency is used for at least another sub-band in the high band sub-band power calculation unit; and a high band signal production unit that produces the high band signals based on the high band-sub-band powers and the low band sub-band signals.

2. The decoder according to claim 1, wherein the high band signal production unit obtains a gain amount based on the high band sub-band powers.

3. The decoder according to claim 1, wherein the high band signals is supplied to a high-pass filter.

4. The decoder according to claim 1, wherein the high band sub-band powers are calculated by using a linear combination of a plurality of low band sub-band powers.

5. The decoder according to claim 1, wherein the low band decoding unit equally divides the low band signals into a plurality of sub-band signals having a predetermined bandwidth.

6. A decoding method of a decoder, comprising:

demultiplxing input encoded data to at least low band encoded data and coefficient information;

decoding the low band encoded data to produce low band signals;

selecting coefficients based on the coefficient information for the production of high band signals;

calculating high band sub-band powers of high band sub-band signals constituting the high band signals based on low band sub-band signals constituting the low band signals and the coefficients, wherein the coefficient for a sub-band having a highest frequency is used for at least another sub-band in the high band sub-band power calculation unit; and producing the high band signals based on the high band sub-band powers and the low band sub-band signals.

7. The decoding method according to claim 6, further comprising obtaining a gain amount based on the high band sub-band powers.

8. The decoding method according to claim 6, wherein the high band signals is supplied to a high-pass filter.

9. The decoding method according to claim 6, wherein the high band sub-band powers are calculated by using a linear combination of a plurality of low band sub-band powers.

10. The decoding methods according to claim 6, wherein the low band signals are divided into a plurality of sub-band signals having a predetermined bandwidth.

11. A non-transitory computer-readable medium having stored therein a program that comprises instructions for causing a computer to execute processes including:

demultiplexing input encoded data to at least low band encoded data and coefficient information;

decoding the low band encoded data to produce low band signals;

selecting coefficients based on the coefficient information for the production of high band signals;

calculating high band sub-band powers of high band sub-band signals constituting the high band signals based on low band sub-band signals constituting the low band signals and the coefficients, wherein the coefficient for a sub-band having a highest frequency in used for at least another sub-band in the high band sub-band power calculation unit; and producing the high band signals based on the high band sub-band powers and the low band sub-band signals.

12. The non-transitory computer-readable medium according to claim 11, wherein the instructions further causes the computer to execute processes including obtaining a gain amount based on the high band sub-band powers.

13. The non-transitory computer-readable medium according to claim 11, wherein the high band signals is supplied to a high-pass filter.

14. The non-transitory computer-readable medium according to claim 11, wherein the high band sub-band powers are calculated by using a linear combination of a plurality of low band-sub-band powers.

15. The non-transitory computer-readable medium according to claim 11, wherein the low band signals are divided into a plurality of sub-based signals having a predetermined bandwidth.

* * * * *